US007817170B2

(12) United States Patent
Miyagawa et al.

(10) Patent No.: US 7,817,170 B2
(45) Date of Patent: Oct. 19, 2010

(54) DISPLAY DEVICE AND METHOD FOR DRIVING THE SAME

(75) Inventors: Keisuke Miyagawa, Kanagawa (JP); Shou Nagao, Tochigi (JP); Hisashi Ohtani, Tochigi (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 826 days.

(21) Appl. No.: 11/658,968

(22) PCT Filed: Jul. 25, 2005

(86) PCT No.: PCT/JP2005/013986

§ 371 (c)(1),
(2), (4) Date: Jan. 30, 2007

(87) PCT Pub. No.: WO2006/013799

PCT Pub. Date: Feb. 9, 2006

(65) Prior Publication Data

US 2009/0189921 A1 Jul. 30, 2009

(30) Foreign Application Priority Data

Aug. 3, 2004 (JP) ..... 2004-227229

(51) Int. Cl.
*G09G 5/10* (2006.01)

(52) U.S. Cl. ..... 345/690; 345/63; 345/77; 345/89

(58) Field of Classification Search ..... 345/60, 345/63, 77, 690, 89
See application file for complete search history.

(56) References Cited

U.S. PATENT DOCUMENTS 5,696,941 A * 12/1997 Jung ..... 710/3
5,818,419 A * 10/1998 Tajima et al. ..... 345/691
5,907,316 A * 5/1999 Mikoshiba et al. ..... 345/596
6,008,793 A * 12/1999 Shigeta ..... 345/204

(Continued)

FOREIGN PATENT DOCUMENTS

EP 0 869 467 A2 10/1998

(Continued)

OTHER PUBLICATIONS

International Search Report re application No. PCT/JP2005/013986, dated Sep. 20, 2005.

(Continued)

*Primary Examiner*—Amare Mengistu
*Assistant Examiner*—Koosha Sharifi-Tafreshi
(74) *Attorney, Agent, or Firm*—Husch Blackwell LLP Welsh Katz

(57) ABSTRACT

The invention provides a driving method of a semiconductor display device in which generation of a pseudo contour can be suppressed while the operating frequency of a driver circuit is suppressed. Furthermore, the invention provides a driving method of a semiconductor display device in which generation of a pseudo contour can be suppressed while the decrease in image quality is suppressed. In a semiconductor display device including a plurality of pixels, tables each storing data for determining a subframe period for light emission among a plurality of subframe periods are provided for a plurality of arbitrary pixels among the plurality of pixels respectively. The table is stored in a memory.

13 Claims, 35 Drawing Sheets

U.S. PATENT DOCUMENTS

| | | | | |
|---|---|---|---|---|
| 6,064,356 | A * | 5/2000 | Shigeta | 345/63 |
| 6,091,398 | A * | 7/2000 | Shigeta | 345/204 |
| 6,144,364 | A * | 11/2000 | Otobe et al. | 345/691 |
| 6,222,512 | B1 | 4/2001 | Tajima et al. | |
| 6,249,265 | B1 | 6/2001 | Tajima et al. | |
| 6,268,890 | B1 | 7/2001 | Kawahara | |
| 6,614,413 | B2 | 9/2003 | Tokunaga et al. | |
| 2002/0005857 | A1 * | 1/2002 | Kasahara et al. | 345/611 |
| 2002/0054000 | A1 | 5/2002 | Tokunaga et al. | |
| 2004/0070590 | A1 | 4/2004 | Lee et al. | |
| 2005/0259121 | A1 | 11/2005 | Miyagawa | |

FOREIGN PATENT DOCUMENTS

| | | | |
|---|---|---|---|
| EP | 0 952 569 | A2 | 10/1999 |
| EP | 1 359 561 | A1 | 11/2003 |
| EP | 1 408 683 | A2 | 4/2004 |
| JP | 07-271325 | | 10/1995 |
| JP | 10-319904 | | 12/1998 |
| JP | 11-288240 | | 10/1999 |
| JP | 2000-231362 | | 8/2000 |
| JP | 2004-133260 | | 4/2004 |
| JP | 2004-133467 | | 4/2004 |
| JP | 2004-138783 | | 5/2004 |

OTHER PUBLICATIONS

Written Opinion re application No. PCT/JP2005/013986, dated Sep. 20, 2005.

* cited by examiner

FIG.20A

| gray scale level | length (ratio) of corresponding subframe | | | | | | | | | | | | | | | | sharing ratio (%) |
|---|---|---|---|---|---|---|---|---|---|---|---|---|---|---|---|---|---|
| | 1 | 2 | 4 | 8 | 10 | 10 | 10 | 12 | 12 | 14 | 17 | 21 | 25 | 30 | 36 | 43 | |
| 0 | 0 | 0 | 0 | 0 | 0 | 0 | 0 | 0 | 0 | 0 | 0 | 0 | 0 | 0 | 0 | 0 | - |
| 1 | 1 | 0 | 0 | 0 | 0 | 0 | 0 | 0 | 0 | 0 | 0 | 0 | 0 | 0 | 0 | 0 | 0.0 |
| 2 | 0 | 1 | 0 | 0 | 0 | 0 | 0 | 0 | 0 | 0 | 0 | 0 | 0 | 0 | 0 | 0 | 0.0 |
| 3 | 1 | 1 | 0 | 0 | 0 | 0 | 0 | 0 | 0 | 0 | 0 | 0 | 0 | 0 | 0 | 0 | 66.7 |
| 4 | 0 | 0 | 1 | 0 | 0 | 0 | 0 | 0 | 0 | 0 | 0 | 0 | 0 | 0 | 0 | 0 | 0.0 |
| 5 | 1 | 0 | 1 | 0 | 0 | 0 | 0 | 0 | 0 | 0 | 0 | 0 | 0 | 0 | 0 | 0 | 80.0 |
| 6 | 0 | 1 | 1 | 0 | 0 | 0 | 0 | 0 | 0 | 0 | 0 | 0 | 0 | 0 | 0 | 0 | 66.7 |
| 7 | 1 | 1 | 1 | 0 | 0 | 0 | 0 | 0 | 0 | 0 | 0 | 0 | 0 | 0 | 0 | 0 | 85.7 |
| 8 | 0 | 0 | 0 | 1 | 0 | 0 | 0 | 0 | 0 | 0 | 0 | 0 | 0 | 0 | 0 | 0 | 0.0 |
| 9 | 1 | 0 | 0 | 1 | 0 | 0 | 0 | 0 | 0 | 0 | 0 | 0 | 0 | 0 | 0 | 0 | 88.9 |
| 10 | 0 | 1 | 0 | 1 | 0 | 0 | 0 | 0 | 0 | 0 | 0 | 0 | 0 | 0 | 0 | 0 | 80.0 |
| 11 | 1 | 1 | 0 | 1 | 0 | 0 | 0 | 0 | 0 | 0 | 0 | 0 | 0 | 0 | 0 | 0 | 90.9 |
| 12 | 0 | 0 | 1 | 1 | 0 | 0 | 0 | 0 | 0 | 0 | 0 | 0 | 0 | 0 | 0 | 0 | 66.7 |
| 13 | 1 | 0 | 1 | 1 | 0 | 0 | 0 | 0 | 0 | 0 | 0 | 0 | 0 | 0 | 0 | 0 | 92.3 |
| 14 | 0 | 1 | 1 | 1 | 0 | 0 | 0 | 0 | 0 | 0 | 0 | 0 | 0 | 0 | 0 | 0 | 85.7 |
| 15 | 1 | 1 | 1 | 1 | 0 | 0 | 0 | 0 | 0 | 0 | 0 | 0 | 0 | 0 | 0 | 0 | 93.3 |
| 16 | 0 | 1 | 1 | 0 | 1 | 0 | 0 | 0 | 0 | 0 | 0 | 0 | 0 | 0 | 0 | 0 | 37.5 |
| 17 | 1 | 1 | 1 | 0 | 1 | 0 | 0 | 0 | 0 | 0 | 0 | 0 | 0 | 0 | 0 | 0 | 94.1 |
| 18 | 0 | 0 | 0 | 1 | 1 | 0 | 0 | 0 | 0 | 0 | 0 | 0 | 0 | 0 | 0 | 0 | 55.6 |
| 19 | 1 | 0 | 0 | 1 | 1 | 0 | 0 | 0 | 0 | 0 | 0 | 0 | 0 | 0 | 0 | 0 | 94.7 |
| 20 | 0 | 1 | 0 | 1 | 1 | 0 | 0 | 0 | 0 | 0 | 0 | 0 | 0 | 0 | 0 | 0 | 90.0 |
| 21 | 1 | 1 | 0 | 1 | 1 | 0 | 0 | 0 | 0 | 0 | 0 | 0 | 0 | 0 | 0 | 0 | 95.2 |
| 22 | 0 | 0 | 1 | 1 | 1 | 0 | 0 | 0 | 0 | 0 | 0 | 0 | 0 | 0 | 0 | 0 | 81.8 |
| 23 | 1 | 0 | 1 | 1 | 1 | 0 | 0 | 0 | 0 | 0 | 0 | 0 | 0 | 0 | 0 | 0 | 95.7 |
| 24 | 0 | 1 | 1 | 1 | 1 | 0 | 0 | 0 | 0 | 0 | 0 | 0 | 0 | 0 | 0 | 0 | 91.7 |
| 25 | 1 | 1 | 1 | 1 | 1 | 0 | 0 | 0 | 0 | 0 | 0 | 0 | 0 | 0 | 0 | 0 | 96.0 |
| 26 | 0 | 1 | 1 | 0 | 1 | 1 | 0 | 0 | 0 | 0 | 0 | 0 | 0 | 0 | 0 | 0 | 61.5 |
| 27 | 1 | 1 | 1 | 0 | 1 | 1 | 0 | 0 | 0 | 0 | 0 | 0 | 0 | 0 | 0 | 0 | 96.3 |
| 28 | 0 | 0 | 0 | 1 | 1 | 1 | 0 | 0 | 0 | 0 | 0 | 0 | 0 | 0 | 0 | 0 | 71.4 |
| 29 | 1 | 0 | 0 | 1 | 1 | 1 | 0 | 0 | 0 | 0 | 0 | 0 | 0 | 0 | 0 | 0 | 96.6 |
| 30 | 0 | 1 | 0 | 1 | 1 | 1 | 0 | 0 | 0 | 0 | 0 | 0 | 0 | 0 | 0 | 0 | 93.3 |
| 31 | 1 | 1 | 0 | 1 | 1 | 1 | 0 | 0 | 0 | 0 | 0 | 0 | 0 | 0 | 0 | 0 | 96.8 |
| 32 | 0 | 0 | 1 | 1 | 1 | 1 | 0 | 0 | 0 | 0 | 0 | 0 | 0 | 0 | 0 | 0 | 87.5 |
| 33 | 1 | 0 | 1 | 1 | 1 | 1 | 0 | 0 | 0 | 0 | 0 | 0 | 0 | 0 | 0 | 0 | 97.0 |
| 34 | 0 | 1 | 1 | 1 | 1 | 1 | 0 | 0 | 0 | 0 | 0 | 0 | 0 | 0 | 0 | 0 | 94.1 |
| 35 | 1 | 1 | 1 | 1 | 1 | 1 | 0 | 0 | 0 | 0 | 0 | 0 | 0 | 0 | 0 | 0 | 97.1 |
| 36 | 0 | 1 | 1 | 0 | 1 | 1 | 1 | 0 | 0 | 0 | 0 | 0 | 0 | 0 | 0 | 0 | 72.2 |
| 37 | 1 | 1 | 1 | 0 | 1 | 1 | 1 | 0 | 0 | 0 | 0 | 0 | 0 | 0 | 0 | 0 | 97.3 |
| 38 | 0 | 0 | 0 | 1 | 1 | 1 | 1 | 0 | 0 | 0 | 0 | 0 | 0 | 0 | 0 | 0 | 78.9 |
| 39 | 1 | 0 | 0 | 1 | 1 | 1 | 1 | 0 | 0 | 0 | 0 | 0 | 0 | 0 | 0 | 0 | 97.4 |
| 40 | 0 | 1 | 0 | 1 | 1 | 1 | 1 | 0 | 0 | 0 | 0 | 0 | 0 | 0 | 0 | 0 | 95.0 |
| 41 | 1 | 1 | 0 | 1 | 1 | 1 | 1 | 0 | 0 | 0 | 0 | 0 | 0 | 0 | 0 | 0 | 97.6 |
| 42 | 0 | 0 | 1 | 1 | 1 | 1 | 1 | 0 | 0 | 0 | 0 | 0 | 0 | 0 | 0 | 0 | 90.5 |
| 43 | 1 | 0 | 1 | 1 | 1 | 1 | 1 | 0 | 0 | 0 | 0 | 0 | 0 | 0 | 0 | 0 | 97.7 |
| 44 | 0 | 1 | 1 | 1 | 1 | 1 | 1 | 0 | 0 | 0 | 0 | 0 | 0 | 0 | 0 | 0 | 95.5 |
| 45 | 1 | 1 | 1 | 1 | 1 | 1 | 1 | 0 | 0 | 0 | 0 | 0 | 0 | 0 | 0 | 0 | 97.8 |
| 46 | 0 | 1 | 1 | 1 | 1 | 1 | 0 | 1 | 0 | 0 | 0 | 0 | 0 | 0 | 0 | 0 | 73.9 |
| 47 | 1 | 1 | 1 | 1 | 1 | 1 | 0 | 1 | 0 | 0 | 0 | 0 | 0 | 0 | 0 | 0 | 97.9 |
| 48 | 0 | 1 | 1 | 0 | 1 | 1 | 1 | 1 | 0 | 0 | 0 | 0 | 0 | 0 | 0 | 0 | 79.2 |
| 49 | 1 | 1 | 1 | 0 | 1 | 1 | 1 | 1 | 0 | 0 | 0 | 0 | 0 | 0 | 0 | 0 | 98.0 |
| 50 | 0 | 0 | 0 | 1 | 1 | 1 | 1 | 1 | 0 | 0 | 0 | 0 | 0 | 0 | 0 | 0 | 84.0 |
| 51 | 1 | 0 | 0 | 1 | 1 | 1 | 1 | 1 | 0 | 0 | 0 | 0 | 0 | 0 | 0 | 0 | 98.0 |
| 52 | 0 | 1 | 0 | 1 | 1 | 1 | 1 | 1 | 0 | 0 | 0 | 0 | 0 | 0 | 0 | 0 | 96.2 |
| 53 | 1 | 1 | 0 | 1 | 1 | 1 | 1 | 1 | 0 | 0 | 0 | 0 | 0 | 0 | 0 | 0 | 98.1 |
| 54 | 0 | 0 | 1 | 1 | 1 | 1 | 1 | 1 | 0 | 0 | 0 | 0 | 0 | 0 | 0 | 0 | 92.6 |
| 55 | 1 | 0 | 1 | 1 | 1 | 1 | 1 | 1 | 0 | 0 | 0 | 0 | 0 | 0 | 0 | 0 | 98.2 |
| 56 | 0 | 1 | 1 | 1 | 1 | 1 | 1 | 1 | 0 | 0 | 0 | 0 | 0 | 0 | 0 | 0 | 96.4 |
| 57 | 1 | 1 | 1 | 1 | 1 | 1 | 1 | 1 | 0 | 0 | 0 | 0 | 0 | 0 | 0 | 0 | 98.2 |
| 58 | 0 | 1 | 1 | 1 | 1 | 1 | 0 | 1 | 1 | 0 | 0 | 0 | 0 | 0 | 0 | 0 | 79.3 |
| 59 | 1 | 1 | 1 | 1 | 1 | 1 | 0 | 1 | 1 | 0 | 0 | 0 | 0 | 0 | 0 | 0 | 98.3 |
| 60 | 0 | 1 | 1 | 0 | 1 | 1 | 1 | 1 | 1 | 0 | 0 | 0 | 0 | 0 | 0 | 0 | 83.3 |
| 61 | 1 | 1 | 1 | 0 | 1 | 1 | 1 | 1 | 1 | 0 | 0 | 0 | 0 | 0 | 0 | 0 | 98.4 |
| 62 | 0 | 0 | 0 | 1 | 1 | 1 | 1 | 1 | 1 | 0 | 0 | 0 | 0 | 0 | 0 | 0 | 87.1 |
| 63 | 1 | 0 | 0 | 1 | 1 | 1 | 1 | 1 | 1 | 0 | 0 | 0 | 0 | 0 | 0 | 0 | 98.4 |
| 64 | 0 | 1 | 0 | 1 | 1 | 1 | 1 | 1 | 1 | 0 | 0 | 0 | 0 | 0 | 0 | 0 | 96.9 |
| 65 | 1 | 1 | 0 | 1 | 1 | 1 | 1 | 1 | 1 | 0 | 0 | 0 | 0 | 0 | 0 | 0 | 98.5 |

FIG.20B

| gray scale level | length (ratio) of corresponding subframe | | | | | | | | | | | | | | | | sharing ratio (%) |
|---|---|---|---|---|---|---|---|---|---|---|---|---|---|---|---|---|---|
| | 1 | 2 | 4 | 8 | 10 | 10 | 10 | 12 | 12 | 14 | 17 | 21 | 25 | 30 | 36 | 43 | |
| 66 | 0 | 0 | 1 | 1 | 1 | 1 | 1 | 1 | 1 | 0 | 0 | 0 | 0 | 0 | 0 | 0 | 93.9 |
| 67 | 1 | 0 | 1 | 1 | 1 | 1 | 1 | 1 | 1 | 0 | 0 | 0 | 0 | 0 | 0 | 0 | 98.5 |
| 68 | 0 | 1 | 1 | 1 | 1 | 1 | 1 | 1 | 1 | 0 | 0 | 0 | 0 | 0 | 0 | 0 | 97.1 |
| 69 | 1 | 1 | 1 | 1 | 1 | 1 | 1 | 1 | 1 | 0 | 0 | 0 | 0 | 0 | 0 | 0 | 98.6 |
| 70 | 0 | 1 | 1 | 1 | 1 | 1 | 1 | 1 | 0 | 1 | 0 | 0 | 0 | 0 | 0 | 0 | 80.0 |
| 71 | 1 | 1 | 1 | 1 | 1 | 1 | 1 | 1 | 0 | 1 | 0 | 0 | 0 | 0 | 0 | 0 | 98.6 |
| 72 | 0 | 1 | 1 | 1 | 1 | 1 | 0 | 1 | 1 | 1 | 0 | 0 | 0 | 0 | 0 | 0 | 83.3 |
| 73 | 1 | 1 | 1 | 1 | 1 | 1 | 0 | 1 | 1 | 1 | 0 | 0 | 0 | 0 | 0 | 0 | 98.6 |
| 74 | 0 | 1 | 1 | 0 | 1 | 1 | 1 | 1 | 1 | 1 | 0 | 0 | 0 | 0 | 0 | 0 | 86.5 |
| 75 | 1 | 1 | 1 | 0 | 1 | 1 | 1 | 1 | 1 | 1 | 0 | 0 | 0 | 0 | 0 | 0 | 98.7 |
| 76 | 0 | 0 | 0 | 1 | 1 | 1 | 1 | 1 | 1 | 1 | 0 | 0 | 0 | 0 | 0 | 0 | 89.5 |
| 77 | 1 | 0 | 0 | 1 | 1 | 1 | 1 | 1 | 1 | 1 | 0 | 0 | 0 | 0 | 0 | 0 | 98.7 |
| 78 | 0 | 1 | 0 | 1 | 1 | 1 | 1 | 1 | 1 | 1 | 0 | 0 | 0 | 0 | 0 | 0 | 97.4 |
| 79 | 1 | 1 | 0 | 1 | 1 | 1 | 1 | 1 | 1 | 1 | 0 | 0 | 0 | 0 | 0 | 0 | 98.7 |
| 80 | 0 | 0 | 1 | 1 | 1 | 1 | 1 | 1 | 1 | 1 | 0 | 0 | 0 | 0 | 0 | 0 | 95.0 |
| 81 | 1 | 0 | 1 | 1 | 1 | 1 | 1 | 1 | 1 | 1 | 0 | 0 | 0 | 0 | 0 | 0 | 98.8 |
| 82 | 0 | 1 | 1 | 1 | 1 | 1 | 1 | 1 | 1 | 1 | 0 | 0 | 0 | 0 | 0 | 0 | 97.6 |
| 83 | 1 | 1 | 1 | 1 | 1 | 1 | 1 | 1 | 1 | 1 | 0 | 0 | 0 | 0 | 0 | 0 | 98.8 |
| 84 | 1 | 0 | 1 | 1 | 1 | 1 | 1 | 1 | 1 | 0 | 1 | 0 | 0 | 0 | 0 | 0 | 79.8 |
| 85 | 0 | 1 | 1 | 1 | 1 | 1 | 1 | 1 | 1 | 0 | 1 | 0 | 0 | 0 | 0 | 0 | 97.6 |
| 86 | 1 | 1 | 1 | 1 | 1 | 1 | 1 | 1 | 1 | 0 | 1 | 0 | 0 | 0 | 0 | 0 | 98.8 |
| 87 | 0 | 1 | 1 | 1 | 1 | 1 | 1 | 1 | 0 | 1 | 1 | 0 | 0 | 0 | 0 | 0 | 83.9 |
| 88 | 1 | 1 | 1 | 1 | 1 | 1 | 1 | 1 | 0 | 1 | 1 | 0 | 0 | 0 | 0 | 0 | 98.9 |
| 89 | 0 | 1 | 1 | 1 | 1 | 1 | 0 | 1 | 1 | 1 | 1 | 0 | 0 | 0 | 0 | 0 | 86.5 |
| 90 | 1 | 1 | 1 | 1 | 1 | 1 | 0 | 1 | 1 | 1 | 1 | 0 | 0 | 0 | 0 | 0 | 98.9 |
| 91 | 0 | 1 | 1 | 0 | 1 | 1 | 1 | 1 | 1 | 1 | 1 | 0 | 0 | 0 | 0 | 0 | 89.0 |
| 92 | 1 | 1 | 1 | 0 | 1 | 1 | 1 | 1 | 1 | 1 | 1 | 0 | 0 | 0 | 0 | 0 | 98.9 |
| 93 | 0 | 0 | 0 | 1 | 1 | 1 | 1 | 1 | 1 | 1 | 1 | 0 | 0 | 0 | 0 | 0 | 91.4 |
| 94 | 1 | 0 | 0 | 1 | 1 | 1 | 1 | 1 | 1 | 1 | 1 | 0 | 0 | 0 | 0 | 0 | 98.9 |
| 95 | 0 | 1 | 0 | 1 | 1 | 1 | 1 | 1 | 1 | 1 | 1 | 0 | 0 | 0 | 0 | 0 | 97.9 |
| 96 | 1 | 1 | 0 | 1 | 1 | 1 | 1 | 1 | 1 | 1 | 1 | 0 | 0 | 0 | 0 | 0 | 99.0 |
| 97 | 0 | 0 | 1 | 1 | 1 | 1 | 1 | 1 | 1 | 1 | 1 | 0 | 0 | 0 | 0 | 0 | 95.9 |
| 98 | 1 | 0 | 1 | 1 | 1 | 1 | 1 | 1 | 1 | 1 | 1 | 0 | 0 | 0 | 0 | 0 | 99.0 |
| 99 | 0 | 1 | 1 | 1 | 1 | 1 | 1 | 1 | 1 | 1 | 1 | 0 | 0 | 0 | 0 | 0 | 98.0 |
| 100 | 1 | 1 | 1 | 1 | 1 | 1 | 1 | 1 | 1 | 1 | 1 | 0 | 0 | 0 | 0 | 0 | 99.0 |
| 101 | 0 | 0 | 1 | 1 | 1 | 1 | 1 | 1 | 1 | 1 | 0 | 1 | 0 | 0 | 0 | 0 | 79.2 |
| 102 | 1 | 0 | 1 | 1 | 1 | 1 | 1 | 1 | 1 | 1 | 0 | 1 | 0 | 0 | 0 | 0 | 99.0 |
| 103 | 0 | 1 | 1 | 1 | 1 | 1 | 1 | 1 | 1 | 1 | 0 | 1 | 0 | 0 | 0 | 0 | 98.1 |
| 104 | 1 | 1 | 1 | 1 | 1 | 1 | 1 | 1 | 1 | 1 | 0 | 1 | 0 | 0 | 0 | 0 | 99.0 |
| 105 | 1 | 0 | 1 | 1 | 1 | 1 | 1 | 1 | 1 | 0 | 1 | 1 | 0 | 0 | 0 | 0 | 83.8 |
| 106 | 0 | 1 | 1 | 1 | 1 | 1 | 1 | 1 | 1 | 0 | 1 | 1 | 0 | 0 | 0 | 0 | 98.1 |
| 107 | 1 | 1 | 1 | 1 | 1 | 1 | 1 | 1 | 1 | 0 | 1 | 1 | 0 | 0 | 0 | 0 | 99.1 |
| 108 | 0 | 1 | 1 | 1 | 1 | 1 | 1 | 1 | 0 | 1 | 1 | 1 | 0 | 0 | 0 | 0 | 87.0 |
| 109 | 1 | 1 | 1 | 1 | 1 | 1 | 1 | 1 | 0 | 1 | 1 | 1 | 0 | 0 | 0 | 0 | 99.1 |
| 110 | 0 | 1 | 1 | 1 | 1 | 1 | 0 | 1 | 1 | 1 | 1 | 1 | 0 | 0 | 0 | 0 | 89.1 |
| 111 | 1 | 1 | 1 | 1 | 1 | 1 | 0 | 1 | 1 | 1 | 1 | 1 | 0 | 0 | 0 | 0 | 99.1 |
| 112 | 0 | 1 | 1 | 0 | 1 | 1 | 1 | 1 | 1 | 1 | 1 | 1 | 0 | 0 | 0 | 0 | 91.1 |
| 113 | 1 | 1 | 1 | 0 | 1 | 1 | 1 | 1 | 1 | 1 | 1 | 1 | 0 | 0 | 0 | 0 | 99.1 |
| 114 | 0 | 0 | 0 | 1 | 1 | 1 | 1 | 1 | 1 | 1 | 1 | 1 | 0 | 0 | 0 | 0 | 93.0 |
| 115 | 1 | 0 | 0 | 1 | 1 | 1 | 1 | 1 | 1 | 1 | 1 | 1 | 0 | 0 | 0 | 0 | 99.1 |
| 116 | 0 | 1 | 0 | 1 | 1 | 1 | 1 | 1 | 1 | 1 | 1 | 1 | 0 | 0 | 0 | 0 | 98.3 |
| 117 | 1 | 1 | 0 | 1 | 1 | 1 | 1 | 1 | 1 | 1 | 1 | 1 | 0 | 0 | 0 | 0 | 99.1 |
| 118 | 0 | 0 | 1 | 1 | 1 | 1 | 1 | 1 | 1 | 1 | 1 | 1 | 0 | 0 | 0 | 0 | 96.6 |
| 119 | 1 | 0 | 1 | 1 | 1 | 1 | 1 | 1 | 1 | 1 | 1 | 1 | 0 | 0 | 0 | 0 | 99.2 |
| 120 | 0 | 1 | 1 | 1 | 1 | 1 | 1 | 1 | 1 | 1 | 1 | 1 | 0 | 0 | 0 | 0 | 98.3 |
| 121 | 1 | 1 | 1 | 1 | 1 | 1 | 1 | 1 | 1 | 1 | 1 | 1 | 0 | 0 | 0 | 0 | 99.2 |
| 122 | 0 | 0 | 1 | 1 | 1 | 1 | 1 | 1 | 1 | 1 | 1 | 0 | 1 | 0 | 0 | 0 | 79.5 |
| 123 | 1 | 0 | 1 | 1 | 1 | 1 | 1 | 1 | 1 | 1 | 1 | 0 | 1 | 0 | 0 | 0 | 99.2 |
| 124 | 0 | 1 | 1 | 1 | 1 | 1 | 1 | 1 | 1 | 1 | 1 | 0 | 1 | 0 | 0 | 0 | 98.4 |
| 125 | 1 | 1 | 1 | 1 | 1 | 1 | 1 | 1 | 1 | 1 | 1 | 0 | 1 | 0 | 0 | 0 | 99.2 |
| 126 | 0 | 0 | 1 | 1 | 1 | 1 | 1 | 1 | 1 | 1 | 0 | 1 | 1 | 0 | 0 | 0 | 83.3 |
| 127 | 1 | 0 | 1 | 1 | 1 | 1 | 1 | 1 | 1 | 1 | 0 | 1 | 1 | 0 | 0 | 0 | 99.2 |

FIG.20C

| gray scale level | length (ratio) of corresponding subframe | | | | | | | | | | | | | | | | sharing ratio (%) |
|---|---|---|---|---|---|---|---|---|---|---|---|---|---|---|---|---|---|
| | 1 | 2 | 4 | 8 | 10 | 10 | 10 | 12 | 12 | 14 | 17 | 21 | 25 | 30 | 36 | 43 | |
| 128 | 0 | 1 | 1 | 1 | 1 | 1 | 1 | 1 | 1 | 1 | 0 | 1 | 1 | 0 | 0 | 0 | 98.4 |
| 129 | 1 | 1 | 1 | 1 | 1 | 1 | 1 | 1 | 1 | 1 | 0 | 1 | 1 | 0 | 0 | 0 | 99.2 |
| 130 | 1 | 0 | 1 | 1 | 1 | 1 | 1 | 1 | 1 | 0 | 1 | 1 | 1 | 0 | 0 | 0 | 86.9 |
| 131 | 0 | 1 | 1 | 1 | 1 | 1 | 1 | 1 | 1 | 0 | 1 | 1 | 1 | 0 | 0 | 0 | 98.5 |
| 132 | 1 | 1 | 1 | 1 | 1 | 1 | 1 | 1 | 1 | 0 | 1 | 1 | 1 | 0 | 0 | 0 | 99.2 |
| 133 | 0 | 1 | 1 | 1 | 1 | 1 | 1 | 1 | 0 | 1 | 1 | 1 | 1 | 0 | 0 | 0 | 89.5 |
| 134 | 1 | 1 | 1 | 1 | 1 | 1 | 1 | 1 | 0 | 1 | 1 | 1 | 1 | 0 | 0 | 0 | 99.3 |
| 135 | 0 | 1 | 1 | 1 | 1 | 1 | 0 | 1 | 1 | 1 | 1 | 1 | 1 | 0 | 0 | 0 | 91.1 |
| 136 | 1 | 1 | 1 | 1 | 1 | 1 | 0 | 1 | 1 | 1 | 1 | 1 | 1 | 0 | 0 | 0 | 99.3 |
| 137 | 0 | 1 | 1 | 0 | 1 | 1 | 1 | 1 | 1 | 1 | 1 | 1 | 1 | 0 | 0 | 0 | 92.7 |
| 138 | 1 | 1 | 1 | 0 | 1 | 1 | 1 | 1 | 1 | 1 | 1 | 1 | 1 | 0 | 0 | 0 | 99.3 |
| 139 | 0 | 0 | 0 | 1 | 1 | 1 | 1 | 1 | 1 | 1 | 1 | 1 | 1 | 0 | 0 | 0 | 94.2 |
| 140 | 1 | 0 | 0 | 1 | 1 | 1 | 1 | 1 | 1 | 1 | 1 | 1 | 1 | 0 | 0 | 0 | 99.3 |
| 141 | 0 | 1 | 0 | 1 | 1 | 1 | 1 | 1 | 1 | 1 | 1 | 1 | 1 | 0 | 0 | 0 | 98.6 |
| 142 | 1 | 1 | 0 | 1 | 1 | 1 | 1 | 1 | 1 | 1 | 1 | 1 | 1 | 0 | 0 | 0 | 99.3 |
| 143 | 0 | 0 | 1 | 1 | 1 | 1 | 1 | 1 | 1 | 1 | 1 | 1 | 1 | 0 | 0 | 0 | 97.2 |
| 144 | 1 | 0 | 1 | 1 | 1 | 1 | 1 | 1 | 1 | 1 | 1 | 1 | 1 | 0 | 0 | 0 | 99.3 |
| 145 | 0 | 1 | 1 | 1 | 1 | 1 | 1 | 1 | 1 | 1 | 1 | 1 | 1 | 0 | 0 | 0 | 98.6 |
| 146 | 1 | 1 | 1 | 1 | 1 | 1 | 1 | 1 | 1 | 1 | 1 | 1 | 1 | 0 | 0 | 0 | 99.3 |
| 147 | 1 | 1 | 0 | 1 | 1 | 1 | 1 | 1 | 1 | 1 | 1 | 1 | 0 | 1 | 0 | 0 | 79.6 |
| 148 | 0 | 0 | 1 | 1 | 1 | 1 | 1 | 1 | 1 | 1 | 1 | 1 | 0 | 1 | 0 | 0 | 97.3 |
| 149 | 1 | 0 | 1 | 1 | 1 | 1 | 1 | 1 | 1 | 1 | 1 | 1 | 0 | 1 | 0 | 0 | 99.3 |
| 150 | 0 | 1 | 1 | 1 | 1 | 1 | 1 | 1 | 1 | 1 | 1 | 1 | 0 | 1 | 0 | 0 | 98.7 |
| 151 | 1 | 1 | 1 | 1 | 1 | 1 | 1 | 1 | 1 | 1 | 1 | 1 | 0 | 1 | 0 | 0 | 99.3 |
| 152 | 0 | 0 | 1 | 1 | 1 | 1 | 1 | 1 | 1 | 1 | 1 | 0 | 1 | 1 | 0 | 0 | 83.6 |
| 153 | 1 | 0 | 1 | 1 | 1 | 1 | 1 | 1 | 1 | 1 | 1 | 0 | 1 | 1 | 0 | 0 | 99.3 |
| 154 | 0 | 1 | 1 | 1 | 1 | 1 | 1 | 1 | 1 | 1 | 1 | 0 | 1 | 1 | 0 | 0 | 98.7 |
| 155 | 1 | 1 | 1 | 1 | 1 | 1 | 1 | 1 | 1 | 1 | 1 | 0 | 1 | 1 | 0 | 0 | 99.4 |
| 156 | 0 | 0 | 1 | 1 | 1 | 1 | 1 | 1 | 1 | 1 | 0 | 1 | 1 | 1 | 0 | 0 | 86.5 |
| 157 | 1 | 0 | 1 | 1 | 1 | 1 | 1 | 1 | 1 | 1 | 0 | 1 | 1 | 1 | 0 | 0 | 99.4 |
| 158 | 0 | 1 | 1 | 1 | 1 | 1 | 1 | 1 | 1 | 1 | 0 | 1 | 1 | 1 | 0 | 0 | 98.7 |
| 159 | 1 | 1 | 1 | 1 | 1 | 1 | 1 | 1 | 1 | 1 | 0 | 1 | 1 | 1 | 0 | 0 | 99.4 |
| 160 | 1 | 0 | 1 | 1 | 1 | 1 | 1 | 1 | 1 | 0 | 1 | 1 | 1 | 1 | 0 | 0 | 89.4 |
| 161 | 0 | 1 | 1 | 1 | 1 | 1 | 1 | 1 | 1 | 0 | 1 | 1 | 1 | 1 | 0 | 0 | 98.8 |
| 162 | 1 | 1 | 1 | 1 | 1 | 1 | 1 | 1 | 1 | 0 | 1 | 1 | 1 | 1 | 0 | 0 | 99.4 |
| 163 | 0 | 1 | 1 | 1 | 1 | 1 | 1 | 1 | 0 | 1 | 1 | 1 | 1 | 1 | 0 | 0 | 91.4 |
| 164 | 1 | 1 | 1 | 1 | 1 | 1 | 1 | 1 | 0 | 1 | 1 | 1 | 1 | 1 | 0 | 0 | 99.4 |
| 165 | 0 | 1 | 1 | 1 | 1 | 1 | 0 | 1 | 1 | 1 | 1 | 1 | 1 | 1 | 0 | 0 | 92.7 |
| 166 | 1 | 1 | 1 | 1 | 1 | 1 | 0 | 1 | 1 | 1 | 1 | 1 | 1 | 1 | 0 | 0 | 99.4 |
| 167 | 0 | 1 | 1 | 0 | 1 | 1 | 1 | 1 | 1 | 1 | 1 | 1 | 1 | 1 | 0 | 0 | 94.0 |
| 168 | 1 | 1 | 1 | 0 | 1 | 1 | 1 | 1 | 1 | 1 | 1 | 1 | 1 | 1 | 0 | 0 | 99.4 |
| 169 | 0 | 0 | 0 | 1 | 1 | 1 | 1 | 1 | 1 | 1 | 1 | 1 | 1 | 1 | 0 | 0 | 95.3 |
| 170 | 1 | 0 | 0 | 1 | 1 | 1 | 1 | 1 | 1 | 1 | 1 | 1 | 1 | 1 | 0 | 0 | 99.4 |
| 171 | 0 | 1 | 0 | 1 | 1 | 1 | 1 | 1 | 1 | 1 | 1 | 1 | 1 | 1 | 0 | 0 | 98.8 |
| 172 | 1 | 1 | 0 | 1 | 1 | 1 | 1 | 1 | 1 | 1 | 1 | 1 | 1 | 1 | 0 | 0 | 99.4 |
| 173 | 0 | 0 | 1 | 1 | 1 | 1 | 1 | 1 | 1 | 1 | 1 | 1 | 1 | 1 | 0 | 0 | 97.7 |
| 174 | 1 | 0 | 1 | 1 | 1 | 1 | 1 | 1 | 1 | 1 | 1 | 1 | 1 | 1 | 0 | 0 | 99.4 |
| 175 | 0 | 1 | 1 | 1 | 1 | 1 | 1 | 1 | 1 | 1 | 1 | 1 | 1 | 1 | 0 | 0 | 98.9 |
| 176 | 1 | 1 | 1 | 1 | 1 | 1 | 1 | 1 | 1 | 1 | 1 | 1 | 1 | 1 | 0 | 0 | 99.4 |
| 177 | 0 | 1 | 0 | 1 | 1 | 1 | 1 | 1 | 1 | 1 | 1 | 1 | 1 | 0 | 1 | 0 | 79.7 |
| 178 | 1 | 1 | 0 | 1 | 1 | 1 | 1 | 1 | 1 | 1 | 1 | 1 | 1 | 0 | 1 | 0 | 99.4 |
| 179 | 0 | 0 | 1 | 1 | 1 | 1 | 1 | 1 | 1 | 1 | 1 | 1 | 1 | 0 | 1 | 0 | 97.8 |
| 180 | 1 | 0 | 1 | 1 | 1 | 1 | 1 | 1 | 1 | 1 | 1 | 1 | 1 | 0 | 1 | 0 | 99.4 |
| 181 | 0 | 1 | 1 | 1 | 1 | 1 | 1 | 1 | 1 | 1 | 1 | 1 | 1 | 0 | 1 | 0 | 98.9 |
| 182 | 1 | 1 | 1 | 1 | 1 | 1 | 1 | 1 | 1 | 1 | 1 | 1 | 1 | 0 | 1 | 0 | 99.5 |
| 183 | 1 | 1 | 0 | 1 | 1 | 1 | 1 | 1 | 1 | 1 | 1 | 1 | 0 | 1 | 1 | 0 | 83.6 |
| 184 | 0 | 0 | 1 | 1 | 1 | 1 | 1 | 1 | 1 | 1 | 1 | 1 | 0 | 1 | 1 | 0 | 97.8 |
| 185 | 1 | 0 | 1 | 1 | 1 | 1 | 1 | 1 | 1 | 1 | 1 | 1 | 0 | 1 | 1 | 0 | 99.5 |
| 186 | 0 | 1 | 1 | 1 | 1 | 1 | 1 | 1 | 1 | 1 | 1 | 1 | 0 | 1 | 1 | 0 | 98.9 |
| 187 | 1 | 1 | 1 | 1 | 1 | 1 | 1 | 1 | 1 | 1 | 1 | 1 | 0 | 1 | 1 | 0 | 99.5 |
| 188 | 0 | 0 | 1 | 1 | 1 | 1 | 1 | 1 | 1 | 1 | 1 | 0 | 1 | 1 | 1 | 0 | 86.7 |
| 189 | 1 | 0 | 1 | 1 | 1 | 1 | 1 | 1 | 1 | 1 | 1 | 0 | 1 | 1 | 1 | 0 | 99.5 |
| 190 | 0 | 1 | 1 | 1 | 1 | 1 | 1 | 1 | 1 | 1 | 1 | 0 | 1 | 1 | 1 | 0 | 98.9 |
| 191 | 1 | 1 | 1 | 1 | 1 | 1 | 1 | 1 | 1 | 1 | 1 | 0 | 1 | 1 | 1 | 0 | 99.5 |
| 192 | 0 | 0 | 1 | 1 | 1 | 1 | 1 | 1 | 1 | 1 | 0 | 1 | 1 | 1 | 1 | 0 | 89.1 |
| 193 | 1 | 0 | 1 | 1 | 1 | 1 | 1 | 1 | 1 | 1 | 0 | 1 | 1 | 1 | 1 | 0 | 99.5 |

FIG.20D

| gray scale level | length (ratio) of corresponding subframe | | | | | | | | | | | | | | | | sharing ratio (%) |
|---|---|---|---|---|---|---|---|---|---|---|---|---|---|---|---|---|---|
| | 1 | 2 | 4 | 8 | 10 | 10 | 10 | 12 | 12 | 14 | 17 | 21 | 25 | 30 | 36 | 43 | |
| 194 | 0 | 1 | 1 | 1 | 1 | 1 | 1 | 1 | 1 | 1 | 0 | 1 | 1 | 1 | 1 | 0 | 99.0 |
| 195 | 1 | 1 | 1 | 1 | 1 | 1 | 1 | 1 | 1 | 1 | 0 | 1 | 1 | 1 | 1 | 0 | 99.5 |
| 196 | 1 | 0 | 1 | 1 | 1 | 1 | 1 | 1 | 1 | 0 | 1 | 1 | 1 | 1 | 1 | 0 | 91.3 |
| 197 | 0 | 1 | 1 | 1 | 1 | 1 | 1 | 1 | 1 | 0 | 1 | 1 | 1 | 1 | 1 | 0 | 99.0 |
| 198 | 1 | 1 | 1 | 1 | 1 | 1 | 1 | 1 | 1 | 0 | 1 | 1 | 1 | 1 | 1 | 0 | 99.5 |
| 199 | 0 | 1 | 1 | 1 | 1 | 1 | 1 | 1 | 0 | 1 | 1 | 1 | 1 | 1 | 1 | 0 | 93.0 |
| 200 | 1 | 1 | 1 | 1 | 1 | 1 | 1 | 1 | 0 | 1 | 1 | 1 | 1 | 1 | 1 | 0 | 99.5 |
| 201 | 0 | 1 | 1 | 1 | 1 | 1 | 0 | 1 | 1 | 1 | 1 | 1 | 1 | 1 | 1 | 0 | 94.0 |
| 202 | 1 | 1 | 1 | 1 | 1 | 1 | 0 | 1 | 1 | 1 | 1 | 1 | 1 | 1 | 1 | 0 | 99.5 |
| 203 | 0 | 1 | 1 | 0 | 1 | 1 | 1 | 1 | 1 | 1 | 1 | 1 | 1 | 1 | 1 | 0 | 95.1 |
| 204 | 1 | 1 | 1 | 0 | 1 | 1 | 1 | 1 | 1 | 1 | 1 | 1 | 1 | 1 | 1 | 0 | 99.5 |
| 205 | 0 | 0 | 0 | 1 | 1 | 1 | 1 | 1 | 1 | 1 | 1 | 1 | 1 | 1 | 1 | 0 | 96.1 |
| 206 | 1 | 0 | 0 | 1 | 1 | 1 | 1 | 1 | 1 | 1 | 1 | 1 | 1 | 1 | 1 | 0 | 99.5 |
| 207 | 0 | 1 | 0 | 1 | 1 | 1 | 1 | 1 | 1 | 1 | 1 | 1 | 1 | 1 | 1 | 0 | 99.0 |
| 208 | 1 | 1 | 0 | 1 | 1 | 1 | 1 | 1 | 1 | 1 | 1 | 1 | 1 | 1 | 1 | 0 | 99.5 |
| 209 | 0 | 0 | 1 | 1 | 1 | 1 | 1 | 1 | 1 | 1 | 1 | 1 | 1 | 1 | 1 | 0 | 98.1 |
| 210 | 1 | 0 | 1 | 1 | 1 | 1 | 1 | 1 | 1 | 1 | 1 | 1 | 1 | 1 | 1 | 0 | 99.5 |
| 211 | 0 | 1 | 1 | 1 | 1 | 1 | 1 | 1 | 1 | 1 | 1 | 1 | 1 | 1 | 1 | 0 | 99.1 |
| 212 | 1 | 1 | 1 | 1 | 1 | 1 | 1 | 1 | 1 | 1 | 1 | 1 | 1 | 1 | 1 | 0 | 99.5 |
| 213 | 1 | 0 | 0 | 1 | 1 | 1 | 1 | 1 | 1 | 1 | 1 | 1 | 1 | 1 | 0 | 1 | 79.8 |
| 214 | 0 | 1 | 0 | 1 | 1 | 1 | 1 | 1 | 1 | 1 | 1 | 1 | 1 | 1 | 0 | 1 | 99.1 |
| 215 | 1 | 1 | 0 | 1 | 1 | 1 | 1 | 1 | 1 | 1 | 1 | 1 | 1 | 1 | 0 | 1 | 99.5 |
| 216 | 0 | 0 | 1 | 1 | 1 | 1 | 1 | 1 | 1 | 1 | 1 | 1 | 1 | 1 | 0 | 1 | 98.1 |
| 217 | 1 | 0 | 1 | 1 | 1 | 1 | 1 | 1 | 1 | 1 | 1 | 1 | 1 | 1 | 0 | 1 | 99.5 |
| 218 | 0 | 1 | 1 | 1 | 1 | 1 | 1 | 1 | 1 | 1 | 1 | 1 | 1 | 1 | 0 | 1 | 99.1 |
| 219 | 1 | 1 | 1 | 1 | 1 | 1 | 1 | 1 | 1 | 1 | 1 | 1 | 1 | 1 | 0 | 1 | 99.5 |
| 220 | 0 | 1 | 0 | 1 | 1 | 1 | 1 | 1 | 1 | 1 | 1 | 1 | 1 | 0 | 1 | 1 | 83.6 |
| 221 | 1 | 1 | 0 | 1 | 1 | 1 | 1 | 1 | 1 | 1 | 1 | 1 | 1 | 0 | 1 | 1 | 99.5 |
| 222 | 0 | 0 | 1 | 1 | 1 | 1 | 1 | 1 | 1 | 1 | 1 | 1 | 1 | 0 | 1 | 1 | 98.2 |
| 223 | 1 | 0 | 1 | 1 | 1 | 1 | 1 | 1 | 1 | 1 | 1 | 1 | 1 | 0 | 1 | 1 | 99.6 |
| 224 | 0 | 1 | 1 | 1 | 1 | 1 | 1 | 1 | 1 | 1 | 1 | 1 | 1 | 0 | 1 | 1 | 99.1 |
| 225 | 1 | 1 | 1 | 1 | 1 | 1 | 1 | 1 | 1 | 1 | 1 | 1 | 1 | 0 | 1 | 1 | 99.6 |
| 226 | 1 | 1 | 0 | 1 | 1 | 1 | 1 | 1 | 1 | 1 | 1 | 1 | 0 | 1 | 1 | 1 | 86.7 |
| 227 | 0 | 0 | 1 | 1 | 1 | 1 | 1 | 1 | 1 | 1 | 1 | 1 | 0 | 1 | 1 | 1 | 98.2 |
| 228 | 1 | 0 | 1 | 1 | 1 | 1 | 1 | 1 | 1 | 1 | 1 | 1 | 0 | 1 | 1 | 1 | 99.6 |
| 229 | 0 | 1 | 1 | 1 | 1 | 1 | 1 | 1 | 1 | 1 | 1 | 1 | 0 | 1 | 1 | 1 | 99.1 |
| 230 | 1 | 1 | 1 | 1 | 1 | 1 | 1 | 1 | 1 | 1 | 1 | 1 | 0 | 1 | 1 | 1 | 99.6 |
| 231 | 0 | 0 | 1 | 1 | 1 | 1 | 1 | 1 | 1 | 1 | 1 | 0 | 1 | 1 | 1 | 1 | 89.2 |
| 232 | 1 | 0 | 1 | 1 | 1 | 1 | 1 | 1 | 1 | 1 | 1 | 0 | 1 | 1 | 1 | 1 | 99.6 |
| 233 | 0 | 1 | 1 | 1 | 1 | 1 | 1 | 1 | 1 | 1 | 1 | 0 | 1 | 1 | 1 | 1 | 99.1 |
| 234 | 1 | 1 | 1 | 1 | 1 | 1 | 1 | 1 | 1 | 1 | 1 | 0 | 1 | 1 | 1 | 1 | 99.6 |
| 235 | 0 | 0 | 1 | 1 | 1 | 1 | 1 | 1 | 1 | 1 | 0 | 1 | 1 | 1 | 1 | 1 | 91.1 |
| 236 | 1 | 0 | 1 | 1 | 1 | 1 | 1 | 1 | 1 | 1 | 0 | 1 | 1 | 1 | 1 | 1 | 99.6 |
| 237 | 0 | 1 | 1 | 1 | 1 | 1 | 1 | 1 | 1 | 1 | 0 | 1 | 1 | 1 | 1 | 1 | 99.2 |
| 238 | 1 | 1 | 1 | 1 | 1 | 1 | 1 | 1 | 1 | 1 | 0 | 1 | 1 | 1 | 1 | 1 | 99.6 |
| 239 | 1 | 0 | 1 | 1 | 1 | 1 | 1 | 1 | 1 | 0 | 1 | 1 | 1 | 1 | 1 | 1 | 92.9 |
| 240 | 0 | 1 | 1 | 1 | 1 | 1 | 1 | 1 | 1 | 0 | 1 | 1 | 1 | 1 | 1 | 1 | 99.2 |
| 241 | 1 | 1 | 1 | 1 | 1 | 1 | 1 | 1 | 1 | 0 | 1 | 1 | 1 | 1 | 1 | 1 | 99.6 |
| 242 | 0 | 1 | 1 | 1 | 1 | 1 | 1 | 1 | 0 | 1 | 1 | 1 | 1 | 1 | 1 | 1 | 94.2 |
| 243 | 1 | 1 | 1 | 1 | 1 | 1 | 1 | 1 | 0 | 1 | 1 | 1 | 1 | 1 | 1 | 1 | 99.6 |
| 244 | 0 | 1 | 1 | 1 | 1 | 1 | 0 | 1 | 1 | 1 | 1 | 1 | 1 | 1 | 1 | 1 | 95.1 |
| 245 | 1 | 1 | 1 | 1 | 1 | 1 | 0 | 1 | 1 | 1 | 1 | 1 | 1 | 1 | 1 | 1 | 99.6 |
| 246 | 0 | 1 | 1 | 0 | 1 | 1 | 1 | 1 | 1 | 1 | 1 | 1 | 1 | 1 | 1 | 1 | 95.9 |
| 247 | 1 | 1 | 1 | 0 | 1 | 1 | 1 | 1 | 1 | 1 | 1 | 1 | 1 | 1 | 1 | 1 | 99.6 |
| 248 | 0 | 0 | 0 | 1 | 1 | 1 | 1 | 1 | 1 | 1 | 1 | 1 | 1 | 1 | 1 | 1 | 96.8 |
| 249 | 1 | 0 | 0 | 1 | 1 | 1 | 1 | 1 | 1 | 1 | 1 | 1 | 1 | 1 | 1 | 1 | 99.6 |
| 250 | 0 | 1 | 0 | 1 | 1 | 1 | 1 | 1 | 1 | 1 | 1 | 1 | 1 | 1 | 1 | 1 | 99.2 |
| 251 | 1 | 1 | 0 | 1 | 1 | 1 | 1 | 1 | 1 | 1 | 1 | 1 | 1 | 1 | 1 | 1 | 99.6 |
| 252 | 0 | 0 | 1 | 1 | 1 | 1 | 1 | 1 | 1 | 1 | 1 | 1 | 1 | 1 | 1 | 1 | 98.4 |
| 253 | 1 | 0 | 1 | 1 | 1 | 1 | 1 | 1 | 1 | 1 | 1 | 1 | 1 | 1 | 1 | 1 | 99.6 |
| 254 | 0 | 1 | 1 | 1 | 1 | 1 | 1 | 1 | 1 | 1 | 1 | 1 | 1 | 1 | 1 | 1 | 99.2 |
| 255 | 1 | 1 | 1 | 1 | 1 | 1 | 1 | 1 | 1 | 1 | 1 | 1 | 1 | 1 | 1 | 1 | 99.6 |

FIG.21A

| gray scale level | length (ratio) of corresponding subframe | | | | | | | | | | | | | | | | sharing ratio (%) |
|---|---|---|---|---|---|---|---|---|---|---|---|---|---|---|---|---|---|
| | 1 | 2 | 4 | 8 | 10 | 10 | 10 | 12 | 12 | 14 | 17 | 21 | 25 | 30 | 36 | 43 | |
| 0 | 0 | 0 | 0 | 0 | 0 | 0 | 0 | 0 | 0 | 0 | 0 | 0 | 0 | 0 | 0 | 0 | - |
| 1 | 1 | 0 | 0 | 0 | 0 | 0 | 0 | 0 | 0 | 0 | 0 | 0 | 0 | 0 | 0 | 0 | 0.0 |
| 2 | 0 | 1 | 0 | 0 | 0 | 0 | 0 | 0 | 0 | 0 | 0 | 0 | 0 | 0 | 0 | 0 | 0.0 |
| 3 | 1 | 1 | 0 | 0 | 0 | 0 | 0 | 0 | 0 | 0 | 0 | 0 | 0 | 0 | 0 | 0 | 66.7 |
| 4 | 0 | 0 | 1 | 0 | 0 | 0 | 0 | 0 | 0 | 0 | 0 | 0 | 0 | 0 | 0 | 0 | 0.0 |
| 5 | 1 | 0 | 1 | 0 | 0 | 0 | 0 | 0 | 0 | 0 | 0 | 0 | 0 | 0 | 0 | 0 | 80.0 |
| 6 | 0 | 1 | 1 | 0 | 0 | 0 | 0 | 0 | 0 | 0 | 0 | 0 | 0 | 0 | 0 | 0 | 66.7 |
| 7 | 1 | 1 | 1 | 0 | 0 | 0 | 0 | 0 | 0 | 0 | 0 | 0 | 0 | 0 | 0 | 0 | 85.7 |
| 8 | 0 | 0 | 0 | 1 | 0 | 0 | 0 | 0 | 0 | 0 | 0 | 0 | 0 | 0 | 0 | 0 | 0.0 |
| 9 | 1 | 0 | 0 | 1 | 0 | 0 | 0 | 0 | 0 | 0 | 0 | 0 | 0 | 0 | 0 | 0 | 88.9 |
| 10 | 0 | 1 | 0 | 1 | 0 | 0 | 0 | 0 | 0 | 0 | 0 | 0 | 0 | 0 | 0 | 0 | 80.0 |
| 11 | 1 | 1 | 0 | 1 | 0 | 0 | 0 | 0 | 0 | 0 | 0 | 0 | 0 | 0 | 0 | 0 | 90.9 |
| 12 | 0 | 0 | 1 | 1 | 0 | 0 | 0 | 0 | 0 | 0 | 0 | 0 | 0 | 0 | 0 | 0 | 66.7 |
| 13 | 1 | 0 | 1 | 1 | 0 | 0 | 0 | 0 | 0 | 0 | 0 | 0 | 0 | 0 | 0 | 0 | 92.3 |
| 14 | 0 | 0 | 1 | 0 | 1 | 0 | 0 | 0 | 0 | 0 | 0 | 0 | 0 | 0 | 0 | 0 | 28.6 |
| 15 | 1 | 0 | 1 | 0 | 1 | 0 | 0 | 0 | 0 | 0 | 0 | 0 | 0 | 0 | 0 | 0 | 93.3 |
| 16 | 0 | 1 | 1 | 0 | 1 | 0 | 0 | 0 | 0 | 0 | 0 | 0 | 0 | 0 | 0 | 0 | 87.5 |
| 17 | 1 | 1 | 1 | 0 | 1 | 0 | 0 | 0 | 0 | 0 | 0 | 0 | 0 | 0 | 0 | 0 | 94.1 |
| 18 | 0 | 0 | 0 | 1 | 1 | 0 | 0 | 0 | 0 | 0 | 0 | 0 | 0 | 0 | 0 | 0 | 55.6 |
| 19 | 1 | 0 | 0 | 1 | 1 | 0 | 0 | 0 | 0 | 0 | 0 | 0 | 0 | 0 | 0 | 0 | 94.7 |
| 20 | 0 | 1 | 0 | 1 | 1 | 0 | 0 | 0 | 0 | 0 | 0 | 0 | 0 | 0 | 0 | 0 | 90.0 |
| 21 | 1 | 1 | 0 | 1 | 1 | 0 | 0 | 0 | 0 | 0 | 0 | 0 | 0 | 0 | 0 | 0 | 95.2 |
| 22 | 0 | 0 | 1 | 1 | 1 | 0 | 0 | 0 | 0 | 0 | 0 | 0 | 0 | 0 | 0 | 0 | 81.8 |
| 23 | 1 | 0 | 1 | 1 | 1 | 0 | 0 | 0 | 0 | 0 | 0 | 0 | 0 | 0 | 0 | 0 | 95.7 |
| 24 | 0 | 0 | 1 | 0 | 1 | 1 | 0 | 0 | 0 | 0 | 0 | 0 | 0 | 0 | 0 | 0 | 58.3 |
| 25 | 1 | 0 | 1 | 0 | 1 | 1 | 0 | 0 | 0 | 0 | 0 | 0 | 0 | 0 | 0 | 0 | 96.0 |
| 26 | 0 | 1 | 1 | 0 | 1 | 1 | 0 | 0 | 0 | 0 | 0 | 0 | 0 | 0 | 0 | 0 | 92.3 |
| 27 | 1 | 1 | 1 | 0 | 1 | 1 | 0 | 0 | 0 | 0 | 0 | 0 | 0 | 0 | 0 | 0 | 96.3 |
| 28 | 0 | 0 | 0 | 1 | 1 | 1 | 0 | 0 | 0 | 0 | 0 | 0 | 0 | 0 | 0 | 0 | 71.4 |
| 29 | 1 | 0 | 0 | 1 | 1 | 1 | 0 | 0 | 0 | 0 | 0 | 0 | 0 | 0 | 0 | 0 | 96.6 |
| 30 | 0 | 1 | 0 | 1 | 1 | 1 | 0 | 0 | 0 | 0 | 0 | 0 | 0 | 0 | 0 | 0 | 93.3 |
| 31 | 1 | 1 | 0 | 1 | 1 | 1 | 0 | 0 | 0 | 0 | 0 | 0 | 0 | 0 | 0 | 0 | 96.8 |
| 32 | 0 | 0 | 1 | 1 | 1 | 1 | 0 | 0 | 0 | 0 | 0 | 0 | 0 | 0 | 0 | 0 | 87.5 |
| 33 | 1 | 0 | 1 | 1 | 1 | 1 | 0 | 0 | 0 | 0 | 0 | 0 | 0 | 0 | 0 | 0 | 97.0 |
| 34 | 0 | 0 | 1 | 0 | 1 | 1 | 1 | 0 | 0 | 0 | 0 | 0 | 0 | 0 | 0 | 0 | 70.6 |
| 35 | 1 | 0 | 1 | 0 | 1 | 1 | 1 | 0 | 0 | 0 | 0 | 0 | 0 | 0 | 0 | 0 | 97.1 |
| 36 | 0 | 1 | 1 | 0 | 1 | 1 | 1 | 0 | 0 | 0 | 0 | 0 | 0 | 0 | 0 | 0 | 94.4 |
| 37 | 1 | 1 | 1 | 0 | 1 | 1 | 1 | 0 | 0 | 0 | 0 | 0 | 0 | 0 | 0 | 0 | 97.3 |
| 38 | 0 | 0 | 0 | 1 | 1 | 1 | 1 | 0 | 0 | 0 | 0 | 0 | 0 | 0 | 0 | 0 | 78.9 |
| 39 | 1 | 0 | 0 | 1 | 1 | 1 | 1 | 0 | 0 | 0 | 0 | 0 | 0 | 0 | 0 | 0 | 97.4 |
| 40 | 0 | 1 | 0 | 1 | 1 | 1 | 1 | 0 | 0 | 0 | 0 | 0 | 0 | 0 | 0 | 0 | 95.0 |
| 41 | 1 | 1 | 0 | 1 | 1 | 1 | 1 | 0 | 0 | 0 | 0 | 0 | 0 | 0 | 0 | 0 | 97.6 |
| 42 | 0 | 0 | 1 | 1 | 1 | 1 | 1 | 0 | 0 | 0 | 0 | 0 | 0 | 0 | 0 | 0 | 90.5 |
| 43 | 1 | 0 | 1 | 1 | 1 | 1 | 1 | 0 | 0 | 0 | 0 | 0 | 0 | 0 | 0 | 0 | 97.7 |
| 44 | 0 | 0 | 1 | 1 | 1 | 1 | 0 | 1 | 0 | 0 | 0 | 0 | 0 | 0 | 0 | 0 | 72.7 |
| 45 | 1 | 0 | 1 | 1 | 1 | 1 | 0 | 1 | 0 | 0 | 0 | 0 | 0 | 0 | 0 | 0 | 97.8 |
| 46 | 0 | 0 | 1 | 0 | 1 | 1 | 1 | 1 | 0 | 0 | 0 | 0 | 0 | 0 | 0 | 0 | 78.3 |
| 47 | 1 | 0 | 1 | 0 | 1 | 1 | 1 | 1 | 0 | 0 | 0 | 0 | 0 | 0 | 0 | 0 | 97.9 |
| 48 | 0 | 1 | 1 | 0 | 1 | 1 | 1 | 1 | 0 | 0 | 0 | 0 | 0 | 0 | 0 | 0 | 95.8 |
| 49 | 1 | 1 | 1 | 0 | 1 | 1 | 1 | 1 | 0 | 0 | 0 | 0 | 0 | 0 | 0 | 0 | 98.0 |
| 50 | 0 | 0 | 0 | 1 | 1 | 1 | 1 | 1 | 0 | 0 | 0 | 0 | 0 | 0 | 0 | 0 | 84.0 |
| 51 | 1 | 0 | 0 | 1 | 1 | 1 | 1 | 1 | 0 | 0 | 0 | 0 | 0 | 0 | 0 | 0 | 98.0 |
| 52 | 0 | 1 | 0 | 1 | 1 | 1 | 1 | 1 | 0 | 0 | 0 | 0 | 0 | 0 | 0 | 0 | 96.2 |
| 53 | 1 | 1 | 0 | 1 | 1 | 1 | 1 | 1 | 0 | 0 | 0 | 0 | 0 | 0 | 0 | 0 | 98.1 |
| 54 | 0 | 0 | 1 | 1 | 1 | 1 | 1 | 1 | 0 | 0 | 0 | 0 | 0 | 0 | 0 | 0 | 92.6 |
| 55 | 1 | 0 | 1 | 1 | 1 | 1 | 1 | 1 | 0 | 0 | 0 | 0 | 0 | 0 | 0 | 0 | 98.2 |
| 56 | 0 | 0 | 1 | 1 | 1 | 1 | 0 | 1 | 1 | 0 | 0 | 0 | 0 | 0 | 0 | 0 | 78.6 |
| 57 | 1 | 0 | 1 | 1 | 1 | 1 | 0 | 1 | 1 | 0 | 0 | 0 | 0 | 0 | 0 | 0 | 98.2 |
| 58 | 0 | 0 | 1 | 0 | 1 | 1 | 1 | 1 | 1 | 0 | 0 | 0 | 0 | 0 | 0 | 0 | 82.8 |
| 59 | 1 | 0 | 1 | 0 | 1 | 1 | 1 | 1 | 1 | 0 | 0 | 0 | 0 | 0 | 0 | 0 | 98.3 |
| 60 | 0 | 1 | 1 | 0 | 1 | 1 | 1 | 1 | 1 | 0 | 0 | 0 | 0 | 0 | 0 | 0 | 96.7 |
| 61 | 1 | 1 | 1 | 0 | 1 | 1 | 1 | 1 | 1 | 0 | 0 | 0 | 0 | 0 | 0 | 0 | 98.4 |
| 62 | 0 | 0 | 0 | 1 | 1 | 1 | 1 | 1 | 1 | 0 | 0 | 0 | 0 | 0 | 0 | 0 | 87.1 |
| 63 | 1 | 0 | 0 | 1 | 1 | 1 | 1 | 1 | 1 | 0 | 0 | 0 | 0 | 0 | 0 | 0 | 98.4 |
| 64 | 0 | 1 | 0 | 1 | 1 | 1 | 1 | 1 | 1 | 0 | 0 | 0 | 0 | 0 | 0 | 0 | 96.9 |
| 65 | 1 | 1 | 0 | 1 | 1 | 1 | 1 | 1 | 1 | 0 | 0 | 0 | 0 | 0 | 0 | 0 | 98.5 |

FIG.21B

| gray scale level | length (ratio) of corresponding subframe | | | | | | | | | | | | | | | | sharing ratio (%) |
|---|---|---|---|---|---|---|---|---|---|---|---|---|---|---|---|---|---|
| | 1 | 2 | 4 | 8 | 10 | 10 | 10 | 12 | 12 | 14 | 17 | 21 | 25 | 30 | 36 | 43 | |
| 66 | 0 | 0 | 1 | 1 | 1 | 1 | 1 | 1 | 1 | 0 | 0 | 0 | 0 | 0 | 0 | 0 | 93.9 |
| 67 | 1 | 0 | 1 | 1 | 1 | 1 | 1 | 1 | 1 | 0 | 0 | 0 | 0 | 0 | 0 | 0 | 98.5 |
| 68 | 0 | 0 | 1 | 1 | 1 | 1 | 1 | 1 | 0 | 1 | 0 | 0 | 0 | 0 | 0 | 0 | 79.4 |
| 69 | 1 | 0 | 1 | 1 | 1 | 1 | 1 | 1 | 0 | 1 | 0 | 0 | 0 | 0 | 0 | 0 | 98.6 |
| 70 | 0 | 0 | 1 | 1 | 1 | 1 | 0 | 1 | 1 | 1 | 0 | 0 | 0 | 0 | 0 | 0 | 82.9 |
| 71 | 1 | 0 | 1 | 1 | 1 | 1 | 0 | 1 | 1 | 1 | 0 | 0 | 0 | 0 | 0 | 0 | 98.6 |
| 72 | 0 | 0 | 1 | 0 | 1 | 1 | 1 | 1 | 1 | 1 | 0 | 0 | 0 | 0 | 0 | 0 | 86.1 |
| 73 | 1 | 0 | 1 | 0 | 1 | 1 | 1 | 1 | 1 | 1 | 0 | 0 | 0 | 0 | 0 | 0 | 98.6 |
| 74 | 0 | 1 | 1 | 0 | 1 | 1 | 1 | 1 | 1 | 1 | 0 | 0 | 0 | 0 | 0 | 0 | 97.3 |
| 75 | 1 | 1 | 1 | 0 | 1 | 1 | 1 | 1 | 1 | 1 | 0 | 0 | 0 | 0 | 0 | 0 | 98.7 |
| 76 | 0 | 0 | 0 | 1 | 1 | 1 | 1 | 1 | 1 | 1 | 0 | 0 | 0 | 0 | 0 | 0 | 89.5 |
| 77 | 1 | 0 | 0 | 1 | 1 | 1 | 1 | 1 | 1 | 1 | 0 | 0 | 0 | 0 | 0 | 0 | 98.7 |
| 78 | 0 | 1 | 0 | 1 | 1 | 1 | 1 | 1 | 1 | 1 | 0 | 0 | 0 | 0 | 0 | 0 | 97.4 |
| 79 | 1 | 1 | 0 | 1 | 1 | 1 | 1 | 1 | 1 | 1 | 0 | 0 | 0 | 0 | 0 | 0 | 98.7 |
| 80 | 0 | 0 | 1 | 1 | 1 | 1 | 1 | 1 | 1 | 1 | 0 | 0 | 0 | 0 | 0 | 0 | 95.0 |
| 81 | 1 | 0 | 1 | 1 | 1 | 1 | 1 | 1 | 1 | 1 | 0 | 0 | 0 | 0 | 0 | 0 | 98.8 |
| 82 | 1 | 1 | 0 | 1 | 1 | 1 | 1 | 1 | 1 | 0 | 1 | 0 | 0 | 0 | 0 | 0 | 76.8 |
| 83 | 0 | 0 | 1 | 1 | 1 | 1 | 1 | 1 | 1 | 0 | 1 | 0 | 0 | 0 | 0 | 0 | 95.2 |
| 84 | 1 | 0 | 1 | 1 | 1 | 1 | 1 | 1 | 1 | 0 | 1 | 0 | 0 | 0 | 0 | 0 | 98.8 |
| 85 | 0 | 0 | 1 | 1 | 1 | 1 | 1 | 1 | 0 | 1 | 1 | 0 | 0 | 0 | 0 | 0 | 83.5 |
| 86 | 1 | 0 | 1 | 1 | 1 | 1 | 1 | 1 | 0 | 1 | 1 | 0 | 0 | 0 | 0 | 0 | 98.8 |
| 87 | 0 | 0 | 1 | 1 | 1 | 1 | 0 | 1 | 1 | 1 | 1 | 0 | 0 | 0 | 0 | 0 | 86.2 |
| 88 | 1 | 0 | 1 | 1 | 1 | 1 | 0 | 1 | 1 | 1 | 1 | 0 | 0 | 0 | 0 | 0 | 98.9 |
| 89 | 0 | 0 | 1 | 0 | 1 | 1 | 1 | 1 | 1 | 1 | 1 | 0 | 0 | 0 | 0 | 0 | 88.8 |
| 90 | 1 | 0 | 1 | 0 | 1 | 1 | 1 | 1 | 1 | 1 | 1 | 0 | 0 | 0 | 0 | 0 | 98.9 |
| 91 | 0 | 1 | 1 | 0 | 1 | 1 | 1 | 1 | 1 | 1 | 1 | 0 | 0 | 0 | 0 | 0 | 97.8 |
| 92 | 1 | 1 | 1 | 0 | 1 | 1 | 1 | 1 | 1 | 1 | 1 | 0 | 0 | 0 | 0 | 0 | 98.9 |
| 93 | 0 | 0 | 0 | 1 | 1 | 1 | 1 | 1 | 1 | 1 | 1 | 0 | 0 | 0 | 0 | 0 | 91.4 |
| 94 | 1 | 0 | 0 | 1 | 1 | 1 | 1 | 1 | 1 | 1 | 1 | 0 | 0 | 0 | 0 | 0 | 98.9 |
| 95 | 0 | 1 | 0 | 1 | 1 | 1 | 1 | 1 | 1 | 1 | 1 | 0 | 0 | 0 | 0 | 0 | 97.9 |
| 96 | 1 | 1 | 0 | 1 | 1 | 1 | 1 | 1 | 1 | 1 | 1 | 0 | 0 | 0 | 0 | 0 | 99.0 |
| 97 | 0 | 0 | 1 | 1 | 1 | 1 | 1 | 1 | 1 | 1 | 1 | 0 | 0 | 0 | 0 | 0 | 95.9 |
| 98 | 1 | 0 | 1 | 1 | 1 | 1 | 1 | 1 | 1 | 1 | 1 | 0 | 0 | 0 | 0 | 0 | 99.0 |
| 99 | 0 | 1 | 0 | 1 | 1 | 1 | 1 | 1 | 1 | 1 | 0 | 1 | 0 | 0 | 0 | 0 | 76.8 |
| 100 | 1 | 1 | 0 | 1 | 1 | 1 | 1 | 1 | 1 | 1 | 0 | 1 | 0 | 0 | 0 | 0 | 99.0 |
| 101 | 0 | 0 | 1 | 1 | 1 | 1 | 1 | 1 | 1 | 1 | 0 | 1 | 0 | 0 | 0 | 0 | 96.0 |
| 102 | 1 | 0 | 1 | 1 | 1 | 1 | 1 | 1 | 1 | 1 | 0 | 1 | 0 | 0 | 0 | 0 | 99.0 |
| 103 | 1 | 1 | 0 | 1 | 1 | 1 | 1 | 1 | 1 | 0 | 1 | 1 | 0 | 0 | 0 | 0 | 81.6 |
| 104 | 0 | 0 | 1 | 1 | 1 | 1 | 1 | 1 | 1 | 0 | 1 | 1 | 0 | 0 | 0 | 0 | 96.2 |
| 105 | 1 | 0 | 1 | 1 | 1 | 1 | 1 | 1 | 1 | 0 | 1 | 1 | 0 | 0 | 0 | 0 | 99.0 |
| 106 | 0 | 0 | 1 | 1 | 1 | 1 | 1 | 1 | 0 | 1 | 1 | 1 | 0 | 0 | 0 | 0 | 86.8 |
| 107 | 1 | 0 | 1 | 1 | 1 | 1 | 1 | 1 | 0 | 1 | 1 | 1 | 0 | 0 | 0 | 0 | 99.1 |
| 108 | 0 | 0 | 1 | 1 | 1 | 1 | 0 | 1 | 1 | 1 | 1 | 1 | 0 | 0 | 0 | 0 | 88.9 |
| 109 | 1 | 0 | 1 | 1 | 1 | 1 | 0 | 1 | 1 | 1 | 1 | 1 | 0 | 0 | 0 | 0 | 99.1 |
| 110 | 0 | 0 | 1 | 0 | 1 | 1 | 1 | 1 | 1 | 1 | 1 | 1 | 0 | 0 | 0 | 0 | 90.9 |
| 111 | 1 | 0 | 1 | 0 | 1 | 1 | 1 | 1 | 1 | 1 | 1 | 1 | 0 | 0 | 0 | 0 | 99.1 |
| 112 | 0 | 1 | 1 | 0 | 1 | 1 | 1 | 1 | 1 | 1 | 1 | 1 | 0 | 0 | 0 | 0 | 98.2 |
| 113 | 1 | 1 | 1 | 0 | 1 | 1 | 1 | 1 | 1 | 1 | 1 | 1 | 0 | 0 | 0 | 0 | 99.1 |
| 114 | 0 | 0 | 0 | 1 | 1 | 1 | 1 | 1 | 1 | 1 | 1 | 1 | 0 | 0 | 0 | 0 | 93.0 |
| 115 | 1 | 0 | 0 | 1 | 1 | 1 | 1 | 1 | 1 | 1 | 1 | 1 | 0 | 0 | 0 | 0 | 99.1 |
| 116 | 0 | 1 | 0 | 1 | 1 | 1 | 1 | 1 | 1 | 1 | 1 | 1 | 0 | 0 | 0 | 0 | 98.3 |
| 117 | 1 | 1 | 0 | 1 | 1 | 1 | 1 | 1 | 1 | 1 | 1 | 1 | 0 | 0 | 0 | 0 | 99.1 |
| 118 | 0 | 0 | 1 | 1 | 1 | 1 | 1 | 1 | 1 | 1 | 1 | 1 | 0 | 0 | 0 | 0 | 96.6 |
| 119 | 1 | 0 | 1 | 1 | 1 | 1 | 1 | 1 | 1 | 1 | 1 | 1 | 0 | 0 | 0 | 0 | 99.2 |
| 120 | 0 | 1 | 0 | 1 | 1 | 1 | 1 | 1 | 1 | 1 | 1 | 0 | 1 | 0 | 0 | 0 | 77.5 |
| 121 | 1 | 1 | 0 | 1 | 1 | 1 | 1 | 1 | 1 | 1 | 1 | 0 | 1 | 0 | 0 | 0 | 99.2 |
| 122 | 0 | 0 | 1 | 1 | 1 | 1 | 1 | 1 | 1 | 1 | 1 | 0 | 1 | 0 | 0 | 0 | 96.7 |
| 123 | 1 | 0 | 1 | 1 | 1 | 1 | 1 | 1 | 1 | 1 | 1 | 0 | 1 | 0 | 0 | 0 | 99.2 |
| 124 | 0 | 1 | 0 | 1 | 1 | 1 | 1 | 1 | 1 | 1 | 0 | 1 | 1 | 0 | 0 | 0 | 81.5 |
| 125 | 1 | 1 | 0 | 1 | 1 | 1 | 1 | 1 | 1 | 1 | 0 | 1 | 1 | 0 | 0 | 0 | 99.2 |
| 126 | 0 | 0 | 1 | 1 | 1 | 1 | 1 | 1 | 1 | 1 | 0 | 1 | 1 | 0 | 0 | 0 | 96.8 |
| 127 | 1 | 0 | 1 | 1 | 1 | 1 | 1 | 1 | 1 | 1 | 0 | 1 | 1 | 0 | 0 | 0 | 99.2 |

FIG.21C

| gray scale level | length (ratio) of corresponding subframe | | | | | | | | | | | | | | | | sharing ratio (%) |
|---|---|---|---|---|---|---|---|---|---|---|---|---|---|---|---|---|---|
| | 1 | 2 | 4 | 8 | 10 | 10 | 10 | 12 | 12 | 14 | 17 | 21 | 25 | 30 | 36 | 43 | |
| 128 | 1 | 1 | 0 | 1 | 1 | 1 | 1 | 1 | 1 | 0 | 1 | 1 | 1 | 0 | 0 | 0 | 85.2 |
| 129 | 0 | 0 | 1 | 1 | 1 | 1 | 1 | 1 | 1 | 0 | 1 | 1 | 1 | 0 | 0 | 0 | 96.9 |
| 130 | 1 | 0 | 1 | 1 | 1 | 1 | 1 | 1 | 1 | 0 | 1 | 1 | 1 | 0 | 0 | 0 | 99.2 |
| 131 | 0 | 0 | 1 | 1 | 1 | 1 | 1 | 1 | 0 | 1 | 1 | 1 | 1 | 0 | 0 | 0 | 89.3 |
| 132 | 1 | 0 | 1 | 1 | 1 | 1 | 1 | 1 | 0 | 1 | 1 | 1 | 1 | 0 | 0 | 0 | 99.2 |
| 133 | 0 | 0 | 1 | 1 | 1 | 1 | 0 | 1 | 1 | 1 | 1 | 1 | 1 | 0 | 0 | 0 | 91.0 |
| 134 | 1 | 0 | 1 | 1 | 1 | 1 | 0 | 1 | 1 | 1 | 1 | 1 | 1 | 0 | 0 | 0 | 99.3 |
| 135 | 0 | 0 | 1 | 0 | 1 | 1 | 1 | 1 | 1 | 1 | 1 | 1 | 1 | 0 | 0 | 0 | 92.6 |
| 136 | 1 | 0 | 1 | 0 | 1 | 1 | 1 | 1 | 1 | 1 | 1 | 1 | 1 | 0 | 0 | 0 | 99.3 |
| 137 | 0 | 1 | 1 | 0 | 1 | 1 | 1 | 1 | 1 | 1 | 1 | 1 | 1 | 0 | 0 | 0 | 98.5 |
| 138 | 1 | 1 | 1 | 0 | 1 | 1 | 1 | 1 | 1 | 1 | 1 | 1 | 1 | 0 | 0 | 0 | 99.3 |
| 139 | 0 | 0 | 0 | 1 | 1 | 1 | 1 | 1 | 1 | 1 | 1 | 1 | 1 | 0 | 0 | 0 | 94.2 |
| 140 | 1 | 0 | 0 | 1 | 1 | 1 | 1 | 1 | 1 | 1 | 1 | 1 | 1 | 0 | 0 | 0 | 99.3 |
| 141 | 0 | 1 | 0 | 1 | 1 | 1 | 1 | 1 | 1 | 1 | 1 | 1 | 1 | 0 | 0 | 0 | 98.6 |
| 142 | 1 | 1 | 0 | 1 | 1 | 1 | 1 | 1 | 1 | 1 | 1 | 1 | 1 | 0 | 0 | 0 | 99.3 |
| 143 | 0 | 0 | 1 | 1 | 1 | 1 | 1 | 1 | 1 | 1 | 1 | 1 | 1 | 0 | 0 | 0 | 97.2 |
| 144 | 1 | 0 | 1 | 1 | 1 | 1 | 1 | 1 | 1 | 1 | 1 | 1 | 1 | 0 | 0 | 0 | 99.3 |
| 145 | 1 | 0 | 0 | 1 | 1 | 1 | 1 | 1 | 1 | 1 | 1 | 1 | 0 | 1 | 0 | 0 | 79.3 |
| 146 | 0 | 1 | 0 | 1 | 1 | 1 | 1 | 1 | 1 | 1 | 1 | 1 | 0 | 1 | 0 | 0 | 98.6 |
| 147 | 1 | 1 | 0 | 1 | 1 | 1 | 1 | 1 | 1 | 1 | 1 | 1 | 0 | 1 | 0 | 0 | 99.3 |
| 148 | 0 | 0 | 1 | 1 | 1 | 1 | 1 | 1 | 1 | 1 | 1 | 1 | 0 | 1 | 0 | 0 | 97.3 |
| 149 | 1 | 0 | 1 | 1 | 1 | 1 | 1 | 1 | 1 | 1 | 1 | 1 | 0 | 1 | 0 | 0 | 99.3 |
| 150 | 0 | 1 | 0 | 1 | 1 | 1 | 1 | 1 | 1 | 1 | 1 | 0 | 1 | 1 | 0 | 0 | 82.0 |
| 151 | 1 | 1 | 0 | 1 | 1 | 1 | 1 | 1 | 1 | 1 | 1 | 0 | 1 | 1 | 0 | 0 | 99.3 |
| 152 | 0 | 0 | 1 | 1 | 1 | 1 | 1 | 1 | 1 | 1 | 1 | 0 | 1 | 1 | 0 | 0 | 97.4 |
| 153 | 1 | 0 | 1 | 1 | 1 | 1 | 1 | 1 | 1 | 1 | 1 | 0 | 1 | 1 | 0 | 0 | 99.3 |
| 154 | 0 | 1 | 0 | 1 | 1 | 1 | 1 | 1 | 1 | 1 | 0 | 1 | 1 | 1 | 0 | 0 | 85.1 |
| 155 | 1 | 1 | 0 | 1 | 1 | 1 | 1 | 1 | 1 | 1 | 0 | 1 | 1 | 1 | 0 | 0 | 99.4 |
| 156 | 0 | 0 | 1 | 1 | 1 | 1 | 1 | 1 | 1 | 1 | 0 | 1 | 1 | 1 | 0 | 0 | 97.4 |
| 157 | 1 | 0 | 1 | 1 | 1 | 1 | 1 | 1 | 1 | 1 | 0 | 1 | 1 | 1 | 0 | 0 | 99.4 |
| 158 | 1 | 1 | 0 | 1 | 1 | 1 | 1 | 1 | 1 | 0 | 1 | 1 | 1 | 1 | 0 | 0 | 88.0 |
| 159 | 0 | 0 | 1 | 1 | 1 | 1 | 1 | 1 | 1 | 0 | 1 | 1 | 1 | 1 | 0 | 0 | 97.5 |
| 160 | 1 | 0 | 1 | 1 | 1 | 1 | 1 | 1 | 1 | 0 | 1 | 1 | 1 | 1 | 0 | 0 | 99.4 |
| 161 | 0 | 0 | 1 | 1 | 1 | 1 | 1 | 1 | 0 | 1 | 1 | 1 | 1 | 1 | 0 | 0 | 91.3 |
| 162 | 1 | 0 | 1 | 1 | 1 | 1 | 1 | 1 | 0 | 1 | 1 | 1 | 1 | 1 | 0 | 0 | 99.4 |
| 163 | 0 | 0 | 1 | 1 | 1 | 1 | 0 | 1 | 1 | 1 | 1 | 1 | 1 | 1 | 0 | 0 | 92.6 |
| 164 | 1 | 0 | 1 | 1 | 1 | 1 | 0 | 1 | 1 | 1 | 1 | 1 | 1 | 1 | 0 | 0 | 99.4 |
| 165 | 0 | 0 | 1 | 0 | 1 | 1 | 1 | 1 | 1 | 1 | 1 | 1 | 1 | 1 | 0 | 0 | 93.9 |
| 166 | 1 | 0 | 1 | 0 | 1 | 1 | 1 | 1 | 1 | 1 | 1 | 1 | 1 | 1 | 0 | 0 | 99.4 |
| 167 | 0 | 1 | 1 | 0 | 1 | 1 | 1 | 1 | 1 | 1 | 1 | 1 | 1 | 1 | 0 | 0 | 98.8 |
| 168 | 1 | 1 | 1 | 0 | 1 | 1 | 1 | 1 | 1 | 1 | 1 | 1 | 1 | 1 | 0 | 0 | 99.4 |
| 169 | 0 | 0 | 0 | 1 | 1 | 1 | 1 | 1 | 1 | 1 | 1 | 1 | 1 | 1 | 0 | 0 | 95.3 |
| 170 | 1 | 0 | 0 | 1 | 1 | 1 | 1 | 1 | 1 | 1 | 1 | 1 | 1 | 1 | 0 | 0 | 99.4 |
| 171 | 0 | 1 | 0 | 1 | 1 | 1 | 1 | 1 | 1 | 1 | 1 | 1 | 1 | 1 | 0 | 0 | 98.8 |
| 172 | 1 | 1 | 0 | 1 | 1 | 1 | 1 | 1 | 1 | 1 | 1 | 1 | 1 | 1 | 0 | 0 | 99.4 |
| 173 | 0 | 0 | 1 | 1 | 1 | 1 | 1 | 1 | 1 | 1 | 1 | 1 | 1 | 1 | 0 | 0 | 97.7 |
| 174 | 1 | 0 | 1 | 1 | 1 | 1 | 1 | 1 | 1 | 1 | 1 | 1 | 1 | 1 | 0 | 0 | 99.4 |
| 175 | 0 | 0 | 0 | 1 | 1 | 1 | 1 | 1 | 1 | 1 | 1 | 1 | 1 | 0 | 1 | 0 | 79.4 |
| 176 | 1 | 0 | 0 | 1 | 1 | 1 | 1 | 1 | 1 | 1 | 1 | 1 | 1 | 0 | 1 | 0 | 99.4 |
| 177 | 0 | 1 | 0 | 1 | 1 | 1 | 1 | 1 | 1 | 1 | 1 | 1 | 1 | 0 | 1 | 0 | 98.9 |
| 178 | 1 | 1 | 0 | 1 | 1 | 1 | 1 | 1 | 1 | 1 | 1 | 1 | 1 | 0 | 1 | 0 | 99.4 |
| 179 | 0 | 0 | 1 | 1 | 1 | 1 | 1 | 1 | 1 | 1 | 1 | 1 | 1 | 0 | 1 | 0 | 97.8 |
| 180 | 1 | 0 | 1 | 1 | 1 | 1 | 1 | 1 | 1 | 1 | 1 | 1 | 1 | 0 | 1 | 0 | 99.4 |
| 181 | 1 | 0 | 0 | 1 | 1 | 1 | 1 | 1 | 1 | 1 | 1 | 1 | 0 | 1 | 1 | 0 | 83.4 |
| 182 | 0 | 1 | 0 | 1 | 1 | 1 | 1 | 1 | 1 | 1 | 1 | 1 | 0 | 1 | 1 | 0 | 98.9 |
| 183 | 1 | 1 | 0 | 1 | 1 | 1 | 1 | 1 | 1 | 1 | 1 | 1 | 0 | 1 | 1 | 0 | 99.5 |
| 184 | 0 | 0 | 1 | 1 | 1 | 1 | 1 | 1 | 1 | 1 | 1 | 1 | 0 | 1 | 1 | 0 | 97.8 |
| 185 | 1 | 0 | 1 | 1 | 1 | 1 | 1 | 1 | 1 | 1 | 1 | 1 | 0 | 1 | 1 | 0 | 99.5 |
| 186 | 0 | 1 | 0 | 1 | 1 | 1 | 1 | 1 | 1 | 1 | 1 | 0 | 1 | 1 | 1 | 0 | 85.5 |
| 187 | 1 | 1 | 0 | 1 | 1 | 1 | 1 | 1 | 1 | 1 | 1 | 0 | 1 | 1 | 1 | 0 | 99.5 |
| 188 | 0 | 0 | 1 | 1 | 1 | 1 | 1 | 1 | 1 | 1 | 1 | 0 | 1 | 1 | 1 | 0 | 97.9 |
| 189 | 1 | 0 | 1 | 1 | 1 | 1 | 1 | 1 | 1 | 1 | 1 | 0 | 1 | 1 | 1 | 0 | 99.5 |
| 190 | 0 | 1 | 0 | 1 | 1 | 1 | 1 | 1 | 1 | 1 | 0 | 1 | 1 | 1 | 1 | 0 | 87.9 |
| 191 | 1 | 1 | 0 | 1 | 1 | 1 | 1 | 1 | 1 | 1 | 0 | 1 | 1 | 1 | 1 | 0 | 99.5 |
| 192 | 0 | 0 | 1 | 1 | 1 | 1 | 1 | 1 | 1 | 1 | 0 | 1 | 1 | 1 | 1 | 0 | 97.9 |
| 193 | 1 | 0 | 1 | 1 | 1 | 1 | 1 | 1 | 1 | 1 | 0 | 1 | 1 | 1 | 1 | 0 | 99.5 |

FIG.21D

| gray scale level | length (ratio) of corresponding subframe | | | | | | | | | | | | | | | | sharing ratio (%) |
|---|---|---|---|---|---|---|---|---|---|---|---|---|---|---|---|---|---|
| | 1 | 2 | 4 | 8 | 10 | 10 | 10 | 12 | 12 | 14 | 17 | 21 | 25 | 30 | 36 | 43 | |
| 194 | 1 | 1 | 0 | 1 | 1 | 1 | 1 | 1 | 1 | 0 | 1 | 1 | 1 | 1 | 1 | 0 | 90.2 |
| 195 | 0 | 0 | 1 | 1 | 1 | 1 | 1 | 1 | 1 | 0 | 1 | 1 | 1 | 1 | 1 | 0 | 97.9 |
| 196 | 1 | 0 | 1 | 1 | 1 | 1 | 1 | 1 | 1 | 0 | 1 | 1 | 1 | 1 | 1 | 0 | 99.5 |
| 197 | 0 | 0 | 1 | 1 | 1 | 1 | 1 | 1 | 0 | 1 | 1 | 1 | 1 | 1 | 1 | 0 | 92.9 |
| 198 | 1 | 0 | 1 | 1 | 1 | 1 | 1 | 1 | 0 | 1 | 1 | 1 | 1 | 1 | 1 | 0 | 99.5 |
| 199 | 0 | 0 | 1 | 1 | 1 | 1 | 0 | 1 | 1 | 1 | 1 | 1 | 1 | 1 | 1 | 0 | 94.0 |
| 200 | 1 | 0 | 1 | 1 | 1 | 1 | 0 | 1 | 1 | 1 | 1 | 1 | 1 | 1 | 1 | 0 | 99.5 |
| 201 | 0 | 0 | 1 | 0 | 1 | 1 | 1 | 1 | 1 | 1 | 1 | 1 | 1 | 1 | 1 | 0 | 95.0 |
| 202 | 1 | 0 | 1 | 0 | 1 | 1 | 1 | 1 | 1 | 1 | 1 | 1 | 1 | 1 | 1 | 0 | 99.5 |
| 203 | 0 | 1 | 1 | 0 | 1 | 1 | 1 | 1 | 1 | 1 | 1 | 1 | 1 | 1 | 1 | 0 | 99.0 |
| 204 | 1 | 1 | 1 | 0 | 1 | 1 | 1 | 1 | 1 | 1 | 1 | 1 | 1 | 1 | 1 | 0 | 99.5 |
| 205 | 0 | 0 | 0 | 1 | 1 | 1 | 1 | 1 | 1 | 1 | 1 | 1 | 1 | 1 | 1 | 0 | 96.1 |
| 206 | 1 | 0 | 0 | 1 | 1 | 1 | 1 | 1 | 1 | 1 | 1 | 1 | 1 | 1 | 1 | 0 | 99.5 |
| 207 | 0 | 1 | 0 | 1 | 1 | 1 | 1 | 1 | 1 | 1 | 1 | 1 | 1 | 1 | 1 | 0 | 99.0 |
| 208 | 1 | 1 | 0 | 1 | 1 | 1 | 1 | 1 | 1 | 1 | 1 | 1 | 1 | 1 | 1 | 0 | 99.5 |
| 209 | 0 | 0 | 1 | 1 | 1 | 1 | 1 | 1 | 1 | 1 | 1 | 1 | 1 | 1 | 1 | 0 | 98.1 |
| 210 | 1 | 0 | 1 | 1 | 1 | 1 | 1 | 1 | 1 | 1 | 1 | 1 | 1 | 1 | 1 | 0 | 99.5 |
| 211 | 1 | 1 | 1 | 0 | 1 | 1 | 1 | 1 | 1 | 1 | 1 | 1 | 1 | 1 | 0 | 1 | 78.7 |
| 212 | 0 | 0 | 0 | 1 | 1 | 1 | 1 | 1 | 1 | 1 | 1 | 1 | 1 | 1 | 0 | 1 | 96.2 |
| 213 | 1 | 0 | 0 | 1 | 1 | 1 | 1 | 1 | 1 | 1 | 1 | 1 | 1 | 1 | 0 | 1 | 99.5 |
| 214 | 0 | 1 | 0 | 1 | 1 | 1 | 1 | 1 | 1 | 1 | 1 | 1 | 1 | 1 | 0 | 1 | 99.1 |
| 215 | 1 | 1 | 0 | 1 | 1 | 1 | 1 | 1 | 1 | 1 | 1 | 1 | 1 | 1 | 0 | 1 | 99.5 |
| 216 | 0 | 0 | 1 | 1 | 1 | 1 | 1 | 1 | 1 | 1 | 1 | 1 | 1 | 1 | 0 | 1 | 98.1 |
| 217 | 1 | 0 | 1 | 1 | 1 | 1 | 1 | 1 | 1 | 1 | 1 | 1 | 1 | 1 | 0 | 1 | 99.5 |
| 218 | 0 | 0 | 0 | 1 | 1 | 1 | 1 | 1 | 1 | 1 | 1 | 1 | 1 | 0 | 1 | 1 | 83.5 |
| 219 | 1 | 0 | 0 | 1 | 1 | 1 | 1 | 1 | 1 | 1 | 1 | 1 | 1 | 0 | 1 | 1 | 99.5 |
| 220 | 0 | 1 | 0 | 1 | 1 | 1 | 1 | 1 | 1 | 1 | 1 | 1 | 1 | 0 | 1 | 1 | 99.1 |
| 221 | 1 | 1 | 0 | 1 | 1 | 1 | 1 | 1 | 1 | 1 | 1 | 1 | 1 | 0 | 1 | 1 | 99.5 |
| 222 | 0 | 0 | 1 | 1 | 1 | 1 | 1 | 1 | 1 | 1 | 1 | 1 | 1 | 0 | 1 | 1 | 98.2 |
| 223 | 1 | 0 | 1 | 1 | 1 | 1 | 1 | 1 | 1 | 1 | 1 | 1 | 1 | 0 | 1 | 1 | 99.6 |
| 224 | 1 | 0 | 0 | 1 | 1 | 1 | 1 | 1 | 1 | 1 | 1 | 1 | 0 | 1 | 1 | 1 | 86.6 |
| 225 | 0 | 1 | 0 | 1 | 1 | 1 | 1 | 1 | 1 | 1 | 1 | 1 | 0 | 1 | 1 | 1 | 99.1 |
| 226 | 1 | 1 | 0 | 1 | 1 | 1 | 1 | 1 | 1 | 1 | 1 | 1 | 0 | 1 | 1 | 1 | 99.6 |
| 227 | 0 | 0 | 1 | 1 | 1 | 1 | 1 | 1 | 1 | 1 | 1 | 1 | 0 | 1 | 1 | 1 | 98.2 |
| 228 | 1 | 0 | 1 | 1 | 1 | 1 | 1 | 1 | 1 | 1 | 1 | 1 | 0 | 1 | 1 | 1 | 99.6 |
| 229 | 0 | 1 | 0 | 1 | 1 | 1 | 1 | 1 | 1 | 1 | 1 | 0 | 1 | 1 | 1 | 1 | 88.2 |
| 230 | 1 | 1 | 0 | 1 | 1 | 1 | 1 | 1 | 1 | 1 | 1 | 0 | 1 | 1 | 1 | 1 | 99.6 |
| 231 | 0 | 0 | 1 | 1 | 1 | 1 | 1 | 1 | 1 | 1 | 1 | 0 | 1 | 1 | 1 | 1 | 98.3 |
| 232 | 1 | 0 | 1 | 1 | 1 | 1 | 1 | 1 | 1 | 1 | 1 | 0 | 1 | 1 | 1 | 1 | 99.6 |
| 233 | 0 | 1 | 0 | 1 | 1 | 1 | 1 | 1 | 1 | 1 | 0 | 1 | 1 | 1 | 1 | 1 | 90.1 |
| 234 | 1 | 1 | 0 | 1 | 1 | 1 | 1 | 1 | 1 | 1 | 0 | 1 | 1 | 1 | 1 | 1 | 99.6 |
| 235 | 0 | 0 | 1 | 1 | 1 | 1 | 1 | 1 | 1 | 1 | 0 | 1 | 1 | 1 | 1 | 1 | 98.3 |
| 236 | 1 | 0 | 1 | 1 | 1 | 1 | 1 | 1 | 1 | 1 | 0 | 1 | 1 | 1 | 1 | 1 | 99.6 |
| 237 | 1 | 1 | 0 | 1 | 1 | 1 | 1 | 1 | 1 | 0 | 1 | 1 | 1 | 1 | 1 | 1 | 92.0 |
| 238 | 0 | 0 | 1 | 1 | 1 | 1 | 1 | 1 | 1 | 0 | 1 | 1 | 1 | 1 | 1 | 1 | 98.3 |
| 239 | 1 | 0 | 1 | 1 | 1 | 1 | 1 | 1 | 1 | 0 | 1 | 1 | 1 | 1 | 1 | 1 | 99.6 |
| 240 | 0 | 0 | 1 | 1 | 1 | 1 | 1 | 1 | 0 | 1 | 1 | 1 | 1 | 1 | 1 | 1 | 94.2 |
| 241 | 1 | 0 | 1 | 1 | 1 | 1 | 1 | 1 | 0 | 1 | 1 | 1 | 1 | 1 | 1 | 1 | 99.6 |
| 242 | 0 | 0 | 1 | 1 | 1 | 1 | 0 | 1 | 1 | 1 | 1 | 1 | 1 | 1 | 1 | 1 | 95.0 |
| 243 | 1 | 0 | 1 | 1 | 1 | 1 | 0 | 1 | 1 | 1 | 1 | 1 | 1 | 1 | 1 | 1 | 99.6 |
| 244 | 0 | 0 | 1 | 0 | 1 | 1 | 1 | 1 | 1 | 1 | 1 | 1 | 1 | 1 | 1 | 1 | 95.9 |
| 245 | 1 | 0 | 1 | 0 | 1 | 1 | 1 | 1 | 1 | 1 | 1 | 1 | 1 | 1 | 1 | 1 | 99.6 |
| 246 | 0 | 1 | 1 | 0 | 1 | 1 | 1 | 1 | 1 | 1 | 1 | 1 | 1 | 1 | 1 | 1 | 99.2 |
| 247 | 1 | 1 | 1 | 0 | 1 | 1 | 1 | 1 | 1 | 1 | 1 | 1 | 1 | 1 | 1 | 1 | 99.6 |
| 248 | 0 | 0 | 0 | 1 | 1 | 1 | 1 | 1 | 1 | 1 | 1 | 1 | 1 | 1 | 1 | 1 | 96.8 |
| 249 | 1 | 0 | 0 | 1 | 1 | 1 | 1 | 1 | 1 | 1 | 1 | 1 | 1 | 1 | 1 | 1 | 99.6 |
| 250 | 0 | 1 | 0 | 1 | 1 | 1 | 1 | 1 | 1 | 1 | 1 | 1 | 1 | 1 | 1 | 1 | 99.2 |
| 251 | 1 | 1 | 0 | 1 | 1 | 1 | 1 | 1 | 1 | 1 | 1 | 1 | 1 | 1 | 1 | 1 | 99.6 |
| 252 | 0 | 0 | 1 | 1 | 1 | 1 | 1 | 1 | 1 | 1 | 1 | 1 | 1 | 1 | 1 | 1 | 98.4 |
| 253 | 1 | 0 | 1 | 1 | 1 | 1 | 1 | 1 | 1 | 1 | 1 | 1 | 1 | 1 | 1 | 1 | 99.6 |
| 254 | 0 | 1 | 1 | 1 | 1 | 1 | 1 | 1 | 1 | 1 | 1 | 1 | 1 | 1 | 1 | 1 | 99.2 |
| 255 | 1 | 1 | 1 | 1 | 1 | 1 | 1 | 1 | 1 | 1 | 1 | 1 | 1 | 1 | 1 | 1 | 99.6 |

FIG.22A

| gray scale level | length (ratio) of corresponding subframe | | | | | | | | | | | | | | | sharing ratio (%) |
|---|---|---|---|---|---|---|---|---|---|---|---|---|---|---|---|---|
| | 1 | 2 | 4 | 8 | 10 | 10 | 10 | 12 | 12 | 14 | 17 | 21 | 25 | 30 | 36 | 43 | |
| 0 | 0 | 0 | 0 | 0 | 0 | 0 | 0 | 0 | 0 | 0 | 0 | 0 | 0 | 0 | 0 | 0 | - |
| 1 | 1 | 0 | 0 | 0 | 0 | 0 | 0 | 0 | 0 | 0 | 0 | 0 | 0 | 0 | 0 | 0 | 0.0 |
| 2 | 0 | 1 | 0 | 0 | 0 | 0 | 0 | 0 | 0 | 0 | 0 | 0 | 0 | 0 | 0 | 0 | 0.0 |
| 3 | 1 | 1 | 0 | 0 | 0 | 0 | 0 | 0 | 0 | 0 | 0 | 0 | 0 | 0 | 0 | 0 | 66.7 |
| 4 | 0 | 0 | 1 | 0 | 0 | 0 | 0 | 0 | 0 | 0 | 0 | 0 | 0 | 0 | 0 | 0 | 0.0 |
| 5 | 1 | 0 | 1 | 0 | 0 | 0 | 0 | 0 | 0 | 0 | 0 | 0 | 0 | 0 | 0 | 0 | 80.0 |
| 6 | 0 | 1 | 1 | 0 | 0 | 0 | 0 | 0 | 0 | 0 | 0 | 0 | 0 | 0 | 0 | 0 | 66.7 |
| 7 | 1 | 1 | 1 | 0 | 0 | 0 | 0 | 0 | 0 | 0 | 0 | 0 | 0 | 0 | 0 | 0 | 85.7 |
| 8 | 0 | 0 | 0 | 1 | 0 | 0 | 0 | 0 | 0 | 0 | 0 | 0 | 0 | 0 | 0 | 0 | 0.0 |
| 9 | 1 | 0 | 0 | 1 | 0 | 0 | 0 | 0 | 0 | 0 | 0 | 0 | 0 | 0 | 0 | 0 | 88.9 |
| 10 | 0 | 1 | 0 | 1 | 0 | 0 | 0 | 0 | 0 | 0 | 0 | 0 | 0 | 0 | 0 | 0 | 80.0 |
| 11 | 1 | 1 | 0 | 1 | 0 | 0 | 0 | 0 | 0 | 0 | 0 | 0 | 0 | 0 | 0 | 0 | 90.9 |
| 12 | 0 | 1 | 0 | 0 | 1 | 0 | 0 | 0 | 0 | 0 | 0 | 0 | 0 | 0 | 0 | 0 | 16.7 |
| 13 | 1 | 1 | 0 | 0 | 1 | 0 | 0 | 0 | 0 | 0 | 0 | 0 | 0 | 0 | 0 | 0 | 92.3 |
| 14 | 0 | 0 | 1 | 0 | 1 | 0 | 0 | 0 | 0 | 0 | 0 | 0 | 0 | 0 | 0 | 0 | 71.4 |
| 15 | 1 | 0 | 1 | 0 | 1 | 0 | 0 | 0 | 0 | 0 | 0 | 0 | 0 | 0 | 0 | 0 | 93.3 |
| 16 | 0 | 1 | 1 | 0 | 1 | 0 | 0 | 0 | 0 | 0 | 0 | 0 | 0 | 0 | 0 | 0 | 87.5 |
| 17 | 1 | 1 | 1 | 0 | 1 | 0 | 0 | 0 | 0 | 0 | 0 | 0 | 0 | 0 | 0 | 0 | 94.1 |
| 18 | 0 | 0 | 0 | 1 | 1 | 0 | 0 | 0 | 0 | 0 | 0 | 0 | 0 | 0 | 0 | 0 | 55.6 |
| 19 | 1 | 0 | 0 | 1 | 1 | 0 | 0 | 0 | 0 | 0 | 0 | 0 | 0 | 0 | 0 | 0 | 94.7 |
| 20 | 0 | 1 | 0 | 1 | 1 | 0 | 0 | 0 | 0 | 0 | 0 | 0 | 0 | 0 | 0 | 0 | 90.0 |
| 21 | 1 | 1 | 0 | 1 | 1 | 0 | 0 | 0 | 0 | 0 | 0 | 0 | 0 | 0 | 0 | 0 | 95.2 |
| 22 | 0 | 1 | 0 | 0 | 1 | 1 | 0 | 0 | 0 | 0 | 0 | 0 | 0 | 0 | 0 | 0 | 54.5 |
| 23 | 1 | 1 | 0 | 0 | 1 | 1 | 0 | 0 | 0 | 0 | 0 | 0 | 0 | 0 | 0 | 0 | 95.7 |
| 24 | 0 | 0 | 1 | 0 | 1 | 1 | 0 | 0 | 0 | 0 | 0 | 0 | 0 | 0 | 0 | 0 | 83.3 |
| 25 | 1 | 0 | 1 | 0 | 1 | 1 | 0 | 0 | 0 | 0 | 0 | 0 | 0 | 0 | 0 | 0 | 96.0 |
| 26 | 0 | 1 | 1 | 0 | 1 | 1 | 0 | 0 | 0 | 0 | 0 | 0 | 0 | 0 | 0 | 0 | 92.3 |
| 27 | 1 | 1 | 1 | 0 | 1 | 1 | 0 | 0 | 0 | 0 | 0 | 0 | 0 | 0 | 0 | 0 | 96.3 |
| 28 | 0 | 0 | 0 | 1 | 1 | 1 | 0 | 0 | 0 | 0 | 0 | 0 | 0 | 0 | 0 | 0 | 71.4 |
| 29 | 1 | 0 | 0 | 1 | 1 | 1 | 0 | 0 | 0 | 0 | 0 | 0 | 0 | 0 | 0 | 0 | 96.6 |
| 30 | 0 | 1 | 0 | 1 | 1 | 1 | 0 | 0 | 0 | 0 | 0 | 0 | 0 | 0 | 0 | 0 | 93.3 |
| 31 | 1 | 1 | 0 | 1 | 1 | 1 | 0 | 0 | 0 | 0 | 0 | 0 | 0 | 0 | 0 | 0 | 96.8 |
| 32 | 0 | 1 | 0 | 0 | 1 | 1 | 1 | 0 | 0 | 0 | 0 | 0 | 0 | 0 | 0 | 0 | 68.8 |
| 33 | 1 | 1 | 0 | 0 | 1 | 1 | 1 | 0 | 0 | 0 | 0 | 0 | 0 | 0 | 0 | 0 | 97.0 |
| 34 | 0 | 0 | 1 | 0 | 1 | 1 | 1 | 0 | 0 | 0 | 0 | 0 | 0 | 0 | 0 | 0 | 88.2 |
| 35 | 1 | 0 | 1 | 0 | 1 | 1 | 1 | 0 | 0 | 0 | 0 | 0 | 0 | 0 | 0 | 0 | 97.1 |
| 36 | 0 | 1 | 1 | 0 | 1 | 1 | 1 | 0 | 0 | 0 | 0 | 0 | 0 | 0 | 0 | 0 | 94.4 |
| 37 | 1 | 1 | 1 | 0 | 1 | 1 | 1 | 0 | 0 | 0 | 0 | 0 | 0 | 0 | 0 | 0 | 97.3 |
| 38 | 0 | 0 | 0 | 1 | 1 | 1 | 1 | 0 | 0 | 0 | 0 | 0 | 0 | 0 | 0 | 0 | 78.9 |
| 39 | 1 | 0 | 0 | 1 | 1 | 1 | 1 | 0 | 0 | 0 | 0 | 0 | 0 | 0 | 0 | 0 | 97.4 |
| 40 | 0 | 1 | 0 | 1 | 1 | 1 | 1 | 0 | 0 | 0 | 0 | 0 | 0 | 0 | 0 | 0 | 95.0 |
| 41 | 1 | 1 | 0 | 1 | 1 | 1 | 1 | 0 | 0 | 0 | 0 | 0 | 0 | 0 | 0 | 0 | 97.6 |
| 42 | 0 | 1 | 0 | 1 | 1 | 1 | 0 | 1 | 0 | 0 | 0 | 0 | 0 | 0 | 0 | 0 | 71.4 |
| 43 | 1 | 1 | 0 | 1 | 1 | 1 | 0 | 1 | 0 | 0 | 0 | 0 | 0 | 0 | 0 | 0 | 97.7 |
| 44 | 0 | 1 | 0 | 0 | 1 | 1 | 1 | 1 | 0 | 0 | 0 | 0 | 0 | 0 | 0 | 0 | 77.3 |
| 45 | 1 | 1 | 0 | 0 | 1 | 1 | 1 | 1 | 0 | 0 | 0 | 0 | 0 | 0 | 0 | 0 | 97.8 |
| 46 | 0 | 0 | 1 | 0 | 1 | 1 | 1 | 1 | 0 | 0 | 0 | 0 | 0 | 0 | 0 | 0 | 91.3 |
| 47 | 1 | 0 | 1 | 0 | 1 | 1 | 1 | 1 | 0 | 0 | 0 | 0 | 0 | 0 | 0 | 0 | 97.9 |
| 48 | 0 | 1 | 1 | 0 | 1 | 1 | 1 | 1 | 0 | 0 | 0 | 0 | 0 | 0 | 0 | 0 | 95.8 |
| 49 | 1 | 1 | 1 | 0 | 1 | 1 | 1 | 1 | 0 | 0 | 0 | 0 | 0 | 0 | 0 | 0 | 98.0 |
| 50 | 0 | 0 | 0 | 1 | 1 | 1 | 1 | 1 | 0 | 0 | 0 | 0 | 0 | 0 | 0 | 0 | 84.0 |
| 51 | 1 | 0 | 0 | 1 | 1 | 1 | 1 | 1 | 0 | 0 | 0 | 0 | 0 | 0 | 0 | 0 | 98.0 |
| 52 | 0 | 1 | 0 | 1 | 1 | 1 | 1 | 1 | 0 | 0 | 0 | 0 | 0 | 0 | 0 | 0 | 96.2 |
| 53 | 1 | 1 | 0 | 1 | 1 | 1 | 1 | 1 | 0 | 0 | 0 | 0 | 0 | 0 | 0 | 0 | 98.1 |
| 54 | 0 | 1 | 0 | 1 | 1 | 1 | 0 | 1 | 1 | 0 | 0 | 0 | 0 | 0 | 0 | 0 | 77.8 |
| 55 | 1 | 1 | 0 | 1 | 1 | 1 | 0 | 1 | 1 | 0 | 0 | 0 | 0 | 0 | 0 | 0 | 98.2 |
| 56 | 0 | 1 | 0 | 0 | 1 | 1 | 1 | 1 | 1 | 0 | 0 | 0 | 0 | 0 | 0 | 0 | 82.1 |
| 57 | 1 | 1 | 0 | 0 | 1 | 1 | 1 | 1 | 1 | 0 | 0 | 0 | 0 | 0 | 0 | 0 | 98.2 |
| 58 | 0 | 0 | 1 | 0 | 1 | 1 | 1 | 1 | 1 | 0 | 0 | 0 | 0 | 0 | 0 | 0 | 93.1 |
| 59 | 1 | 0 | 1 | 0 | 1 | 1 | 1 | 1 | 1 | 0 | 0 | 0 | 0 | 0 | 0 | 0 | 98.3 |
| 60 | 0 | 1 | 1 | 0 | 1 | 1 | 1 | 1 | 1 | 0 | 0 | 0 | 0 | 0 | 0 | 0 | 96.7 |
| 61 | 1 | 1 | 1 | 0 | 1 | 1 | 1 | 1 | 1 | 0 | 0 | 0 | 0 | 0 | 0 | 0 | 98.4 |
| 62 | 0 | 0 | 0 | 1 | 1 | 1 | 1 | 1 | 1 | 0 | 0 | 0 | 0 | 0 | 0 | 0 | 87.1 |
| 63 | 1 | 0 | 0 | 1 | 1 | 1 | 1 | 1 | 1 | 0 | 0 | 0 | 0 | 0 | 0 | 0 | 98.4 |
| 64 | 0 | 1 | 0 | 1 | 1 | 1 | 1 | 1 | 1 | 0 | 0 | 0 | 0 | 0 | 0 | 0 | 96.9 |
| 65 | 1 | 1 | 0 | 1 | 1 | 1 | 1 | 1 | 1 | 0 | 0 | 0 | 0 | 0 | 0 | 0 | 98.5 |

FIG.22B

| gray scale level | length (ratio) of corresponding subframe | | | | | | | | | | | | | | | | sharing ratio (%) |
|---|---|---|---|---|---|---|---|---|---|---|---|---|---|---|---|---|---|
| | 1 | 2 | 4 | 8 | 10 | 10 | 10 | 12 | 12 | 14 | 17 | 21 | 25 | 30 | 36 | 43 | |
| 66 | 0 | 1 | 0 | 1 | 1 | 1 | 1 | 1 | 0 | 1 | 0 | 0 | 0 | 0 | 0 | 0 | 78.8 |
| 67 | 1 | 1 | 0 | 1 | 1 | 1 | 1 | 1 | 0 | 1 | 0 | 0 | 0 | 0 | 0 | 0 | 98.5 |
| 68 | 0 | 1 | 0 | 1 | 1 | 1 | 0 | 1 | 1 | 1 | 0 | 0 | 0 | 0 | 0 | 0 | 82.4 |
| 69 | 1 | 1 | 0 | 1 | 1 | 1 | 0 | 1 | 1 | 1 | 0 | 0 | 0 | 0 | 0 | 0 | 98.6 |
| 70 | 0 | 1 | 0 | 0 | 1 | 1 | 1 | 1 | 1 | 1 | 0 | 0 | 0 | 0 | 0 | 0 | 85.7 |
| 71 | 1 | 1 | 0 | 0 | 1 | 1 | 1 | 1 | 1 | 1 | 0 | 0 | 0 | 0 | 0 | 0 | 98.6 |
| 72 | 0 | 0 | 1 | 0 | 1 | 1 | 1 | 1 | 1 | 1 | 0 | 0 | 0 | 0 | 0 | 0 | 94.4 |
| 73 | 1 | 0 | 1 | 0 | 1 | 1 | 1 | 1 | 1 | 1 | 0 | 0 | 0 | 0 | 0 | 0 | 98.6 |
| 74 | 0 | 1 | 1 | 0 | 1 | 1 | 1 | 1 | 1 | 1 | 0 | 0 | 0 | 0 | 0 | 0 | 97.3 |
| 75 | 1 | 1 | 1 | 0 | 1 | 1 | 1 | 1 | 1 | 1 | 0 | 0 | 0 | 0 | 0 | 0 | 98.7 |
| 76 | 0 | 0 | 0 | 1 | 1 | 1 | 1 | 1 | 1 | 1 | 0 | 0 | 0 | 0 | 0 | 0 | 89.5 |
| 77 | 1 | 0 | 0 | 1 | 1 | 1 | 1 | 1 | 1 | 1 | 0 | 0 | 0 | 0 | 0 | 0 | 98.7 |
| 78 | 0 | 1 | 0 | 1 | 1 | 1 | 1 | 1 | 1 | 1 | 0 | 0 | 0 | 0 | 0 | 0 | 97.4 |
| 79 | 1 | 1 | 0 | 1 | 1 | 1 | 1 | 1 | 1 | 1 | 0 | 0 | 0 | 0 | 0 | 0 | 98.7 |
| 80 | 1 | 0 | 0 | 1 | 1 | 1 | 1 | 1 | 1 | 0 | 1 | 0 | 0 | 0 | 0 | 0 | 78.8 |
| 81 | 0 | 1 | 0 | 1 | 1 | 1 | 1 | 1 | 1 | 0 | 1 | 0 | 0 | 0 | 0 | 0 | 97.5 |
| 82 | 1 | 1 | 0 | 1 | 1 | 1 | 1 | 1 | 1 | 0 | 1 | 0 | 0 | 0 | 0 | 0 | 98.8 |
| 83 | 0 | 1 | 0 | 1 | 1 | 1 | 1 | 1 | 0 | 1 | 1 | 0 | 0 | 0 | 0 | 0 | 83.1 |
| 84 | 1 | 1 | 0 | 1 | 1 | 1 | 1 | 1 | 0 | 1 | 1 | 0 | 0 | 0 | 0 | 0 | 98.8 |
| 85 | 0 | 1 | 0 | 1 | 1 | 1 | 0 | 1 | 1 | 1 | 1 | 0 | 0 | 0 | 0 | 0 | 85.9 |
| 86 | 1 | 1 | 0 | 1 | 1 | 1 | 0 | 1 | 1 | 1 | 1 | 0 | 0 | 0 | 0 | 0 | 98.8 |
| 87 | 0 | 1 | 0 | 0 | 1 | 1 | 1 | 1 | 1 | 1 | 1 | 0 | 0 | 0 | 0 | 0 | 88.5 |
| 88 | 1 | 1 | 0 | 0 | 1 | 1 | 1 | 1 | 1 | 1 | 1 | 0 | 0 | 0 | 0 | 0 | 98.9 |
| 89 | 0 | 0 | 1 | 0 | 1 | 1 | 1 | 1 | 1 | 1 | 1 | 0 | 0 | 0 | 0 | 0 | 95.5 |
| 90 | 1 | 0 | 1 | 0 | 1 | 1 | 1 | 1 | 1 | 1 | 1 | 0 | 0 | 0 | 0 | 0 | 98.9 |
| 91 | 0 | 1 | 1 | 0 | 1 | 1 | 1 | 1 | 1 | 1 | 1 | 0 | 0 | 0 | 0 | 0 | 97.8 |
| 92 | 1 | 1 | 1 | 0 | 1 | 1 | 1 | 1 | 1 | 1 | 1 | 0 | 0 | 0 | 0 | 0 | 98.9 |
| 93 | 0 | 0 | 0 | 1 | 1 | 1 | 1 | 1 | 1 | 1 | 1 | 0 | 0 | 0 | 0 | 0 | 91.4 |
| 94 | 1 | 0 | 0 | 1 | 1 | 1 | 1 | 1 | 1 | 1 | 1 | 0 | 0 | 0 | 0 | 0 | 98.9 |
| 95 | 0 | 1 | 0 | 1 | 1 | 1 | 1 | 1 | 1 | 1 | 1 | 0 | 0 | 0 | 0 | 0 | 97.9 |
| 96 | 1 | 1 | 0 | 1 | 1 | 1 | 1 | 1 | 1 | 1 | 1 | 0 | 0 | 0 | 0 | 0 | 99.0 |
| 97 | 0 | 0 | 0 | 1 | 1 | 1 | 1 | 1 | 1 | 1 | 0 | 1 | 0 | 0 | 0 | 0 | 78.4 |
| 98 | 1 | 0 | 0 | 1 | 1 | 1 | 1 | 1 | 1 | 1 | 0 | 1 | 0 | 0 | 0 | 0 | 99.0 |
| 99 | 0 | 1 | 0 | 1 | 1 | 1 | 1 | 1 | 1 | 1 | 0 | 1 | 0 | 0 | 0 | 0 | 98.0 |
| 100 | 1 | 1 | 0 | 1 | 1 | 1 | 1 | 1 | 1 | 1 | 0 | 1 | 0 | 0 | 0 | 0 | 99.0 |
| 101 | 1 | 0 | 0 | 1 | 1 | 1 | 1 | 1 | 1 | 0 | 1 | 1 | 0 | 0 | 0 | 0 | 83.2 |
| 102 | 0 | 1 | 0 | 1 | 1 | 1 | 1 | 1 | 1 | 0 | 1 | 1 | 0 | 0 | 0 | 0 | 98.0 |
| 103 | 1 | 1 | 0 | 1 | 1 | 1 | 1 | 1 | 1 | 0 | 1 | 1 | 0 | 0 | 0 | 0 | 99.0 |
| 104 | 0 | 1 | 0 | 1 | 1 | 1 | 1 | 1 | 0 | 1 | 1 | 1 | 0 | 0 | 0 | 0 | 86.5 |
| 105 | 1 | 1 | 0 | 1 | 1 | 1 | 1 | 1 | 0 | 1 | 1 | 1 | 0 | 0 | 0 | 0 | 99.0 |
| 106 | 0 | 1 | 0 | 1 | 1 | 1 | 0 | 1 | 1 | 1 | 1 | 1 | 0 | 0 | 0 | 0 | 88.7 |
| 107 | 1 | 1 | 0 | 1 | 1 | 1 | 0 | 1 | 1 | 1 | 1 | 1 | 0 | 0 | 0 | 0 | 99.1 |
| 108 | 0 | 1 | 0 | 0 | 1 | 1 | 1 | 1 | 1 | 1 | 1 | 1 | 0 | 0 | 0 | 0 | 90.7 |
| 109 | 1 | 1 | 0 | 0 | 1 | 1 | 1 | 1 | 1 | 1 | 1 | 1 | 0 | 0 | 0 | 0 | 99.1 |
| 110 | 0 | 0 | 1 | 0 | 1 | 1 | 1 | 1 | 1 | 1 | 1 | 1 | 0 | 0 | 0 | 0 | 96.4 |
| 111 | 1 | 0 | 1 | 0 | 1 | 1 | 1 | 1 | 1 | 1 | 1 | 1 | 0 | 0 | 0 | 0 | 99.1 |
| 112 | 0 | 1 | 1 | 0 | 1 | 1 | 1 | 1 | 1 | 1 | 1 | 1 | 0 | 0 | 0 | 0 | 98.2 |
| 113 | 1 | 1 | 1 | 0 | 1 | 1 | 1 | 1 | 1 | 1 | 1 | 1 | 0 | 0 | 0 | 0 | 99.1 |
| 114 | 0 | 0 | 0 | 1 | 1 | 1 | 1 | 1 | 1 | 1 | 1 | 1 | 0 | 0 | 0 | 0 | 93.0 |
| 115 | 1 | 0 | 0 | 1 | 1 | 1 | 1 | 1 | 1 | 1 | 1 | 1 | 0 | 0 | 0 | 0 | 99.1 |
| 116 | 0 | 1 | 0 | 1 | 1 | 1 | 1 | 1 | 1 | 1 | 1 | 1 | 0 | 0 | 0 | 0 | 98.3 |
| 117 | 1 | 1 | 0 | 1 | 1 | 1 | 1 | 1 | 1 | 1 | 1 | 1 | 0 | 0 | 0 | 0 | 99.1 |
| 118 | 0 | 0 | 0 | 1 | 1 | 1 | 1 | 1 | 1 | 1 | 1 | 0 | 1 | 0 | 0 | 0 | 78.8 |
| 119 | 1 | 0 | 0 | 1 | 1 | 1 | 1 | 1 | 1 | 1 | 1 | 0 | 1 | 0 | 0 | 0 | 99.2 |
| 120 | 0 | 1 | 0 | 1 | 1 | 1 | 1 | 1 | 1 | 1 | 1 | 0 | 1 | 0 | 0 | 0 | 98.3 |
| 121 | 1 | 1 | 0 | 1 | 1 | 1 | 1 | 1 | 1 | 1 | 1 | 0 | 1 | 0 | 0 | 0 | 99.2 |
| 122 | 0 | 0 | 0 | 1 | 1 | 1 | 1 | 1 | 1 | 1 | 0 | 1 | 1 | 0 | 0 | 0 | 82.8 |
| 123 | 1 | 0 | 0 | 1 | 1 | 1 | 1 | 1 | 1 | 1 | 0 | 1 | 1 | 0 | 0 | 0 | 99.2 |
| 124 | 0 | 1 | 0 | 1 | 1 | 1 | 1 | 1 | 1 | 1 | 0 | 1 | 1 | 0 | 0 | 0 | 98.4 |
| 125 | 1 | 1 | 0 | 1 | 1 | 1 | 1 | 1 | 1 | 1 | 0 | 1 | 1 | 0 | 0 | 0 | 99.2 |
| 126 | 1 | 0 | 0 | 1 | 1 | 1 | 1 | 1 | 1 | 0 | 1 | 1 | 1 | 0 | 0 | 0 | 86.5 |
| 127 | 0 | 1 | 0 | 1 | 1 | 1 | 1 | 1 | 1 | 0 | 1 | 1 | 1 | 0 | 0 | 0 | 98.4 |

FIG.22C

| gray scale level | length (ratio) of corresponding subframe | | | | | | | | | | | | | | | | sharing ratio (%) |
|---|---|---|---|---|---|---|---|---|---|---|---|---|---|---|---|---|---|
| | 1 | 2 | 4 | 8 | 10 | 10 | 10 | 12 | 12 | 14 | 17 | 21 | 25 | 30 | 36 | 43 | |
| 128 | 1 | 1 | 0 | 1 | 1 | 1 | 1 | 1 | 1 | 0 | 1 | 1 | 1 | 0 | 0 | 0 | 99.2 |
| 129 | 0 | 1 | 0 | 1 | 1 | 1 | 1 | 1 | 0 | 1 | 1 | 1 | 1 | 0 | 0 | 0 | 89.1 |
| 130 | 1 | 1 | 0 | 1 | 1 | 1 | 1 | 1 | 0 | 1 | 1 | 1 | 1 | 0 | 0 | 0 | 99.2 |
| 131 | 0 | 1 | 0 | 1 | 1 | 1 | 0 | 1 | 1 | 1 | 1 | 1 | 1 | 0 | 0 | 0 | 90.8 |
| 132 | 1 | 1 | 0 | 1 | 1 | 1 | 0 | 1 | 1 | 1 | 1 | 1 | 1 | 0 | 0 | 0 | 99.2 |
| 133 | 0 | 1 | 0 | 0 | 1 | 1 | 1 | 1 | 1 | 1 | 1 | 1 | 1 | 0 | 0 | 0 | 92.5 |
| 134 | 1 | 1 | 0 | 0 | 1 | 1 | 1 | 1 | 1 | 1 | 1 | 1 | 1 | 0 | 0 | 0 | 99.3 |
| 135 | 0 | 0 | 1 | 0 | 1 | 1 | 1 | 1 | 1 | 1 | 1 | 1 | 1 | 0 | 0 | 0 | 97.0 |
| 136 | 1 | 0 | 1 | 0 | 1 | 1 | 1 | 1 | 1 | 1 | 1 | 1 | 1 | 0 | 0 | 0 | 99.3 |
| 137 | 0 | 1 | 1 | 0 | 1 | 1 | 1 | 1 | 1 | 1 | 1 | 1 | 1 | 0 | 0 | 0 | 98.5 |
| 138 | 1 | 1 | 1 | 0 | 1 | 1 | 1 | 1 | 1 | 1 | 1 | 1 | 1 | 0 | 0 | 0 | 99.3 |
| 139 | 0 | 0 | 0 | 1 | 1 | 1 | 1 | 1 | 1 | 1 | 1 | 1 | 1 | 0 | 0 | 0 | 94.2 |
| 140 | 1 | 0 | 0 | 1 | 1 | 1 | 1 | 1 | 1 | 1 | 1 | 1 | 1 | 0 | 0 | 0 | 99.3 |
| 141 | 0 | 1 | 0 | 1 | 1 | 1 | 1 | 1 | 1 | 1 | 1 | 1 | 1 | 0 | 0 | 0 | 98.6 |
| 142 | 1 | 1 | 0 | 1 | 1 | 1 | 1 | 1 | 1 | 1 | 1 | 1 | 1 | 0 | 0 | 0 | 99.3 |
| 143 | 1 | 1 | 1 | 0 | 1 | 1 | 1 | 1 | 1 | 1 | 1 | 1 | 0 | 1 | 0 | 0 | 76.2 |
| 144 | 0 | 0 | 0 | 1 | 1 | 1 | 1 | 1 | 1 | 1 | 1 | 1 | 0 | 1 | 0 | 0 | 94.4 |
| 145 | 1 | 0 | 0 | 1 | 1 | 1 | 1 | 1 | 1 | 1 | 1 | 1 | 0 | 1 | 0 | 0 | 99.3 |
| 146 | 0 | 1 | 0 | 1 | 1 | 1 | 1 | 1 | 1 | 1 | 1 | 1 | 0 | 1 | 0 | 0 | 98.6 |
| 147 | 1 | 1 | 0 | 1 | 1 | 1 | 1 | 1 | 1 | 1 | 1 | 1 | 0 | 1 | 0 | 0 | 99.3 |
| 148 | 0 | 0 | 0 | 1 | 1 | 1 | 1 | 1 | 1 | 1 | 1 | 0 | 1 | 1 | 0 | 0 | 83.1 |
| 149 | 1 | 0 | 0 | 1 | 1 | 1 | 1 | 1 | 1 | 1 | 1 | 0 | 1 | 1 | 0 | 0 | 99.3 |
| 150 | 0 | 1 | 0 | 1 | 1 | 1 | 1 | 1 | 1 | 1 | 1 | 0 | 1 | 1 | 0 | 0 | 98.7 |
| 151 | 1 | 1 | 0 | 1 | 1 | 1 | 1 | 1 | 1 | 1 | 1 | 0 | 1 | 1 | 0 | 0 | 99.3 |
| 152 | 0 | 0 | 0 | 1 | 1 | 1 | 1 | 1 | 1 | 1 | 0 | 1 | 1 | 1 | 0 | 0 | 86.2 |
| 153 | 1 | 0 | 0 | 1 | 1 | 1 | 1 | 1 | 1 | 1 | 0 | 1 | 1 | 1 | 0 | 0 | 99.3 |
| 154 | 0 | 1 | 0 | 1 | 1 | 1 | 1 | 1 | 1 | 1 | 0 | 1 | 1 | 1 | 0 | 0 | 98.7 |
| 155 | 1 | 1 | 0 | 1 | 1 | 1 | 1 | 1 | 1 | 1 | 0 | 1 | 1 | 1 | 0 | 0 | 99.4 |
| 156 | 1 | 0 | 0 | 1 | 1 | 1 | 1 | 1 | 1 | 0 | 1 | 1 | 1 | 1 | 0 | 0 | 89.1 |
| 157 | 0 | 1 | 0 | 1 | 1 | 1 | 1 | 1 | 1 | 0 | 1 | 1 | 1 | 1 | 0 | 0 | 98.7 |
| 158 | 1 | 1 | 0 | 1 | 1 | 1 | 1 | 1 | 1 | 0 | 1 | 1 | 1 | 1 | 0 | 0 | 99.4 |
| 159 | 0 | 1 | 0 | 1 | 1 | 1 | 1 | 1 | 0 | 1 | 1 | 1 | 1 | 1 | 0 | 0 | 91.2 |
| 160 | 1 | 1 | 0 | 1 | 1 | 1 | 1 | 1 | 0 | 1 | 1 | 1 | 1 | 1 | 0 | 0 | 99.4 |
| 161 | 0 | 1 | 0 | 1 | 1 | 1 | 0 | 1 | 1 | 1 | 1 | 1 | 1 | 1 | 0 | 0 | 92.5 |
| 162 | 1 | 1 | 0 | 1 | 1 | 1 | 0 | 1 | 1 | 1 | 1 | 1 | 1 | 1 | 0 | 0 | 99.4 |
| 163 | 0 | 1 | 0 | 0 | 1 | 1 | 1 | 1 | 1 | 1 | 1 | 1 | 1 | 1 | 0 | 0 | 93.9 |
| 164 | 1 | 1 | 0 | 0 | 1 | 1 | 1 | 1 | 1 | 1 | 1 | 1 | 1 | 1 | 0 | 0 | 99.4 |
| 165 | 0 | 0 | 1 | 0 | 1 | 1 | 1 | 1 | 1 | 1 | 1 | 1 | 1 | 1 | 0 | 0 | 97.6 |
| 166 | 1 | 0 | 1 | 0 | 1 | 1 | 1 | 1 | 1 | 1 | 1 | 1 | 1 | 1 | 0 | 0 | 99.4 |
| 167 | 0 | 1 | 1 | 0 | 1 | 1 | 1 | 1 | 1 | 1 | 1 | 1 | 1 | 1 | 0 | 0 | 98.8 |
| 168 | 1 | 1 | 1 | 0 | 1 | 1 | 1 | 1 | 1 | 1 | 1 | 1 | 1 | 1 | 0 | 0 | 99.4 |
| 169 | 0 | 0 | 0 | 1 | 1 | 1 | 1 | 1 | 1 | 1 | 1 | 1 | 1 | 1 | 0 | 0 | 95.3 |
| 170 | 1 | 0 | 0 | 1 | 1 | 1 | 1 | 1 | 1 | 1 | 1 | 1 | 1 | 1 | 0 | 0 | 99.4 |
| 171 | 0 | 1 | 0 | 1 | 1 | 1 | 1 | 1 | 1 | 1 | 1 | 1 | 1 | 1 | 0 | 0 | 98.8 |
| 172 | 1 | 1 | 0 | 1 | 1 | 1 | 1 | 1 | 1 | 1 | 1 | 1 | 1 | 1 | 0 | 0 | 99.4 |
| 173 | 0 | 1 | 1 | 0 | 1 | 1 | 1 | 1 | 1 | 1 | 1 | 1 | 1 | 0 | 1 | 0 | 76.9 |
| 174 | 1 | 1 | 1 | 0 | 1 | 1 | 1 | 1 | 1 | 1 | 1 | 1 | 1 | 0 | 1 | 0 | 99.4 |
| 175 | 0 | 0 | 0 | 1 | 1 | 1 | 1 | 1 | 1 | 1 | 1 | 1 | 1 | 0 | 1 | 0 | 95.4 |
| 176 | 1 | 0 | 0 | 1 | 1 | 1 | 1 | 1 | 1 | 1 | 1 | 1 | 1 | 0 | 1 | 0 | 99.4 |
| 177 | 0 | 1 | 0 | 1 | 1 | 1 | 1 | 1 | 1 | 1 | 1 | 1 | 1 | 0 | 1 | 0 | 98.9 |
| 178 | 1 | 1 | 0 | 1 | 1 | 1 | 1 | 1 | 1 | 1 | 1 | 1 | 1 | 0 | 1 | 0 | 99.4 |
| 179 | 1 | 1 | 1 | 0 | 1 | 1 | 1 | 1 | 1 | 1 | 1 | 1 | 0 | 1 | 1 | 0 | 81.0 |
| 180 | 0 | 0 | 0 | 1 | 1 | 1 | 1 | 1 | 1 | 1 | 1 | 1 | 0 | 1 | 1 | 0 | 95.6 |
| 181 | 1 | 0 | 0 | 1 | 1 | 1 | 1 | 1 | 1 | 1 | 1 | 1 | 0 | 1 | 1 | 0 | 99.4 |
| 182 | 0 | 1 | 0 | 1 | 1 | 1 | 1 | 1 | 1 | 1 | 1 | 1 | 0 | 1 | 1 | 0 | 98.9 |
| 183 | 1 | 1 | 0 | 1 | 1 | 1 | 1 | 1 | 1 | 1 | 1 | 1 | 0 | 1 | 1 | 0 | 99.5 |
| 184 | 0 | 0 | 0 | 1 | 1 | 1 | 1 | 1 | 1 | 1 | 1 | 0 | 1 | 1 | 1 | 0 | 86.4 |
| 185 | 1 | 0 | 0 | 1 | 1 | 1 | 1 | 1 | 1 | 1 | 1 | 0 | 1 | 1 | 1 | 0 | 99.5 |
| 186 | 0 | 1 | 0 | 1 | 1 | 1 | 1 | 1 | 1 | 1 | 1 | 0 | 1 | 1 | 1 | 0 | 98.9 |
| 187 | 1 | 1 | 0 | 1 | 1 | 1 | 1 | 1 | 1 | 1 | 1 | 0 | 1 | 1 | 1 | 0 | 99.5 |
| 188 | 0 | 0 | 0 | 1 | 1 | 1 | 1 | 1 | 1 | 1 | 0 | 1 | 1 | 1 | 1 | 0 | 88.8 |
| 189 | 1 | 0 | 0 | 1 | 1 | 1 | 1 | 1 | 1 | 1 | 0 | 1 | 1 | 1 | 1 | 0 | 99.5 |
| 190 | 0 | 1 | 0 | 1 | 1 | 1 | 1 | 1 | 1 | 1 | 0 | 1 | 1 | 1 | 1 | 0 | 98.9 |
| 191 | 1 | 1 | 0 | 1 | 1 | 1 | 1 | 1 | 1 | 1 | 0 | 1 | 1 | 1 | 1 | 0 | 99.5 |
| 192 | 1 | 0 | 0 | 1 | 1 | 1 | 1 | 1 | 1 | 0 | 1 | 1 | 1 | 1 | 1 | 0 | 91.1 |
| 193 | 0 | 1 | 0 | 1 | 1 | 1 | 1 | 1 | 1 | 0 | 1 | 1 | 1 | 1 | 1 | 0 | 99.0 |

FIG.22D

| gray scale level | length (ratio) of corresponding subframe | | | | | | | | | | | | | | | | sharing ratio (%) |
|---|---|---|---|---|---|---|---|---|---|---|---|---|---|---|---|---|---|
| | 1 | 2 | 4 | 8 | 10 | 10 | 10 | 12 | 12 | 14 | 17 | 21 | 25 | 30 | 36 | 43 | |
| 194 | 1 | 1 | 0 | 1 | 1 | 1 | 1 | 1 | 1 | 0 | 1 | 1 | 1 | 1 | 1 | 0 | 99.5 |
| 195 | 0 | 1 | 0 | 1 | 1 | 1 | 1 | 1 | 0 | 1 | 1 | 1 | 1 | 1 | 1 | 0 | 92.8 |
| 196 | 1 | 1 | 0 | 1 | 1 | 1 | 1 | 1 | 0 | 1 | 1 | 1 | 1 | 1 | 1 | 0 | 99.5 |
| 197 | 0 | 1 | 0 | 1 | 1 | 1 | 0 | 1 | 1 | 1 | 1 | 1 | 1 | 1 | 1 | 0 | 93.9 |
| 198 | 1 | 1 | 0 | 1 | 1 | 1 | 0 | 1 | 1 | 1 | 1 | 1 | 1 | 1 | 1 | 0 | 99.5 |
| 199 | 0 | 1 | 0 | 0 | 1 | 1 | 1 | 1 | 1 | 1 | 1 | 1 | 1 | 1 | 1 | 0 | 95.0 |
| 200 | 1 | 1 | 0 | 0 | 1 | 1 | 1 | 1 | 1 | 1 | 1 | 1 | 1 | 1 | 1 | 0 | 99.5 |
| 201 | 0 | 0 | 1 | 0 | 1 | 1 | 1 | 1 | 1 | 1 | 1 | 1 | 1 | 1 | 1 | 0 | 98.0 |
| 202 | 1 | 0 | 1 | 0 | 1 | 1 | 1 | 1 | 1 | 1 | 1 | 1 | 1 | 1 | 1 | 0 | 99.5 |
| 203 | 0 | 1 | 1 | 0 | 1 | 1 | 1 | 1 | 1 | 1 | 1 | 1 | 1 | 1 | 1 | 0 | 99.0 |
| 204 | 1 | 1 | 1 | 0 | 1 | 1 | 1 | 1 | 1 | 1 | 1 | 1 | 1 | 1 | 1 | 0 | 99.5 |
| 205 | 0 | 0 | 0 | 1 | 1 | 1 | 1 | 1 | 1 | 1 | 1 | 1 | 1 | 1 | 1 | 0 | 96.1 |
| 206 | 1 | 0 | 0 | 1 | 1 | 1 | 1 | 1 | 1 | 1 | 1 | 1 | 1 | 1 | 1 | 0 | 99.5 |
| 207 | 0 | 1 | 0 | 1 | 1 | 1 | 1 | 1 | 1 | 1 | 1 | 1 | 1 | 1 | 1 | 0 | 99.0 |
| 208 | 1 | 1 | 0 | 1 | 1 | 1 | 1 | 1 | 1 | 1 | 1 | 1 | 1 | 1 | 1 | 0 | 99.5 |
| 209 | 1 | 0 | 1 | 0 | 1 | 1 | 1 | 1 | 1 | 1 | 1 | 1 | 1 | 1 | 0 | 1 | 77.5 |
| 210 | 0 | 1 | 1 | 0 | 1 | 1 | 1 | 1 | 1 | 1 | 1 | 1 | 1 | 1 | 0 | 1 | 99.0 |
| 211 | 1 | 1 | 1 | 0 | 1 | 1 | 1 | 1 | 1 | 1 | 1 | 1 | 1 | 1 | 0 | 1 | 99.5 |
| 212 | 0 | 0 | 0 | 1 | 1 | 1 | 1 | 1 | 1 | 1 | 1 | 1 | 1 | 1 | 0 | 1 | 96.2 |
| 213 | 1 | 0 | 0 | 1 | 1 | 1 | 1 | 1 | 1 | 1 | 1 | 1 | 1 | 1 | 0 | 1 | 99.5 |
| 214 | 0 | 1 | 0 | 1 | 1 | 1 | 1 | 1 | 1 | 1 | 1 | 1 | 1 | 1 | 0 | 1 | 99.1 |
| 215 | 1 | 1 | 0 | 1 | 1 | 1 | 1 | 1 | 1 | 1 | 1 | 1 | 1 | 1 | 0 | 1 | 99.5 |
| 216 | 0 | 1 | 1 | 0 | 1 | 1 | 1 | 1 | 1 | 1 | 1 | 1 | 1 | 0 | 1 | 1 | 81.5 |
| 217 | 1 | 1 | 1 | 0 | 1 | 1 | 1 | 1 | 1 | 1 | 1 | 1 | 1 | 0 | 1 | 1 | 99.5 |
| 218 | 0 | 0 | 0 | 1 | 1 | 1 | 1 | 1 | 1 | 1 | 1 | 1 | 1 | 0 | 1 | 1 | 96.3 |
| 219 | 1 | 0 | 0 | 1 | 1 | 1 | 1 | 1 | 1 | 1 | 1 | 1 | 1 | 0 | 1 | 1 | 99.5 |
| 220 | 0 | 1 | 0 | 1 | 1 | 1 | 1 | 1 | 1 | 1 | 1 | 1 | 1 | 0 | 1 | 1 | 99.1 |
| 221 | 1 | 1 | 0 | 1 | 1 | 1 | 1 | 1 | 1 | 1 | 1 | 1 | 1 | 0 | 1 | 1 | 99.5 |
| 222 | 1 | 1 | 1 | 0 | 1 | 1 | 1 | 1 | 1 | 1 | 1 | 1 | 0 | 1 | 1 | 1 | 84.7 |
| 223 | 0 | 0 | 0 | 1 | 1 | 1 | 1 | 1 | 1 | 1 | 1 | 1 | 0 | 1 | 1 | 1 | 96.4 |
| 224 | 1 | 0 | 0 | 1 | 1 | 1 | 1 | 1 | 1 | 1 | 1 | 1 | 0 | 1 | 1 | 1 | 99.6 |
| 225 | 0 | 1 | 0 | 1 | 1 | 1 | 1 | 1 | 1 | 1 | 1 | 1 | 0 | 1 | 1 | 1 | 99.1 |
| 226 | 1 | 1 | 0 | 1 | 1 | 1 | 1 | 1 | 1 | 1 | 1 | 1 | 0 | 1 | 1 | 1 | 99.6 |
| 227 | 0 | 0 | 0 | 1 | 1 | 1 | 1 | 1 | 1 | 1 | 1 | 0 | 1 | 1 | 1 | 1 | 89.0 |
| 228 | 1 | 0 | 0 | 1 | 1 | 1 | 1 | 1 | 1 | 1 | 1 | 0 | 1 | 1 | 1 | 1 | 99.6 |
| 229 | 0 | 1 | 0 | 1 | 1 | 1 | 1 | 1 | 1 | 1 | 1 | 0 | 1 | 1 | 1 | 1 | 99.1 |
| 230 | 1 | 1 | 0 | 1 | 1 | 1 | 1 | 1 | 1 | 1 | 1 | 0 | 1 | 1 | 1 | 1 | 99.6 |
| 231 | 0 | 0 | 0 | 1 | 1 | 1 | 1 | 1 | 1 | 1 | 0 | 1 | 1 | 1 | 1 | 1 | 90.9 |
| 232 | 1 | 0 | 0 | 1 | 1 | 1 | 1 | 1 | 1 | 1 | 0 | 1 | 1 | 1 | 1 | 1 | 99.6 |
| 233 | 0 | 1 | 0 | 1 | 1 | 1 | 1 | 1 | 1 | 1 | 0 | 1 | 1 | 1 | 1 | 1 | 99.1 |
| 234 | 1 | 1 | 0 | 1 | 1 | 1 | 1 | 1 | 1 | 1 | 0 | 1 | 1 | 1 | 1 | 1 | 99.6 |
| 235 | 1 | 0 | 0 | 1 | 1 | 1 | 1 | 1 | 1 | 0 | 1 | 1 | 1 | 1 | 1 | 1 | 92.8 |
| 236 | 0 | 1 | 0 | 1 | 1 | 1 | 1 | 1 | 1 | 0 | 1 | 1 | 1 | 1 | 1 | 1 | 99.2 |
| 237 | 1 | 1 | 0 | 1 | 1 | 1 | 1 | 1 | 1 | 0 | 1 | 1 | 1 | 1 | 1 | 1 | 99.6 |
| 238 | 0 | 1 | 0 | 1 | 1 | 1 | 1 | 1 | 0 | 1 | 1 | 1 | 1 | 1 | 1 | 1 | 94.1 |
| 239 | 1 | 1 | 0 | 1 | 1 | 1 | 1 | 1 | 0 | 1 | 1 | 1 | 1 | 1 | 1 | 1 | 99.6 |
| 240 | 0 | 1 | 0 | 1 | 1 | 1 | 0 | 1 | 1 | 1 | 1 | 1 | 1 | 1 | 1 | 1 | 95.0 |
| 241 | 1 | 1 | 0 | 1 | 1 | 1 | 0 | 1 | 1 | 1 | 1 | 1 | 1 | 1 | 1 | 1 | 99.6 |
| 242 | 0 | 1 | 0 | 0 | 1 | 1 | 1 | 1 | 1 | 1 | 1 | 1 | 1 | 1 | 1 | 1 | 95.9 |
| 243 | 1 | 1 | 0 | 0 | 1 | 1 | 1 | 1 | 1 | 1 | 1 | 1 | 1 | 1 | 1 | 1 | 99.6 |
| 244 | 0 | 0 | 1 | 0 | 1 | 1 | 1 | 1 | 1 | 1 | 1 | 1 | 1 | 1 | 1 | 1 | 98.4 |
| 245 | 1 | 0 | 1 | 0 | 1 | 1 | 1 | 1 | 1 | 1 | 1 | 1 | 1 | 1 | 1 | 1 | 99.6 |
| 246 | 0 | 1 | 1 | 0 | 1 | 1 | 1 | 1 | 1 | 1 | 1 | 1 | 1 | 1 | 1 | 1 | 99.2 |
| 247 | 1 | 1 | 1 | 0 | 1 | 1 | 1 | 1 | 1 | 1 | 1 | 1 | 1 | 1 | 1 | 1 | 99.6 |
| 248 | 0 | 0 | 0 | 1 | 1 | 1 | 1 | 1 | 1 | 1 | 1 | 1 | 1 | 1 | 1 | 1 | 96.8 |
| 249 | 1 | 0 | 0 | 1 | 1 | 1 | 1 | 1 | 1 | 1 | 1 | 1 | 1 | 1 | 1 | 1 | 99.6 |
| 250 | 0 | 1 | 0 | 1 | 1 | 1 | 1 | 1 | 1 | 1 | 1 | 1 | 1 | 1 | 1 | 1 | 99.2 |
| 251 | 1 | 1 | 0 | 1 | 1 | 1 | 1 | 1 | 1 | 1 | 1 | 1 | 1 | 1 | 1 | 1 | 99.6 |
| 252 | 0 | 0 | 1 | 1 | 1 | 1 | 1 | 1 | 1 | 1 | 1 | 1 | 1 | 1 | 1 | 1 | 98.4 |
| 253 | 1 | 0 | 1 | 1 | 1 | 1 | 1 | 1 | 1 | 1 | 1 | 1 | 1 | 1 | 1 | 1 | 99.6 |
| 254 | 0 | 1 | 1 | 1 | 1 | 1 | 1 | 1 | 1 | 1 | 1 | 1 | 1 | 1 | 1 | 1 | 99.2 |
| 255 | 1 | 1 | 1 | 1 | 1 | 1 | 1 | 1 | 1 | 1 | 1 | 1 | 1 | 1 | 1 | 1 | 99.6 |

FIG.23A

| gray scale level | length (ratio) of corresponding subframe | | | | | | | | | | | | | | | | sharing ratio (%) |
|---|---|---|---|---|---|---|---|---|---|---|---|---|---|---|---|---|---|
| | 1 | 2 | 4 | 8 | 10 | 10 | 10 | 12 | 12 | 14 | 17 | 21 | 25 | 30 | 36 | 43 | |
| 0 | 0 | 0 | 0 | 0 | 0 | 0 | 0 | 0 | 0 | 0 | 0 | 0 | 0 | 0 | 0 | 0 | - |
| 1 | 1 | 0 | 0 | 0 | 0 | 0 | 0 | 0 | 0 | 0 | 0 | 0 | 0 | 0 | 0 | 0 | 0.0 |
| 2 | 0 | 1 | 0 | 0 | 0 | 0 | 0 | 0 | 0 | 0 | 0 | 0 | 0 | 0 | 0 | 0 | 0.0 |
| 3 | 1 | 1 | 0 | 0 | 0 | 0 | 0 | 0 | 0 | 0 | 0 | 0 | 0 | 0 | 0 | 0 | 66.7 |
| 4 | 0 | 0 | 1 | 0 | 0 | 0 | 0 | 0 | 0 | 0 | 0 | 0 | 0 | 0 | 0 | 0 | 0.0 |
| 5 | 1 | 0 | 1 | 0 | 0 | 0 | 0 | 0 | 0 | 0 | 0 | 0 | 0 | 0 | 0 | 0 | 80.0 |
| 6 | 0 | 1 | 1 | 0 | 0 | 0 | 0 | 0 | 0 | 0 | 0 | 0 | 0 | 0 | 0 | 0 | 66.7 |
| 7 | 1 | 1 | 1 | 0 | 0 | 0 | 0 | 0 | 0 | 0 | 0 | 0 | 0 | 0 | 0 | 0 | 85.7 |
| 8 | 0 | 0 | 0 | 1 | 0 | 0 | 0 | 0 | 0 | 0 | 0 | 0 | 0 | 0 | 0 | 0 | 0.0 |
| 9 | 1 | 0 | 0 | 1 | 0 | 0 | 0 | 0 | 0 | 0 | 0 | 0 | 0 | 0 | 0 | 0 | 88.9 |
| 10 | 0 | 0 | 0 | 0 | 1 | 0 | 0 | 0 | 0 | 0 | 0 | 0 | 0 | 0 | 0 | 0 | 0.0 |
| 11 | 1 | 0 | 0 | 0 | 1 | 0 | 0 | 0 | 0 | 0 | 0 | 0 | 0 | 0 | 0 | 0 | 90.9 |
| 12 | 0 | 1 | 0 | 0 | 1 | 0 | 0 | 0 | 0 | 0 | 0 | 0 | 0 | 0 | 0 | 0 | 83.3 |
| 13 | 1 | 1 | 0 | 0 | 1 | 0 | 0 | 0 | 0 | 0 | 0 | 0 | 0 | 0 | 0 | 0 | 92.3 |
| 14 | 0 | 0 | 1 | 0 | 1 | 0 | 0 | 0 | 0 | 0 | 0 | 0 | 0 | 0 | 0 | 0 | 71.4 |
| 15 | 1 | 0 | 1 | 0 | 1 | 0 | 0 | 0 | 0 | 0 | 0 | 0 | 0 | 0 | 0 | 0 | 93.3 |
| 16 | 0 | 1 | 1 | 0 | 1 | 0 | 0 | 0 | 0 | 0 | 0 | 0 | 0 | 0 | 0 | 0 | 87.5 |
| 17 | 1 | 1 | 1 | 0 | 1 | 0 | 0 | 0 | 0 | 0 | 0 | 0 | 0 | 0 | 0 | 0 | 94.1 |
| 18 | 0 | 0 | 0 | 1 | 1 | 0 | 0 | 0 | 0 | 0 | 0 | 0 | 0 | 0 | 0 | 0 | 55.6 |
| 19 | 1 | 0 | 0 | 1 | 1 | 0 | 0 | 0 | 0 | 0 | 0 | 0 | 0 | 0 | 0 | 0 | 94.7 |
| 20 | 0 | 0 | 0 | 0 | 1 | 1 | 0 | 0 | 0 | 0 | 0 | 0 | 0 | 0 | 0 | 0 | 50.0 |
| 21 | 1 | 0 | 0 | 0 | 1 | 1 | 0 | 0 | 0 | 0 | 0 | 0 | 0 | 0 | 0 | 0 | 95.2 |
| 22 | 0 | 1 | 0 | 0 | 1 | 1 | 0 | 0 | 0 | 0 | 0 | 0 | 0 | 0 | 0 | 0 | 90.9 |
| 23 | 1 | 1 | 0 | 0 | 1 | 1 | 0 | 0 | 0 | 0 | 0 | 0 | 0 | 0 | 0 | 0 | 95.7 |
| 24 | 0 | 0 | 1 | 0 | 1 | 1 | 0 | 0 | 0 | 0 | 0 | 0 | 0 | 0 | 0 | 0 | 83.3 |
| 25 | 1 | 0 | 1 | 0 | 1 | 1 | 0 | 0 | 0 | 0 | 0 | 0 | 0 | 0 | 0 | 0 | 96.0 |
| 26 | 0 | 1 | 1 | 0 | 1 | 1 | 0 | 0 | 0 | 0 | 0 | 0 | 0 | 0 | 0 | 0 | 92.3 |
| 27 | 1 | 1 | 1 | 0 | 1 | 1 | 0 | 0 | 0 | 0 | 0 | 0 | 0 | 0 | 0 | 0 | 96.3 |
| 28 | 0 | 0 | 0 | 1 | 1 | 1 | 0 | 0 | 0 | 0 | 0 | 0 | 0 | 0 | 0 | 0 | 71.4 |
| 29 | 1 | 0 | 0 | 1 | 1 | 1 | 0 | 0 | 0 | 0 | 0 | 0 | 0 | 0 | 0 | 0 | 96.6 |
| 30 | 0 | 0 | 0 | 0 | 1 | 1 | 1 | 0 | 0 | 0 | 0 | 0 | 0 | 0 | 0 | 0 | 66.7 |
| 31 | 1 | 0 | 0 | 0 | 1 | 1 | 1 | 0 | 0 | 0 | 0 | 0 | 0 | 0 | 0 | 0 | 96.8 |
| 32 | 0 | 1 | 0 | 0 | 1 | 1 | 1 | 0 | 0 | 0 | 0 | 0 | 0 | 0 | 0 | 0 | 93.8 |
| 33 | 1 | 1 | 0 | 0 | 1 | 1 | 1 | 0 | 0 | 0 | 0 | 0 | 0 | 0 | 0 | 0 | 97.0 |
| 34 | 0 | 0 | 1 | 0 | 1 | 1 | 1 | 0 | 0 | 0 | 0 | 0 | 0 | 0 | 0 | 0 | 88.2 |
| 35 | 1 | 0 | 1 | 0 | 1 | 1 | 1 | 0 | 0 | 0 | 0 | 0 | 0 | 0 | 0 | 0 | 97.1 |
| 36 | 0 | 1 | 1 | 0 | 1 | 1 | 1 | 0 | 0 | 0 | 0 | 0 | 0 | 0 | 0 | 0 | 94.4 |
| 37 | 1 | 1 | 1 | 0 | 1 | 1 | 1 | 0 | 0 | 0 | 0 | 0 | 0 | 0 | 0 | 0 | 97.3 |
| 38 | 0 | 0 | 0 | 1 | 1 | 1 | 1 | 0 | 0 | 0 | 0 | 0 | 0 | 0 | 0 | 0 | 78.9 |
| 39 | 1 | 0 | 0 | 1 | 1 | 1 | 1 | 0 | 0 | 0 | 0 | 0 | 0 | 0 | 0 | 0 | 97.4 |
| 40 | 0 | 0 | 0 | 1 | 1 | 1 | 0 | 1 | 0 | 0 | 0 | 0 | 0 | 0 | 0 | 0 | 70.0 |
| 41 | 1 | 0 | 0 | 1 | 1 | 1 | 0 | 1 | 0 | 0 | 0 | 0 | 0 | 0 | 0 | 0 | 97.6 |
| 42 | 0 | 0 | 0 | 0 | 1 | 1 | 1 | 1 | 0 | 0 | 0 | 0 | 0 | 0 | 0 | 0 | 76.2 |
| 43 | 1 | 0 | 0 | 0 | 1 | 1 | 1 | 1 | 0 | 0 | 0 | 0 | 0 | 0 | 0 | 0 | 97.7 |
| 44 | 0 | 1 | 0 | 0 | 1 | 1 | 1 | 1 | 0 | 0 | 0 | 0 | 0 | 0 | 0 | 0 | 95.5 |
| 45 | 1 | 1 | 0 | 0 | 1 | 1 | 1 | 1 | 0 | 0 | 0 | 0 | 0 | 0 | 0 | 0 | 97.8 |
| 46 | 0 | 0 | 1 | 0 | 1 | 1 | 1 | 1 | 0 | 0 | 0 | 0 | 0 | 0 | 0 | 0 | 91.3 |
| 47 | 1 | 0 | 1 | 0 | 1 | 1 | 1 | 1 | 0 | 0 | 0 | 0 | 0 | 0 | 0 | 0 | 97.9 |
| 48 | 0 | 1 | 1 | 0 | 1 | 1 | 1 | 1 | 0 | 0 | 0 | 0 | 0 | 0 | 0 | 0 | 95.8 |
| 49 | 1 | 1 | 1 | 0 | 1 | 1 | 1 | 1 | 0 | 0 | 0 | 0 | 0 | 0 | 0 | 0 | 98.0 |
| 50 | 0 | 0 | 0 | 1 | 1 | 1 | 1 | 1 | 0 | 0 | 0 | 0 | 0 | 0 | 0 | 0 | 84.0 |
| 51 | 1 | 0 | 0 | 1 | 1 | 1 | 1 | 1 | 0 | 0 | 0 | 0 | 0 | 0 | 0 | 0 | 98.0 |
| 52 | 0 | 0 | 0 | 1 | 1 | 1 | 0 | 1 | 1 | 0 | 0 | 0 | 0 | 0 | 0 | 0 | 76.9 |
| 53 | 1 | 0 | 0 | 1 | 1 | 1 | 0 | 1 | 1 | 0 | 0 | 0 | 0 | 0 | 0 | 0 | 98.1 |
| 54 | 0 | 0 | 0 | 0 | 1 | 1 | 1 | 1 | 1 | 0 | 0 | 0 | 0 | 0 | 0 | 0 | 81.5 |
| 55 | 1 | 0 | 0 | 0 | 1 | 1 | 1 | 1 | 1 | 0 | 0 | 0 | 0 | 0 | 0 | 0 | 98.2 |
| 56 | 0 | 1 | 0 | 0 | 1 | 1 | 1 | 1 | 1 | 0 | 0 | 0 | 0 | 0 | 0 | 0 | 96.4 |
| 57 | 1 | 1 | 0 | 0 | 1 | 1 | 1 | 1 | 1 | 0 | 0 | 0 | 0 | 0 | 0 | 0 | 98.2 |
| 58 | 0 | 0 | 1 | 0 | 1 | 1 | 1 | 1 | 1 | 0 | 0 | 0 | 0 | 0 | 0 | 0 | 93.1 |
| 59 | 1 | 0 | 1 | 0 | 1 | 1 | 1 | 1 | 1 | 0 | 0 | 0 | 0 | 0 | 0 | 0 | 98.3 |
| 60 | 0 | 1 | 1 | 0 | 1 | 1 | 1 | 1 | 1 | 0 | 0 | 0 | 0 | 0 | 0 | 0 | 96.7 |
| 61 | 1 | 1 | 1 | 0 | 1 | 1 | 1 | 1 | 1 | 0 | 0 | 0 | 0 | 0 | 0 | 0 | 98.4 |
| 62 | 0 | 0 | 0 | 1 | 1 | 1 | 1 | 1 | 1 | 0 | 0 | 0 | 0 | 0 | 0 | 0 | 87.1 |
| 63 | 1 | 0 | 0 | 1 | 1 | 1 | 1 | 1 | 1 | 0 | 0 | 0 | 0 | 0 | 0 | 0 | 98.4 |
| 64 | 0 | 0 | 0 | 1 | 1 | 1 | 1 | 1 | 0 | 1 | 0 | 0 | 0 | 0 | 0 | 0 | 78.1 |
| 65 | 1 | 0 | 0 | 1 | 1 | 1 | 1 | 1 | 0 | 1 | 0 | 0 | 0 | 0 | 0 | 0 | 98.5 |

FIG.23B

| gray scale level | length (ratio) of corresponding subframe | | | | | | | | | | | | | | | | sharing ratio (%) |
|---|---|---|---|---|---|---|---|---|---|---|---|---|---|---|---|---|---|
| | 1 | 2 | 4 | 8 | 10 | 10 | 10 | 12 | 12 | 14 | 17 | 21 | 25 | 30 | 36 | 43 | |
| 66 | 0 | 0 | 0 | 1 | 1 | 1 | 0 | 1 | 1 | 1 | 0 | 0 | 0 | 0 | 0 | 0 | 81.8 |
| 67 | 1 | 0 | 0 | 1 | 1 | 1 | 0 | 1 | 1 | 1 | 0 | 0 | 0 | 0 | 0 | 0 | 98.5 |
| 68 | 0 | 0 | 0 | 0 | 1 | 1 | 1 | 1 | 1 | 1 | 0 | 0 | 0 | 0 | 0 | 0 | 85.3 |
| 69 | 1 | 0 | 0 | 0 | 1 | 1 | 1 | 1 | 1 | 1 | 0 | 0 | 0 | 0 | 0 | 0 | 98.6 |
| 70 | 0 | 1 | 0 | 0 | 1 | 1 | 1 | 1 | 1 | 1 | 0 | 0 | 0 | 0 | 0 | 0 | 97.1 |
| 71 | 1 | 1 | 0 | 0 | 1 | 1 | 1 | 1 | 1 | 1 | 0 | 0 | 0 | 0 | 0 | 0 | 98.6 |
| 72 | 0 | 0 | 1 | 0 | 1 | 1 | 1 | 1 | 1 | 1 | 0 | 0 | 0 | 0 | 0 | 0 | 94.4 |
| 73 | 1 | 0 | 1 | 0 | 1 | 1 | 1 | 1 | 1 | 1 | 0 | 0 | 0 | 0 | 0 | 0 | 98.6 |
| 74 | 0 | 1 | 1 | 0 | 1 | 1 | 1 | 1 | 1 | 1 | 0 | 0 | 0 | 0 | 0 | 0 | 97.3 |
| 75 | 1 | 1 | 1 | 0 | 1 | 1 | 1 | 1 | 1 | 1 | 0 | 0 | 0 | 0 | 0 | 0 | 98.7 |
| 76 | 0 | 0 | 0 | 1 | 1 | 1 | 1 | 1 | 1 | 1 | 0 | 0 | 0 | 0 | 0 | 0 | 89.5 |
| 77 | 1 | 0 | 0 | 1 | 1 | 1 | 1 | 1 | 1 | 1 | 0 | 0 | 0 | 0 | 0 | 0 | 98.7 |
| 78 | 1 | 1 | 1 | 0 | 1 | 1 | 1 | 1 | 1 | 0 | 1 | 0 | 0 | 0 | 0 | 0 | 70.5 |
| 79 | 0 | 0 | 0 | 1 | 1 | 1 | 1 | 1 | 1 | 0 | 1 | 0 | 0 | 0 | 0 | 0 | 89.9 |
| 80 | 1 | 0 | 0 | 1 | 1 | 1 | 1 | 1 | 1 | 0 | 1 | 0 | 0 | 0 | 0 | 0 | 98.8 |
| 81 | 0 | 0 | 0 | 1 | 1 | 1 | 1 | 1 | 0 | 1 | 1 | 0 | 0 | 0 | 0 | 0 | 82.7 |
| 82 | 1 | 0 | 0 | 1 | 1 | 1 | 1 | 1 | 0 | 1 | 1 | 0 | 0 | 0 | 0 | 0 | 98.8 |
| 83 | 0 | 0 | 0 | 1 | 1 | 1 | 0 | 1 | 1 | 1 | 1 | 0 | 0 | 0 | 0 | 0 | 85.5 |
| 84 | 1 | 0 | 0 | 1 | 1 | 1 | 0 | 1 | 1 | 1 | 1 | 0 | 0 | 0 | 0 | 0 | 98.8 |
| 85 | 0 | 0 | 0 | 0 | 1 | 1 | 1 | 1 | 1 | 1 | 1 | 0 | 0 | 0 | 0 | 0 | 88.2 |
| 86 | 1 | 0 | 0 | 0 | 1 | 1 | 1 | 1 | 1 | 1 | 1 | 0 | 0 | 0 | 0 | 0 | 98.8 |
| 87 | 0 | 1 | 0 | 0 | 1 | 1 | 1 | 1 | 1 | 1 | 1 | 0 | 0 | 0 | 0 | 0 | 97.7 |
| 88 | 1 | 1 | 0 | 0 | 1 | 1 | 1 | 1 | 1 | 1 | 1 | 0 | 0 | 0 | 0 | 0 | 98.9 |
| 89 | 0 | 0 | 1 | 0 | 1 | 1 | 1 | 1 | 1 | 1 | 1 | 0 | 0 | 0 | 0 | 0 | 95.5 |
| 90 | 1 | 0 | 1 | 0 | 1 | 1 | 1 | 1 | 1 | 1 | 1 | 0 | 0 | 0 | 0 | 0 | 98.9 |
| 91 | 0 | 1 | 1 | 0 | 1 | 1 | 1 | 1 | 1 | 1 | 1 | 0 | 0 | 0 | 0 | 0 | 97.8 |
| 92 | 1 | 1 | 1 | 0 | 1 | 1 | 1 | 1 | 1 | 1 | 1 | 0 | 0 | 0 | 0 | 0 | 98.9 |
| 93 | 0 | 0 | 0 | 1 | 1 | 1 | 1 | 1 | 1 | 1 | 1 | 0 | 0 | 0 | 0 | 0 | 91.4 |
| 94 | 1 | 0 | 0 | 1 | 1 | 1 | 1 | 1 | 1 | 1 | 1 | 0 | 0 | 0 | 0 | 0 | 98.9 |
| 95 | 0 | 1 | 1 | 0 | 1 | 1 | 1 | 1 | 1 | 1 | 0 | 1 | 0 | 0 | 0 | 0 | 71.6 |
| 96 | 1 | 1 | 1 | 0 | 1 | 1 | 1 | 1 | 1 | 1 | 0 | 1 | 0 | 0 | 0 | 0 | 99.0 |
| 97 | 0 | 0 | 0 | 1 | 1 | 1 | 1 | 1 | 1 | 1 | 0 | 1 | 0 | 0 | 0 | 0 | 91.8 |
| 98 | 1 | 0 | 0 | 1 | 1 | 1 | 1 | 1 | 1 | 1 | 0 | 1 | 0 | 0 | 0 | 0 | 99.0 |
| 99 | 1 | 1 | 1 | 0 | 1 | 1 | 1 | 1 | 1 | 0 | 1 | 1 | 0 | 0 | 0 | 0 | 76.8 |
| 100 | 0 | 0 | 0 | 1 | 1 | 1 | 1 | 1 | 1 | 0 | 1 | 1 | 0 | 0 | 0 | 0 | 92.0 |
| 101 | 1 | 0 | 0 | 1 | 1 | 1 | 1 | 1 | 1 | 0 | 1 | 1 | 0 | 0 | 0 | 0 | 99.0 |
| 102 | 0 | 0 | 0 | 1 | 1 | 1 | 1 | 1 | 0 | 1 | 1 | 1 | 0 | 0 | 0 | 0 | 86.3 |
| 103 | 1 | 0 | 0 | 1 | 1 | 1 | 1 | 1 | 0 | 1 | 1 | 1 | 0 | 0 | 0 | 0 | 99.0 |
| 104 | 0 | 0 | 0 | 1 | 1 | 1 | 0 | 1 | 1 | 1 | 1 | 1 | 0 | 0 | 0 | 0 | 88.5 |
| 105 | 1 | 0 | 0 | 1 | 1 | 1 | 0 | 1 | 1 | 1 | 1 | 1 | 0 | 0 | 0 | 0 | 99.0 |
| 106 | 0 | 0 | 0 | 0 | 1 | 1 | 1 | 1 | 1 | 1 | 1 | 1 | 0 | 0 | 0 | 0 | 90.6 |
| 107 | 1 | 0 | 0 | 0 | 1 | 1 | 1 | 1 | 1 | 1 | 1 | 1 | 0 | 0 | 0 | 0 | 99.1 |
| 108 | 0 | 1 | 0 | 0 | 1 | 1 | 1 | 1 | 1 | 1 | 1 | 1 | 0 | 0 | 0 | 0 | 98.1 |
| 109 | 1 | 1 | 0 | 0 | 1 | 1 | 1 | 1 | 1 | 1 | 1 | 1 | 0 | 0 | 0 | 0 | 99.1 |
| 110 | 0 | 0 | 1 | 0 | 1 | 1 | 1 | 1 | 1 | 1 | 1 | 1 | 0 | 0 | 0 | 0 | 96.4 |
| 111 | 1 | 0 | 1 | 0 | 1 | 1 | 1 | 1 | 1 | 1 | 1 | 1 | 0 | 0 | 0 | 0 | 99.1 |
| 112 | 0 | 1 | 1 | 0 | 1 | 1 | 1 | 1 | 1 | 1 | 1 | 1 | 0 | 0 | 0 | 0 | 98.2 |
| 113 | 1 | 1 | 1 | 0 | 1 | 1 | 1 | 1 | 1 | 1 | 1 | 1 | 0 | 0 | 0 | 0 | 99.1 |
| 114 | 0 | 0 | 0 | 1 | 1 | 1 | 1 | 1 | 1 | 1 | 1 | 1 | 0 | 0 | 0 | 0 | 93.0 |
| 115 | 1 | 0 | 0 | 1 | 1 | 1 | 1 | 1 | 1 | 1 | 1 | 1 | 0 | 0 | 0 | 0 | 99.1 |
| 116 | 0 | 1 | 1 | 0 | 1 | 1 | 1 | 1 | 1 | 1 | 1 | 0 | 1 | 0 | 0 | 0 | 73.3 |
| 117 | 1 | 1 | 1 | 0 | 1 | 1 | 1 | 1 | 1 | 1 | 1 | 0 | 1 | 0 | 0 | 0 | 99.1 |
| 118 | 0 | 0 | 0 | 1 | 1 | 1 | 1 | 1 | 1 | 1 | 1 | 0 | 1 | 0 | 0 | 0 | 93.2 |
| 119 | 1 | 0 | 0 | 1 | 1 | 1 | 1 | 1 | 1 | 1 | 1 | 0 | 1 | 0 | 0 | 0 | 99.2 |
| 120 | 0 | 1 | 1 | 0 | 1 | 1 | 1 | 1 | 1 | 1 | 0 | 1 | 1 | 0 | 0 | 0 | 77.5 |
| 121 | 1 | 1 | 1 | 0 | 1 | 1 | 1 | 1 | 1 | 1 | 0 | 1 | 1 | 0 | 0 | 0 | 99.2 |
| 122 | 0 | 0 | 0 | 1 | 1 | 1 | 1 | 1 | 1 | 1 | 0 | 1 | 1 | 0 | 0 | 0 | 93.4 |
| 123 | 1 | 0 | 0 | 1 | 1 | 1 | 1 | 1 | 1 | 1 | 0 | 1 | 1 | 0 | 0 | 0 | 99.2 |
| 124 | 1 | 1 | 1 | 0 | 1 | 1 | 1 | 1 | 1 | 0 | 1 | 1 | 1 | 0 | 0 | 0 | 81.5 |
| 125 | 0 | 0 | 0 | 1 | 1 | 1 | 1 | 1 | 1 | 0 | 1 | 1 | 1 | 0 | 0 | 0 | 93.6 |
| 126 | 1 | 0 | 0 | 1 | 1 | 1 | 1 | 1 | 1 | 0 | 1 | 1 | 1 | 0 | 0 | 0 | 99.2 |
| 127 | 0 | 0 | 0 | 1 | 1 | 1 | 1 | 1 | 0 | 1 | 1 | 1 | 1 | 0 | 0 | 0 | 89.0 |

FIG.23C

| gray scale level | length (ratio) of corresponding subframe | | | | | | | | | | | | | | | | sharing ratio (%) |
|---|---|---|---|---|---|---|---|---|---|---|---|---|---|---|---|---|---|
| | 1 | 2 | 4 | 8 | 10 | 10 | 10 | 12 | 12 | 14 | 17 | 21 | 25 | 30 | 36 | 43 | |
| 128 | 1 | 0 | 0 | 1 | 1 | 1 | 1 | 1 | 0 | 1 | 1 | 1 | 1 | 0 | 0 | 0 | 99.2 |
| 129 | 0 | 0 | 0 | 1 | 1 | 1 | 0 | 1 | 1 | 1 | 1 | 1 | 1 | 0 | 0 | 0 | 90.7 |
| 130 | 1 | 0 | 0 | 1 | 1 | 1 | 0 | 1 | 1 | 1 | 1 | 1 | 1 | 0 | 0 | 0 | 99.2 |
| 131 | 0 | 0 | 0 | 0 | 1 | 1 | 1 | 1 | 1 | 1 | 1 | 1 | 1 | 0 | 0 | 0 | 92.4 |
| 132 | 1 | 0 | 0 | 0 | 1 | 1 | 1 | 1 | 1 | 1 | 1 | 1 | 1 | 0 | 0 | 0 | 99.2 |
| 133 | 0 | 1 | 0 | 0 | 1 | 1 | 1 | 1 | 1 | 1 | 1 | 1 | 1 | 0 | 0 | 0 | 98.5 |
| 134 | 1 | 1 | 0 | 0 | 1 | 1 | 1 | 1 | 1 | 1 | 1 | 1 | 1 | 0 | 0 | 0 | 99.3 |
| 135 | 0 | 0 | 1 | 0 | 1 | 1 | 1 | 1 | 1 | 1 | 1 | 1 | 1 | 0 | 0 | 0 | 97.0 |
| 136 | 1 | 0 | 1 | 0 | 1 | 1 | 1 | 1 | 1 | 1 | 1 | 1 | 1 | 0 | 0 | 0 | 99.3 |
| 137 | 0 | 1 | 1 | 0 | 1 | 1 | 1 | 1 | 1 | 1 | 1 | 1 | 1 | 0 | 0 | 0 | 98.5 |
| 138 | 1 | 1 | 1 | 0 | 1 | 1 | 1 | 1 | 1 | 1 | 1 | 1 | 1 | 0 | 0 | 0 | 99.3 |
| 139 | 0 | 0 | 0 | 1 | 1 | 1 | 1 | 1 | 1 | 1 | 1 | 1 | 1 | 0 | 0 | 0 | 94.2 |
| 140 | 1 | 0 | 0 | 1 | 1 | 1 | 1 | 1 | 1 | 1 | 1 | 1 | 1 | 0 | 0 | 0 | 99.3 |
| 141 | 1 | 0 | 1 | 0 | 1 | 1 | 1 | 1 | 1 | 1 | 1 | 1 | 0 | 1 | 0 | 0 | 75.9 |
| 142 | 0 | 1 | 1 | 0 | 1 | 1 | 1 | 1 | 1 | 1 | 1 | 1 | 0 | 1 | 0 | 0 | 98.6 |
| 143 | 1 | 1 | 1 | 0 | 1 | 1 | 1 | 1 | 1 | 1 | 1 | 1 | 0 | 1 | 0 | 0 | 99.3 |
| 144 | 0 | 0 | 0 | 1 | 1 | 1 | 1 | 1 | 1 | 1 | 1 | 1 | 0 | 1 | 0 | 0 | 94.4 |
| 145 | 1 | 0 | 0 | 1 | 1 | 1 | 1 | 1 | 1 | 1 | 1 | 1 | 0 | 1 | 0 | 0 | 99.3 |
| 146 | 0 | 1 | 1 | 0 | 1 | 1 | 1 | 1 | 1 | 1 | 1 | 0 | 1 | 1 | 0 | 0 | 78.8 |
| 147 | 1 | 1 | 1 | 0 | 1 | 1 | 1 | 1 | 1 | 1 | 1 | 0 | 1 | 1 | 0 | 0 | 99.3 |
| 148 | 0 | 0 | 0 | 1 | 1 | 1 | 1 | 1 | 1 | 1 | 1 | 0 | 1 | 1 | 0 | 0 | 94.6 |
| 149 | 1 | 0 | 0 | 1 | 1 | 1 | 1 | 1 | 1 | 1 | 1 | 0 | 1 | 1 | 0 | 0 | 99.3 |
| 150 | 0 | 1 | 1 | 0 | 1 | 1 | 1 | 1 | 1 | 1 | 0 | 1 | 1 | 1 | 0 | 0 | 82.0 |
| 151 | 1 | 1 | 1 | 0 | 1 | 1 | 1 | 1 | 1 | 1 | 0 | 1 | 1 | 1 | 0 | 0 | 99.3 |
| 152 | 0 | 0 | 0 | 1 | 1 | 1 | 1 | 1 | 1 | 1 | 0 | 1 | 1 | 1 | 0 | 0 | 94.7 |
| 153 | 1 | 0 | 0 | 1 | 1 | 1 | 1 | 1 | 1 | 1 | 0 | 1 | 1 | 1 | 0 | 0 | 99.3 |
| 154 | 1 | 1 | 1 | 0 | 1 | 1 | 1 | 1 | 1 | 0 | 1 | 1 | 1 | 1 | 0 | 0 | 85.1 |
| 155 | 0 | 0 | 0 | 1 | 1 | 1 | 1 | 1 | 1 | 0 | 1 | 1 | 1 | 1 | 0 | 0 | 94.8 |
| 156 | 1 | 0 | 0 | 1 | 1 | 1 | 1 | 1 | 1 | 0 | 1 | 1 | 1 | 1 | 0 | 0 | 99.4 |
| 157 | 0 | 0 | 0 | 1 | 1 | 1 | 1 | 1 | 0 | 1 | 1 | 1 | 1 | 1 | 0 | 0 | 91.1 |
| 158 | 1 | 0 | 0 | 1 | 1 | 1 | 1 | 1 | 0 | 1 | 1 | 1 | 1 | 1 | 0 | 0 | 99.4 |
| 159 | 0 | 0 | 0 | 1 | 1 | 1 | 0 | 1 | 1 | 1 | 1 | 1 | 1 | 1 | 0 | 0 | 92.5 |
| 160 | 1 | 0 | 0 | 1 | 1 | 1 | 0 | 1 | 1 | 1 | 1 | 1 | 1 | 1 | 0 | 0 | 99.4 |
| 161 | 0 | 0 | 0 | 0 | 1 | 1 | 1 | 1 | 1 | 1 | 1 | 1 | 1 | 1 | 0 | 0 | 93.8 |
| 162 | 1 | 0 | 0 | 0 | 1 | 1 | 1 | 1 | 1 | 1 | 1 | 1 | 1 | 1 | 0 | 0 | 99.4 |
| 163 | 0 | 1 | 0 | 0 | 1 | 1 | 1 | 1 | 1 | 1 | 1 | 1 | 1 | 1 | 0 | 0 | 98.8 |
| 164 | 1 | 1 | 0 | 0 | 1 | 1 | 1 | 1 | 1 | 1 | 1 | 1 | 1 | 1 | 0 | 0 | 99.4 |
| 165 | 0 | 0 | 1 | 0 | 1 | 1 | 1 | 1 | 1 | 1 | 1 | 1 | 1 | 1 | 0 | 0 | 97.6 |
| 166 | 1 | 0 | 1 | 0 | 1 | 1 | 1 | 1 | 1 | 1 | 1 | 1 | 1 | 1 | 0 | 0 | 99.4 |
| 167 | 0 | 1 | 1 | 0 | 1 | 1 | 1 | 1 | 1 | 1 | 1 | 1 | 1 | 1 | 0 | 0 | 98.8 |
| 168 | 1 | 1 | 1 | 0 | 1 | 1 | 1 | 1 | 1 | 1 | 1 | 1 | 1 | 1 | 0 | 0 | 99.4 |
| 169 | 0 | 0 | 0 | 1 | 1 | 1 | 1 | 1 | 1 | 1 | 1 | 1 | 1 | 1 | 0 | 0 | 95.3 |
| 170 | 1 | 0 | 0 | 1 | 1 | 1 | 1 | 1 | 1 | 1 | 1 | 1 | 1 | 1 | 0 | 0 | 99.4 |
| 171 | 0 | 0 | 1 | 0 | 1 | 1 | 1 | 1 | 1 | 1 | 1 | 1 | 1 | 0 | 1 | 0 | 76.6 |
| 172 | 1 | 0 | 1 | 0 | 1 | 1 | 1 | 1 | 1 | 1 | 1 | 1 | 1 | 0 | 1 | 0 | 99.4 |
| 173 | 0 | 1 | 1 | 0 | 1 | 1 | 1 | 1 | 1 | 1 | 1 | 1 | 1 | 0 | 1 | 0 | 98.8 |
| 174 | 1 | 1 | 1 | 0 | 1 | 1 | 1 | 1 | 1 | 1 | 1 | 1 | 1 | 0 | 1 | 0 | 99.4 |
| 175 | 0 | 0 | 0 | 1 | 1 | 1 | 1 | 1 | 1 | 1 | 1 | 1 | 1 | 0 | 1 | 0 | 95.4 |
| 176 | 1 | 0 | 0 | 1 | 1 | 1 | 1 | 1 | 1 | 1 | 1 | 1 | 1 | 0 | 1 | 0 | 99.4 |
| 177 | 1 | 0 | 1 | 0 | 1 | 1 | 1 | 1 | 1 | 1 | 1 | 1 | 0 | 1 | 1 | 0 | 80.8 |
| 178 | 0 | 1 | 1 | 0 | 1 | 1 | 1 | 1 | 1 | 1 | 1 | 1 | 0 | 1 | 1 | 0 | 98.9 |
| 179 | 1 | 1 | 1 | 0 | 1 | 1 | 1 | 1 | 1 | 1 | 1 | 1 | 0 | 1 | 1 | 0 | 99.4 |
| 180 | 0 | 0 | 0 | 1 | 1 | 1 | 1 | 1 | 1 | 1 | 1 | 1 | 0 | 1 | 1 | 0 | 95.6 |
| 181 | 1 | 0 | 0 | 1 | 1 | 1 | 1 | 1 | 1 | 1 | 1 | 1 | 0 | 1 | 1 | 0 | 99.4 |
| 182 | 0 | 1 | 1 | 0 | 1 | 1 | 1 | 1 | 1 | 1 | 1 | 0 | 1 | 1 | 1 | 0 | 83.0 |
| 183 | 1 | 1 | 1 | 0 | 1 | 1 | 1 | 1 | 1 | 1 | 1 | 0 | 1 | 1 | 1 | 0 | 99.5 |
| 184 | 0 | 0 | 0 | 1 | 1 | 1 | 1 | 1 | 1 | 1 | 1 | 0 | 1 | 1 | 1 | 0 | 95.7 |
| 185 | 1 | 0 | 0 | 1 | 1 | 1 | 1 | 1 | 1 | 1 | 1 | 0 | 1 | 1 | 1 | 0 | 99.5 |
| 186 | 0 | 1 | 1 | 0 | 1 | 1 | 1 | 1 | 1 | 1 | 0 | 1 | 1 | 1 | 1 | 0 | 85.5 |
| 187 | 1 | 1 | 1 | 0 | 1 | 1 | 1 | 1 | 1 | 1 | 0 | 1 | 1 | 1 | 1 | 0 | 99.5 |
| 188 | 0 | 0 | 0 | 1 | 1 | 1 | 1 | 1 | 1 | 1 | 0 | 1 | 1 | 1 | 1 | 0 | 95.7 |
| 189 | 1 | 0 | 0 | 1 | 1 | 1 | 1 | 1 | 1 | 1 | 0 | 1 | 1 | 1 | 1 | 0 | 99.5 |
| 190 | 1 | 1 | 1 | 0 | 1 | 1 | 1 | 1 | 1 | 0 | 1 | 1 | 1 | 1 | 1 | 0 | 87.9 |
| 191 | 0 | 0 | 0 | 1 | 1 | 1 | 1 | 1 | 1 | 0 | 1 | 1 | 1 | 1 | 1 | 0 | 95.8 |
| 192 | 1 | 0 | 0 | 1 | 1 | 1 | 1 | 1 | 1 | 0 | 1 | 1 | 1 | 1 | 1 | 0 | 99.5 |
| 193 | 0 | 0 | 0 | 1 | 1 | 1 | 1 | 1 | 0 | 1 | 1 | 1 | 1 | 1 | 1 | 0 | 92.7 |

FIG.23D

| gray scale level | length (ratio) of corresponding subframe | | | | | | | | | | | | | | | | sharing ratio (%) |
|---|---|---|---|---|---|---|---|---|---|---|---|---|---|---|---|---|---|
| | 1 | 2 | 4 | 8 | 10 | 10 | 10 | 12 | 12 | 14 | 17 | 21 | 25 | 30 | 36 | 43 | |
| 194 | 1 | 0 | 0 | 1 | 1 | 1 | 1 | 1 | 0 | 1 | 1 | 1 | 1 | 1 | 1 | 0 | 99.5 |
| 195 | 0 | 0 | 0 | 1 | 1 | 1 | 0 | 1 | 1 | 1 | 1 | 1 | 1 | 1 | 1 | 0 | 93.8 |
| 196 | 1 | 0 | 0 | 1 | 1 | 1 | 0 | 1 | 1 | 1 | 1 | 1 | 1 | 1 | 1 | 0 | 99.5 |
| 197 | 0 | 0 | 0 | 0 | 1 | 1 | 1 | 1 | 1 | 1 | 1 | 1 | 1 | 1 | 1 | 0 | 94.9 |
| 198 | 1 | 0 | 0 | 0 | 1 | 1 | 1 | 1 | 1 | 1 | 1 | 1 | 1 | 1 | 1 | 0 | 99.5 |
| 199 | 0 | 1 | 0 | 0 | 1 | 1 | 1 | 1 | 1 | 1 | 1 | 1 | 1 | 1 | 1 | 0 | 99.0 |
| 200 | 1 | 1 | 0 | 0 | 1 | 1 | 1 | 1 | 1 | 1 | 1 | 1 | 1 | 1 | 1 | 0 | 99.5 |
| 201 | 0 | 0 | 1 | 0 | 1 | 1 | 1 | 1 | 1 | 1 | 1 | 1 | 1 | 1 | 1 | 0 | 98.0 |
| 202 | 1 | 0 | 1 | 0 | 1 | 1 | 1 | 1 | 1 | 1 | 1 | 1 | 1 | 1 | 1 | 0 | 99.5 |
| 203 | 0 | 1 | 1 | 0 | 1 | 1 | 1 | 1 | 1 | 1 | 1 | 1 | 1 | 1 | 1 | 0 | 99.0 |
| 204 | 1 | 1 | 1 | 0 | 1 | 1 | 1 | 1 | 1 | 1 | 1 | 1 | 1 | 1 | 1 | 0 | 99.5 |
| 205 | 0 | 0 | 0 | 1 | 1 | 1 | 1 | 1 | 1 | 1 | 1 | 1 | 1 | 1 | 1 | 0 | 96.1 |
| 206 | 1 | 0 | 0 | 1 | 1 | 1 | 1 | 1 | 1 | 1 | 1 | 1 | 1 | 1 | 1 | 0 | 99.5 |
| 207 | 1 | 1 | 0 | 0 | 1 | 1 | 1 | 1 | 1 | 1 | 1 | 1 | 1 | 1 | 0 | 1 | 78.3 |
| 208 | 0 | 0 | 1 | 0 | 1 | 1 | 1 | 1 | 1 | 1 | 1 | 1 | 1 | 1 | 0 | 1 | 98.1 |
| 209 | 1 | 0 | 1 | 0 | 1 | 1 | 1 | 1 | 1 | 1 | 1 | 1 | 1 | 1 | 0 | 1 | 99.5 |
| 210 | 0 | 1 | 1 | 0 | 1 | 1 | 1 | 1 | 1 | 1 | 1 | 1 | 1 | 1 | 0 | 1 | 99.0 |
| 211 | 1 | 1 | 1 | 0 | 1 | 1 | 1 | 1 | 1 | 1 | 1 | 1 | 1 | 1 | 0 | 1 | 99.5 |
| 212 | 0 | 0 | 0 | 1 | 1 | 1 | 1 | 1 | 1 | 1 | 1 | 1 | 1 | 1 | 0 | 1 | 96.2 |
| 213 | 1 | 0 | 0 | 1 | 1 | 1 | 1 | 1 | 1 | 1 | 1 | 1 | 1 | 1 | 0 | 1 | 99.5 |
| 214 | 0 | 0 | 1 | 0 | 1 | 1 | 1 | 1 | 1 | 1 | 1 | 1 | 1 | 0 | 1 | 1 | 81.3 |
| 215 | 1 | 0 | 1 | 0 | 1 | 1 | 1 | 1 | 1 | 1 | 1 | 1 | 1 | 0 | 1 | 1 | 99.5 |
| 216 | 0 | 1 | 1 | 0 | 1 | 1 | 1 | 1 | 1 | 1 | 1 | 1 | 1 | 0 | 1 | 1 | 99.1 |
| 217 | 1 | 1 | 1 | 0 | 1 | 1 | 1 | 1 | 1 | 1 | 1 | 1 | 1 | 0 | 1 | 1 | 99.5 |
| 218 | 0 | 0 | 0 | 1 | 1 | 1 | 1 | 1 | 1 | 1 | 1 | 1 | 1 | 0 | 1 | 1 | 96.3 |
| 219 | 1 | 0 | 0 | 1 | 1 | 1 | 1 | 1 | 1 | 1 | 1 | 1 | 1 | 0 | 1 | 1 | 99.5 |
| 220 | 1 | 0 | 1 | 0 | 1 | 1 | 1 | 1 | 1 | 1 | 1 | 1 | 0 | 1 | 1 | 1 | 84.5 |
| 221 | 0 | 1 | 1 | 0 | 1 | 1 | 1 | 1 | 1 | 1 | 1 | 1 | 0 | 1 | 1 | 1 | 99.1 |
| 222 | 1 | 1 | 1 | 0 | 1 | 1 | 1 | 1 | 1 | 1 | 1 | 1 | 0 | 1 | 1 | 1 | 99.5 |
| 223 | 0 | 0 | 0 | 1 | 1 | 1 | 1 | 1 | 1 | 1 | 1 | 1 | 0 | 1 | 1 | 1 | 96.4 |
| 224 | 1 | 0 | 0 | 1 | 1 | 1 | 1 | 1 | 1 | 1 | 1 | 1 | 0 | 1 | 1 | 1 | 99.6 |
| 225 | 0 | 1 | 1 | 0 | 1 | 1 | 1 | 1 | 1 | 1 | 1 | 0 | 1 | 1 | 1 | 1 | 86.2 |
| 226 | 1 | 1 | 1 | 0 | 1 | 1 | 1 | 1 | 1 | 1 | 1 | 0 | 1 | 1 | 1 | 1 | 99.6 |
| 227 | 0 | 0 | 0 | 1 | 1 | 1 | 1 | 1 | 1 | 1 | 1 | 0 | 1 | 1 | 1 | 1 | 96.5 |
| 228 | 1 | 0 | 0 | 1 | 1 | 1 | 1 | 1 | 1 | 1 | 1 | 0 | 1 | 1 | 1 | 1 | 99.6 |
| 229 | 0 | 1 | 1 | 0 | 1 | 1 | 1 | 1 | 1 | 1 | 0 | 1 | 1 | 1 | 1 | 1 | 88.2 |
| 230 | 1 | 1 | 1 | 0 | 1 | 1 | 1 | 1 | 1 | 1 | 0 | 1 | 1 | 1 | 1 | 1 | 99.6 |
| 231 | 0 | 0 | 0 | 1 | 1 | 1 | 1 | 1 | 1 | 1 | 0 | 1 | 1 | 1 | 1 | 1 | 96.5 |
| 232 | 1 | 0 | 0 | 1 | 1 | 1 | 1 | 1 | 1 | 1 | 0 | 1 | 1 | 1 | 1 | 1 | 99.6 |
| 233 | 1 | 1 | 1 | 0 | 1 | 1 | 1 | 1 | 1 | 0 | 1 | 1 | 1 | 1 | 1 | 1 | 90.1 |
| 234 | 0 | 0 | 0 | 1 | 1 | 1 | 1 | 1 | 1 | 0 | 1 | 1 | 1 | 1 | 1 | 1 | 96.6 |
| 235 | 1 | 0 | 0 | 1 | 1 | 1 | 1 | 1 | 1 | 0 | 1 | 1 | 1 | 1 | 1 | 1 | 99.6 |
| 236 | 0 | 0 | 0 | 1 | 1 | 1 | 1 | 1 | 0 | 1 | 1 | 1 | 1 | 1 | 1 | 1 | 94.1 |
| 237 | 1 | 0 | 0 | 1 | 1 | 1 | 1 | 1 | 0 | 1 | 1 | 1 | 1 | 1 | 1 | 1 | 99.6 |
| 238 | 0 | 0 | 0 | 1 | 1 | 1 | 0 | 1 | 1 | 1 | 1 | 1 | 1 | 1 | 1 | 1 | 95.0 |
| 239 | 1 | 0 | 0 | 1 | 1 | 1 | 0 | 1 | 1 | 1 | 1 | 1 | 1 | 1 | 1 | 1 | 99.6 |
| 240 | 0 | 0 | 0 | 0 | 1 | 1 | 1 | 1 | 1 | 1 | 1 | 1 | 1 | 1 | 1 | 1 | 95.8 |
| 241 | 1 | 0 | 0 | 0 | 1 | 1 | 1 | 1 | 1 | 1 | 1 | 1 | 1 | 1 | 1 | 1 | 99.6 |
| 242 | 0 | 1 | 0 | 0 | 1 | 1 | 1 | 1 | 1 | 1 | 1 | 1 | 1 | 1 | 1 | 1 | 99.2 |
| 243 | 1 | 1 | 0 | 0 | 1 | 1 | 1 | 1 | 1 | 1 | 1 | 1 | 1 | 1 | 1 | 1 | 99.6 |
| 244 | 0 | 0 | 1 | 0 | 1 | 1 | 1 | 1 | 1 | 1 | 1 | 1 | 1 | 1 | 1 | 1 | 98.4 |
| 245 | 1 | 0 | 1 | 0 | 1 | 1 | 1 | 1 | 1 | 1 | 1 | 1 | 1 | 1 | 1 | 1 | 99.6 |
| 246 | 0 | 1 | 1 | 0 | 1 | 1 | 1 | 1 | 1 | 1 | 1 | 1 | 1 | 1 | 1 | 1 | 99.2 |
| 247 | 1 | 1 | 1 | 0 | 1 | 1 | 1 | 1 | 1 | 1 | 1 | 1 | 1 | 1 | 1 | 1 | 99.6 |
| 248 | 0 | 0 | 0 | 1 | 1 | 1 | 1 | 1 | 1 | 1 | 1 | 1 | 1 | 1 | 1 | 1 | 96.8 |
| 249 | 1 | 0 | 0 | 1 | 1 | 1 | 1 | 1 | 1 | 1 | 1 | 1 | 1 | 1 | 1 | 1 | 99.6 |
| 250 | 0 | 1 | 0 | 1 | 1 | 1 | 1 | 1 | 1 | 1 | 1 | 1 | 1 | 1 | 1 | 1 | 99.2 |
| 251 | 1 | 1 | 0 | 1 | 1 | 1 | 1 | 1 | 1 | 1 | 1 | 1 | 1 | 1 | 1 | 1 | 99.6 |
| 252 | 0 | 0 | 1 | 1 | 1 | 1 | 1 | 1 | 1 | 1 | 1 | 1 | 1 | 1 | 1 | 1 | 98.4 |
| 253 | 1 | 0 | 1 | 1 | 1 | 1 | 1 | 1 | 1 | 1 | 1 | 1 | 1 | 1 | 1 | 1 | 99.6 |
| 254 | 0 | 1 | 1 | 1 | 1 | 1 | 1 | 1 | 1 | 1 | 1 | 1 | 1 | 1 | 1 | 1 | 99.2 |
| 255 | 1 | 1 | 1 | 1 | 1 | 1 | 1 | 1 | 1 | 1 | 1 | 1 | 1 | 1 | 1 | 1 | 99.6 |

DISPLAY DEVICE AND METHOD FOR DRIVING THE SAME

TECHNICAL FIELD

The present invention relates to a display device for performing display by a time gray scale method and a driving method of the display device.

BACKGROUND ART

As a driving method of a light emitting device that is one of display devices, there is known a time gray scale method in which a light emission period of a pixel in one frame period is controlled with a binary voltage of a digital video signal to display a gray scale. Electroluminescent materials are more suitable for a time gray scale method than liquid crystals and the like since the response rate is generally faster. Specifically, when performing display by the time gray scale method, one frame period is divided into a plurality of subframe periods. Then, a pixel emits light or not in accordance with a video signal in each subframe period. According to the aforementioned structure, the total actual light emission period of the pixel in one frame period can be controlled by a video signal, so that a gray scale can be displayed.

However, in the case of performing display using the time gray scale method, there is a problem in that a pseudo contour is displayed in a pixel portion depending on the frame frequency. Pseudo contours are unnatural contour lines that are often perceived when the middle gray scale is displayed by the time gray scale method, which are considered to be mainly caused by a variation of the perceptual luminance due to the characteristic of human visual sense.

As a technique to prevent the above-described pseudo contour, a driving method of a plasma display has been proposed in which a subframe period for light emission appears continuously within one frame period in the following Patent Document 1. According to the driving method, such a phenomenon that a light emission period and a non-light emission period within each frame period are inverted in adjacent frame periods can be prevented, so that generation of a pseudo contour can be suppressed.

[Patent Document 1] Japanese Patent Laid-Open No. 2000-231362

DISCLOSURE OF INVENTION

However, in the driving method disclosed in Patent Document 1, the total gray scale level equals to the number of subframe periods in one frame period. Therefore, when the number of subframe periods is increased in order to increase the total gray scale level, each subframe period is required to be shortened. However, video signal input to pixels of all rows is required in each subframe period in general display devices. Thus, in the case where the subframe period is too short, the operating frequency of a driver circuit is required to be increased. Considering the reliability of a driver circuit, it is not preferable to make a subframe period shorter than is necessary.

Each subframe period can be lengthened to some extent by lengthening a frame period; however, lengthening the frame period is not preferable in that drastic increase of the total gray scale level cannot be expected, and besides, a pseudo contour is more easily generated.

Patent Document 1, therefore, also describes a technique for increasing the total gray scale level to be displayed in a pseudo manner without increasing the number of subframe periods, in which image processing such as dithering is performed. However, by performing the image processing such as dithering, the total gray scale level to be displayed can be increased while the image is displayed as if sand is spread thereover, which inevitably leads to decrease in image quality.

In view of the foregoing problem, it is an object of the invention to provide a driving method of a display device in which generation of a pseudo contour can be suppressed while suppressing the operating frequency of a driver circuit. In addition, it is an object of the invention to provide a driving method of a display device in which generation of a pseudo contour can be suppressed while suppressing the drop in image quality.

Furthermore, in view of the foregoing problem, it is an object of the invention to provide a display device in which generation of a pseudo contour can be suppressed while suppressing the operating frequency of a driver circuit. In addition, it is another object of the invention to provide a display device in which generation of a pseudo contour can be suppressed while suppressing the drop in image quality.

According to the invention in view of the foregoing problem, a display device comprises tables each storing data for determining a subframe period for light emission among a plurality of subframe periods. The plurality of subframe periods is determined for an arbitrary pixel among a plurality of pixels. Such a table is stored in a memory.

Specific constitution of the invention is described below.

According to one mode of the invention, a display device comprises a plurality of tables each storing data for determining a subframe period for light emission, a controller for outputting a video signal in accordance with the data, and a pixel portion including pixels each of which gray scale level is controlled in accordance with the outputted video signal, wherein the plurality of tables is different from each other between adjacent pixels in the pixel portion.

According to another mode of the invention, a display device comprises a plurality of tables each storing data for determining a subframe period for light emission, a controller for outputting a video signal in accordance with the data, and a pixel portion including pixels each of which gray scale level is controlled in accordance with the outputted video signal, wherein the plurality of tables is different from each other between adjacent pixels in the pixel portion, and besides, the table for the pixel is different per frame period having subframe periods.

According to the display device of the invention, the number and length of the plurality of subframe periods are determined in accordance with a subframe ratio $R_{SF}$ calculated following a sharing ratio $R_{sh}$.

In addition, according to the display device of the invention, combination of subframe periods determined for displaying a certain gray scale is different among the plurality of tables.

The display device of the invention includes in its category a light emitting device comprising a light emitting element typified by an organic light emitting diode (OLED), a liquid crystal display device, a DMD (Digital Micromirror Device), a PDP (Plasma Display Panel), an FED (Field Emission Display), and other display devices capable of displaying images by a time gray scale method. In addition, the light emitting device includes in its category a panel with a light emitting element sealed, and a module where an IC and the like including a controller are mounted on the panel.

According to one mode of a driving method of the display device of the invention, at least a first pixel and a second pixel adjacent to each other are included, and a first table selected among the plurality of tables each storing data for determining a subframe period for light emission is provided for the first pixel while a second table selected among the plurality of tables is provided for the second pixel.

According to another mode of the driving method of the display device of the invention, at least a first pixel and a second pixel adjacent to each other are included, a first table selected among the plurality of tables each storing data for determining a subframe period for light emission is provided for the first pixel while a second table selected among the plurality of tables is provided for the second pixel, and combination of subframe periods determined for displaying a certain gray scale is different among the plurality of tables.

According to the driving method of the display device of the invention, the first table and the second table are interchanged per frame period having subframe periods.

As set forth above, by providing a table for each of at least two pixels, generation of a pseudo contour can be suppressed. Further, by interchanging a first table and a second table per frame period, generation of a pseudo contour can be further suppressed.

BRIEF DESCRIPTION OF DRAWINGS

FIGS. 20A to 20D are diagrams showing a specific Table a of the invention.

FIGS. 21A to 21D are diagrams showing a specific Table b of the invention.

FIGS. 22A to 22D are diagrams showing a specific Table c of the invention.

FIGS. 23A to 23D are diagrams showing a specific Table d of the invention.

BEST MODE FOR CARRYING OUT THE INVENTION

Figure 1:
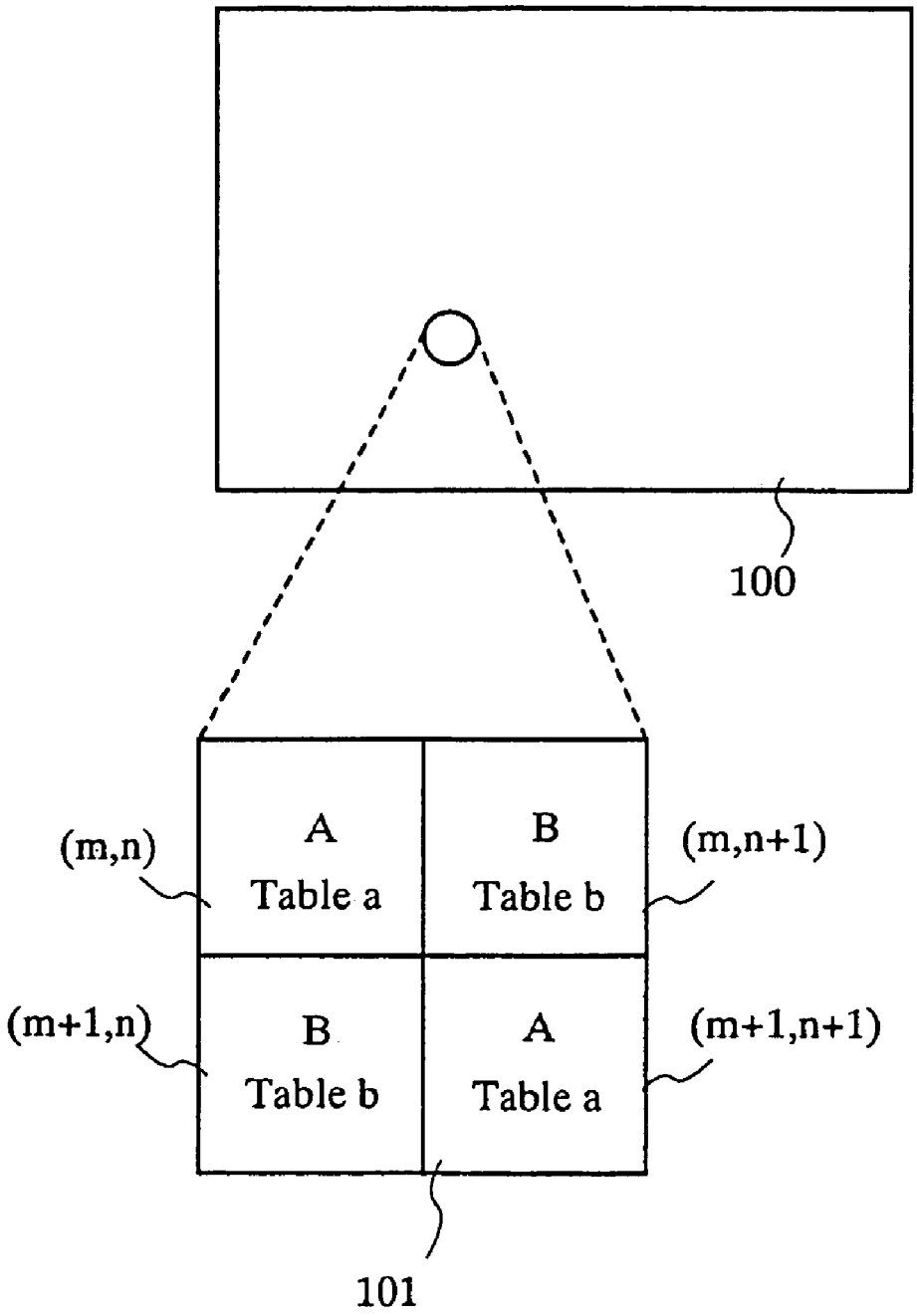
FIG. 1 is a diagram showing a pixel portion and a table of the invention.

Although the invention will be described below by way of embodiment modes and embodiments with reference to the accompanying drawings, it is to be understood that various changes and modifications will be apparent to those skilled in the art. Therefore, unless such changes and modifications depart from the scope of the invention, they should be construed as being included therein. Note that identical portions or the portions having the identical functions are denoted by the same reference numerals in the drawings for describing embodiment modes and embodiments. Therefore, description thereof will be made only once.

Embodiment Mode 1

In this embodiment mode, description is made on a case where a plurality of tables is used for a plurality of pixels.

A plurality of pixels 101 is included in a pixel portion 100 as shown in FIG. 1. Different tables (Table a and Table b) are provided for arbitrary adjacent pixels (A) and (B) among the pixels 101. In other words, Table a and Table b are selected among a plurality of tables each storing data for determining a subframe period for light emission, and Table a and Table b are provided for adjacent pixels (A) and (B) respectively.

In this case, positions of the adjacent pixels (A) and (B) can be denoted by (m, n) and (m, n+1) respectively, provided that m is an arbitrary pixel number of the pixel portion in the row direction while n is an arbitrary pixel number of the pixel portion in the column direction. In this case, in the next (m+1)th row, the pixels (A) and (B) are disposed so as not to be adjacent to the pixels (A) and (B) of the m-th row in the column direction respectively. That is, positions of the pixels (A) and (B) of the (m+1)th row are denoted by (m+1, n+1) and (m+1, n) respectively.

Such pixel arrangement appears as a whole such that the pixels (A) and the pixels (B) are disposed in diagonal respectively.

Table a and Table b provided for respective pixels arranged as above are set to display a certain gray scale at different timings.

In order that a certain gray scale is displayed at different timings, the length of subframe period is determined in view of the sharing ratio. It should be noted here that the sharing ratio is the length rate of subframe period for light emission which appears in common in adjacent frame periods where the gray scale level is different by one.

Specifically, the sharing ratio is obtained as follows: provided that one frame period is divided into three subframe periods $SF_1$ to $SF_3$, when a subframe period for light emission in a frame period is only $SF_3$ whereas subframe periods for light emission in the next frame period are $SF_1$ to $SF_3$, the sharing ratio is $SF_3/(SF_1+SF_2+SF_3)\times100(\%)$.

Typically, the length of subframe period is set to be $2^0:2^1:2^2:2^3:\ldots$; however, the invention is not limited to this and the length of subframe period is determined in view of the sharing ratio.

Figure 16A:
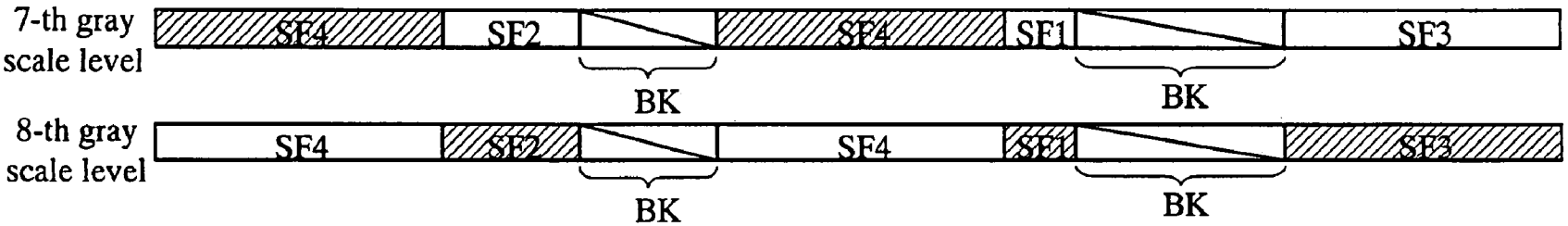
FIG. 16A is a diagram of a conventional subframe period and FIG. 16B is a diagram of a subframe period of the invention.
Figure 16B:
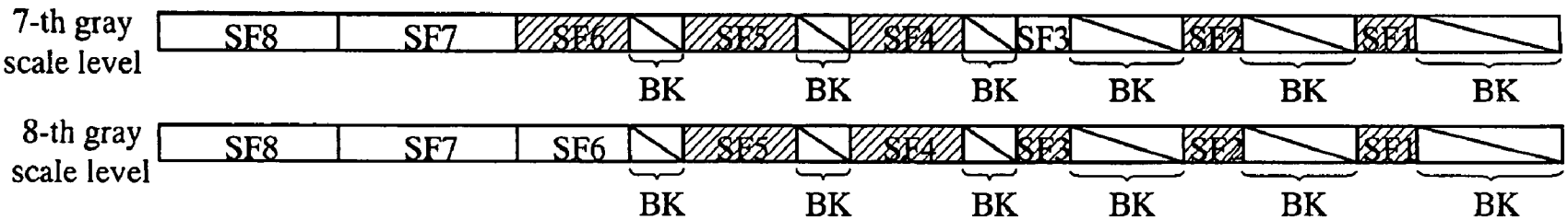

FIGS. 16A and 16B show examples of a subframe period structure. FIG. 16A shows conventional subframe period structures for a 7-th gray scale level and for an 8-th gray scale level respectively in the case where the total gray scale level for display is $2^4$. In FIG. 16A, four subframe periods $SF_1$ to $SF_4$ are employed, and the subframe period $SF_4$ is further divided into two. The length ratio of the subframe periods $SF_1$ to $SF_4$ is set to be $SF_1:SF_2:SF_3:\Sigma SF_4=1:2:4:8$. It is to be noted that a period BK corresponds to a period for forcibly making a light emitting element emit no light (non-display period), which makes no contribution to the gray scale level.

In the case of displaying 7-th gray scale level in FIG. 16A, subframe periods for light emission are $SF_1$, $SF_2$, and $SF_3$, and a subframe period for non-light emission is $SF_4$. In the case of displaying 8-th gray scale level, a subframe period for light emission is $SF_4$, and subframe periods for non-light emission are $SF_1$, $SF_2$, and $SF_3$. Therefore, there is no subframe period for light emission in common, so that the sharing ratio is 0%. According to the subframe period structures shown in FIG. 16A, a pseudo contour tends to be generated easily.

Next, FIG. 16B shows subframe period structures in view of the sharing ratio, which differ from those shown in FIG. 16A. FIG. 16B shows subframe period structures for a 7-th gray scale level and for an 8-th gray scale level respectively in the case where the total gray scale level for display is $2^4$ similarly to FIG. 16A. In FIG. 16B, 8 subframe periods $SF_1$ to $SF_8$ are employed. The length ratio of the subframe periods $SF_1$ to $SF_8$ is set to be $SF_1:SF_2:SF_3:SF_4:SF_5:SF_6:SF_7:SF_8=1:1:1:2:2:2:3:3$. It is to be noted that a period BK corresponds to a non-display period, which makes no contribution to the gray scale level.

In the case of displaying 7-th gray scale level in FIG. 16B, subframe periods for light emission are $SF_3$, $SF_7$, and $SF_8$, and subframe periods for non-light emission are $SF_1$, $SF_2$, $SF_4$, $SF_5$, and $SF_6$. In the case of displaying 8-th gray scale level, subframe periods for light emission are $SF_6$, $SF_7$, and $SF_8$, and subframe periods for non-light emission are $SF_1$, $SF_2$, $SF_3$, $SF_4$, and $SF_5$. Therefore, subframe periods for light emission which appear in common are $SF_7$ and $SF_8$, so that the sharing ratio is $(SF_7+SF_8)\times100/(SF_6+SF_7+SF_8)$, namely 75%. According to the subframe period structures shown in FIG. 16B, a pseudo contour is less generated than the case of FIG. 16A.

Furthermore, according to the subframe period of the invention, there is a plurality of combinations of subframe periods for light emission in displaying a certain gray scale such as 7-th gray scale level or 8-th gray scale level. In FIG. 16B, for example, subframe periods for light emission in displaying 7-th gray scale level can be ($SF_1$, $SF_7$, and $SF_8$), ($SF_2$, $SF_7$, and $SF_8$), ($SF_1$, $SF_4$, $SF_5$, and $SF_6$), or the like. Meanwhile, subframe periods for light emission in displaying 8-th gray scale level can be ($SF_6$, $SF_7$, and $SF_8$), ($SF_1$, $SF_2$, $SF_7$, and $SF_8$), ($SF_1$, $SF_2$, $SF_4$, $SF_5$, and $SF_6$), or the like. Therefore, different tables can be provided for pixels. Which combination of subframe periods is to be provided can be determined in view of the sharing ratio. As a result, a display device can be provided where the gray scale level is determined in accordance with the tables so as to less occur a pseudo contour.

Described next is a specific method for determining the length of each subframe period in one frame period by the sharing ratio $R_{sh}$ and the total gray scale level.

First, the sharing ratio $R_{sh}$ is calculated based on the frame frequency employed for driving. A pseudo contour is less generated with a higher frame frequency, while it is more generated with a lower frame frequency. Thus, by determining the frame frequency in advance, the minimum sharing ratio for suppressing generation of a pseudo contour can be determined for each display device.

Figure 5:
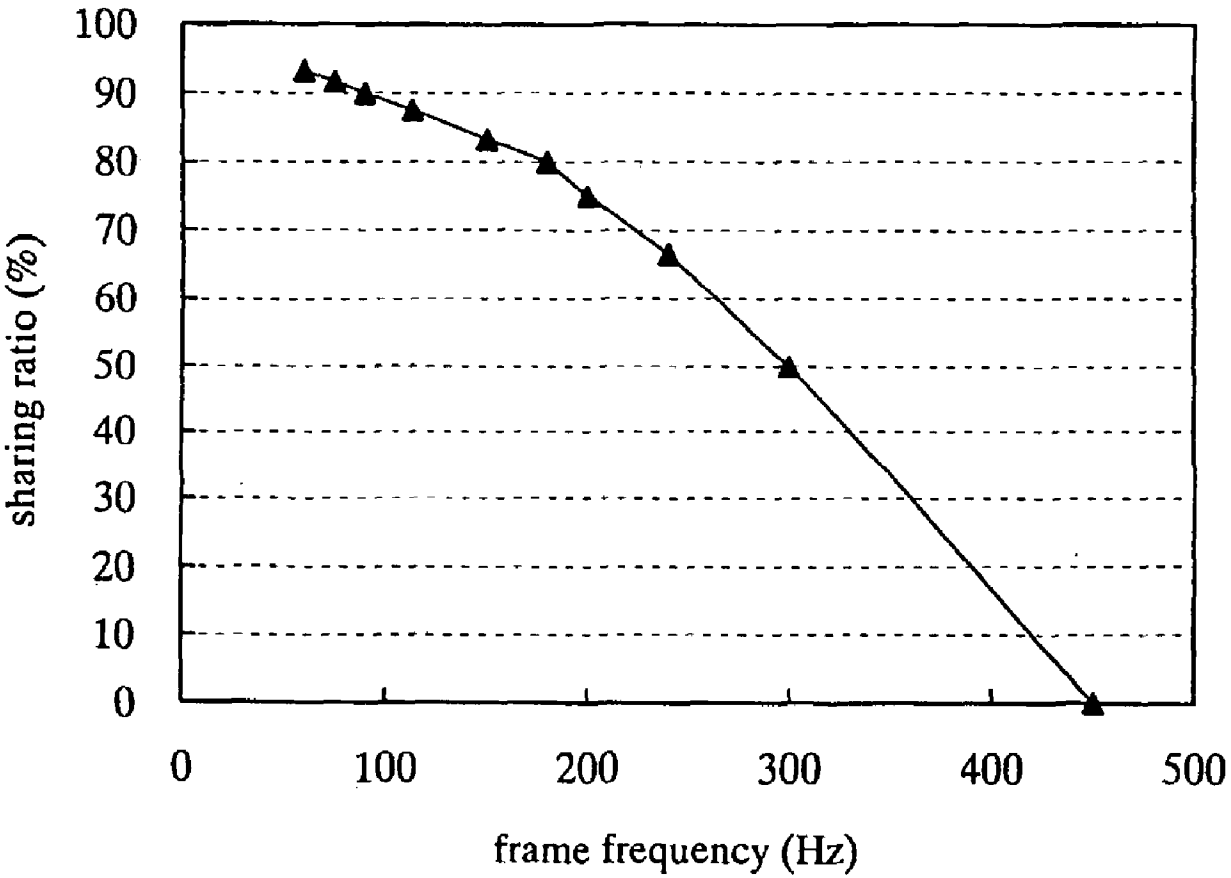
FIG. 5 is a graph showing a relationship between the frame frequency and the minimum sharing ratio for suppressing generation of a pseudo contour.

FIG. 5 shows an example of a relationship between the frame frequency (Hz) and the minimum sharing ratio (%) for suppressing generation of a pseudo contour.

The lower the sharing ratio is, the higher frame frequency is required for suppressing generation of a pseudo contour as shown in FIG. 5. Note that the criterion for judging whether a pseudo contour is being generated or not can be determined arbitrarily; therefore, the same numerical relationship as that shown in FIG. 5 is not necessarily obtained. Under a certain predetermined criterion for that judgement, however, a relationship between the frame frequency (Hz) and the minimum sharing ratio (%) for suppressing generation of a pseudo contour results in that the higher the frame frequency is, the more generation of a pseudo contour can be suppressed.

From the graph shown in FIG. 5, in case of using a specific frame frequency, the minimum sharing ratio (%) for suppressing generation of a pseudo contour is obtained, and thereby a value of the sharing ratio $R_{sh}$ which is equal to or more than the minimum sharing ratio can be determined. With the sharing ratio $R_{sh}$ determined, the length of each subframe period is determined.

First, n subframe periods in one frame period are referred to as $SF_1$ to $SF_n$ in ascending order of length. It is provided here that when light emission is performed in all of $SF_1$ to $SF_p$ ($p<n$), m-th gray scale level ($m<2^n$) can be displayed. In this case, when the total length of the subframe periods $SF_1$ to $SF_p$ for light emission in displaying m-th gray scale level is denoted by $T_m$, $T_m$ can be expressed by the following Formula 1.

$$T_m = \sum_{n=1}^{p} SF_n \quad \text{[Formula 1]}$$

Next, the case of displaying (m+1)-th gray scale level is considered. Since m-th gray scale level can be displayed by emitting light in all of $SF_1$ to $SF_p$, it is necessary to employ $SF_{p+1}$ which is longer than $SF_p$ in order to display (m+1)-th gray scale level. At the same time, it is necessary to subtract one or a plurality of subframe periods, corresponding to a length obtained by subtracting the length for one gray scale level (e.g., a length corresponding to $SF_1$) from $SF_{p+1}$, from the subframe periods $SF_1$ to $SF_p$ to perform display. Consequently, when the total length of subframe periods for light emission in displaying (m+1)-th gray scale level is denoted by $T_{m+1}$, $T_{m+1}$ can be expressed by the following Formula 2.

$$T_{m+1} = \sum_{n=1}^{p+1} SF_n - (SF_{p+1} - SF_1) \quad \text{[Formula2]}$$

When the rate of $SF_{p+1}$ to $\Sigma$ ($SF_1$~$SF_{p+1}$) is the subframe ratio $R_{SF}$, $R_{SF}$ can be expressed by the following Formula 3.

$$R_{SF} = \frac{SF_{p+1}}{\sum_{n=1}^{p+1} SF_n} \quad \text{[Formula 3]}$$

The following Formula 4 can be derived from Formula 3.

$$SF_{p+1} = \sum_{n=1}^{p+1} SF_n \times R_{SF} \quad \text{[Formula 4]}$$

Then, when the total length of subframe periods for light emission which appear in common in displaying m-th gray scale level and in displaying (m+1)-th gray scale level is denoted by $W_{m/m+1}$, $W_{m/m+1}$ can be expressed by the following Formula 5.

$$W_{m/m+1} = T_m - (SF_{p+1} - SF_1) \quad \text{[Formula 5]}$$

Accordingly, the following Formula 6 is derived from Formula 1, Formula 4, and Formula 5.

$$\begin{aligned} W_{m/m+1} &= \sum_{n=1}^{p} SF_n - (SF_{p+1} - SF_1) \\ &= \sum_{n=1}^{p+1} SF_n - SF_{p+1} - (SF_{p+1} - SF_1) \\ &= \sum_{n=1}^{p+1} SF_n - 2 \times R_{SF} \times \sum_{n=1}^{p+1} SF_n + SF_1 \end{aligned} \quad \text{[Formula 6]}$$

The sharing ratio $R_{sh}$ of subframe periods for light emission which appear in common in displaying m-th gray scale level and in displaying (m+1)-th gray scale level is expressed by the following Formula 7.

$$R_{sh} = W_{m/m+1} / T_{m+1} \quad \text{[Formula 7]}$$

As a result, the following Formula 8 is derived from Formula 2, Formula 4, Formula 6, and Formula 7.

$$\begin{aligned} R_{sh} &= \left\{ \sum_{n=1}^{p+1} SF_n - 2 \times R_{SF} \times \sum_{n=1}^{p+1} SF_n + SF_1 \right\} \Big/ \left\{ \sum_{n=1}^{p+1} SF_n - R_{SF} \times \sum_{n=1}^{p+1} SF_n + SF_1 \right\} \\ &\approx \left\{ \sum_{n=1}^{p+1} SF_n - 2 \times R_{SF} \times \sum_{n=1}^{p+1} SF_n \right\} \Big/ \left\{ \sum_{n=1}^{p+1} SF_n - R_{SF} \times \sum_{n=1}^{p+1} SF_n \right\} \\ &= (1 - 2R_{SF}) / (1 - R_{SF}) \end{aligned} \quad \text{[Formula 8]}$$

Further, the following Formula 9 can be derived from Formula 8.

$$R_{SF} = (1 - R_{sh}) / (2 - R_{sh}) \quad \text{[Formula 9]}$$

Consequently, a value of the subframe ratio $R_{SF}$ can be obtained by substituting a value of the sharing ratio $R_{sh}$ into Formula 9. The subframe ratio $R_{SF}$ is the rate of $SF_{p+1}$ to $\Sigma$ ($SF_1$~$SF_{p+1}$). By using this subframe ratio $R_{SF}$, the length of each of the subframe periods can be determined sequentially from that of the longest subframe period $SF_n$.

By determining the length of subframe period in view of the sharing ratio, there are various options of subframe periods for light emission in displaying a certain gray scale as described above. That is, a plurality of tables storing data for determining a subframe period for light emission each have the redundancy. Therefore, some tables selected among the plurality of tables can be provided for a plurality of pixels.

By providing tables for at least two pixels or more as above, the gray scale level where a pseudo contour tends to be generated is dispersed, so that a pseudo contour can be less perceived.

Tables are provided for the pixels (A) and (B) respectively in this embodiment mode; however, the invention is not limited to this. For example, four tables may be provided for pixels, and the respective pixels may be arranged in rectangular shape. That is, according to the invention, a pseudo contour can be prevented as compared to a conventional technique by providing each tables for at least two pixels or more.

In a display device performing the driving method of the invention as above, a table for outputting a predetermined signal correspondingly to a signal being inputted is a kind of look-up table and is storing by hardware such as a memory of a ROM, a RAM, or the like.

In the driving method described in this embodiment mode, any subframe period may be inverted. For example, a set of subframe periods may be inverted at the end thereof within one frame period. As a result, a pseudo contour, particularly a moving-image pseudo contour can be further prevented.

Embodiment Mode 2

A specific example of a subframe period is described in this embodiment mode.

Figure 6:
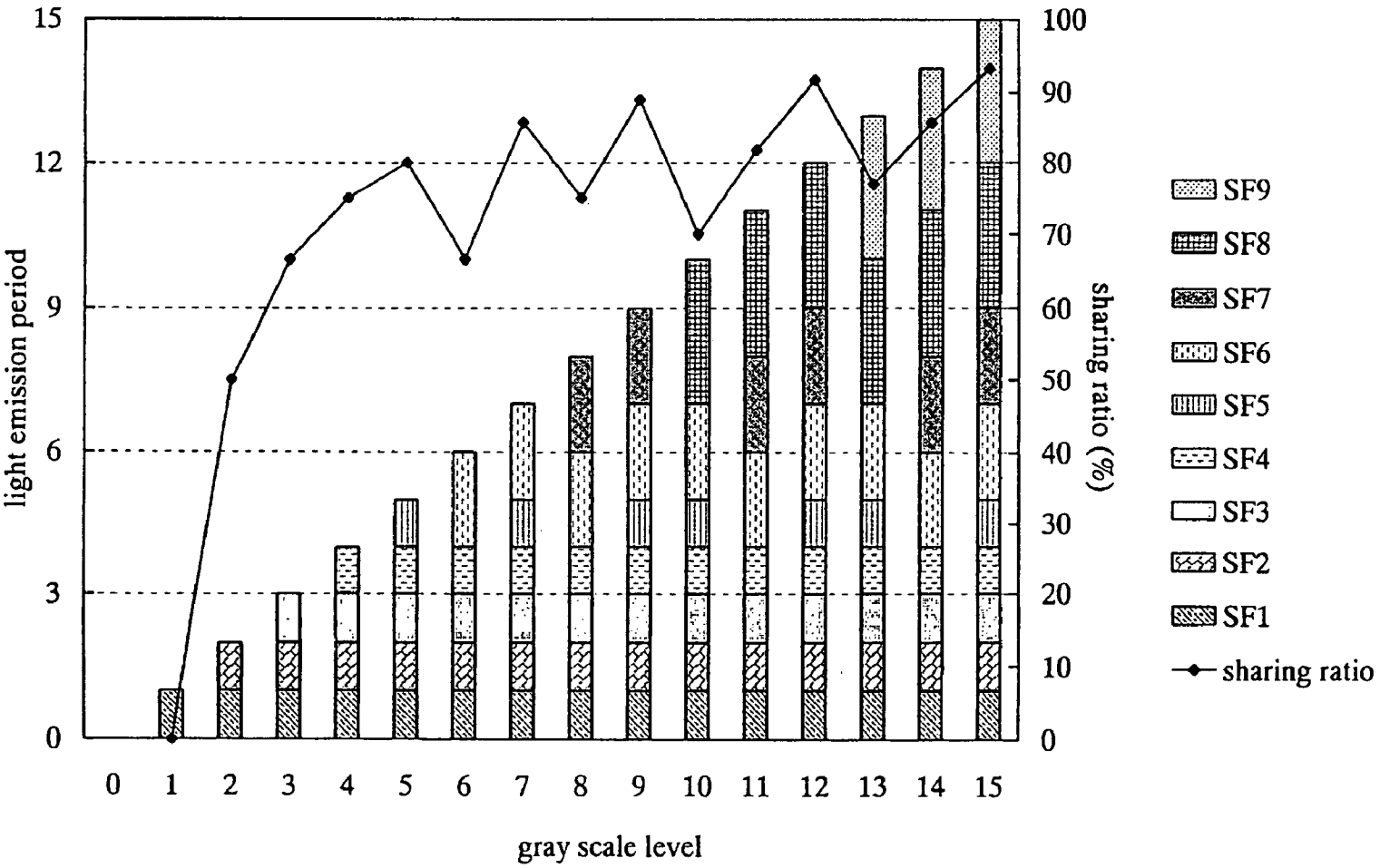
FIG. 6 is a graph showing a relationship between the gray scale level and a subframe period for light emission, and a sharing ratio obtained by comparing with the case of a lower gray scale level by one.

FIG. 6 shows a specific example a subframe period for light emission in the case where the total gray scale level is $2^4$ using a video signal of 4 bits. The abscissa axis in FIG. 6 indicates a gray scale level while the left-ordinate axis indicates a light emission period that is a total period of subframe period for light emission. In the FIG. 6 also, the right-ordinate axis indicates a sharing ratio $R_{sh}$ (%) obtained by comparing with the case for a lower gray scale level by one. 9 subframe periods $SF_1$ to $SF_9$ are employed for display in FIG. 6. The length ratio of each the subframe periods $SF_1$ to $SF_9$ is set to be SF1:SF2:SF3:SF4:SF5:SF6:SF7:SF8:SF9=1:1:1:1:1:2:2:3:3.

There are periods having the same length among these subframe periods. Therefore, there is a plurality of combinations of subframe periods selected for displaying a certain gray scale, and in accordance with the combinations different tables can be set.

Such a table is a kind of look-up table and is storing by hardware such as a memory of a ROM, a RAM, or the like.

In FIG. 6, the length of subframe period is determined such that the sharing ratio $R_{sh}$ (%) is kept at 65% or more when a gray scale from 4 to 16 is displayed. Note that the sharing ratio $R_{sh}$ (%) is not satisfied in the 0-th and 1-th gray scale levels under the definition of the sharing ratio $R_{sh}$ (%). In addition, the sharing ratio $R_{sh}$ (%) is not satisfied either in the 2-th gray scale level which is relatively low in FIG. 6, because the sharing ratio $R_{sh}$ (%) is not necessarily required to be satisfied in such a low gray scale level where a pseudo contour is less generated.

Figure 17:
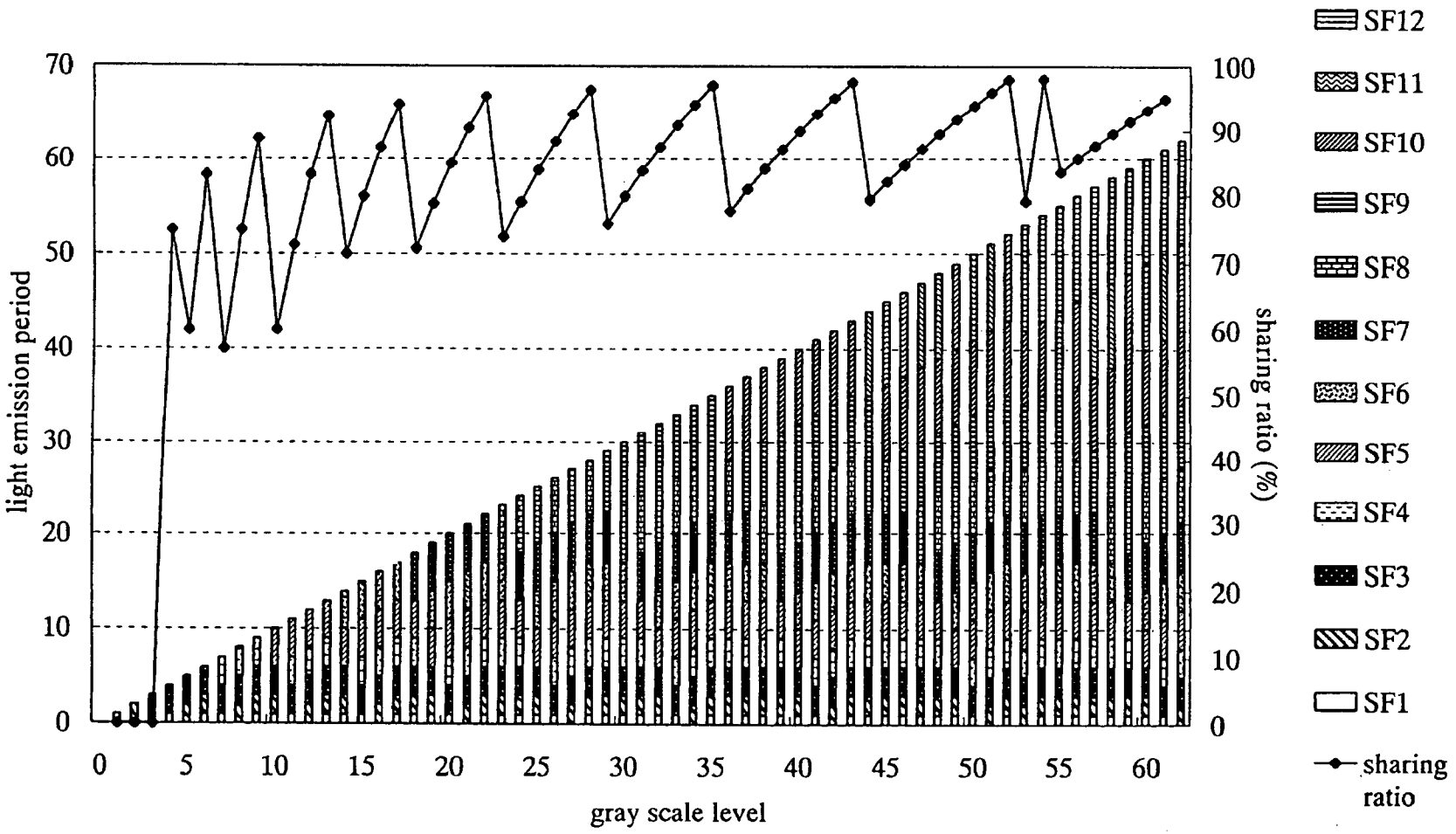
FIG. 17 is a graph showing a relationship between the gray scale level and a subframe period for light emission, and a sharing ratio obtained by comparing with the case for a lower gray scale level by one.

FIG. 17 shows a specific example a subframe period for light emission in the case where the total gray scale level is $2^6$ using a video signal of 6 bits. The abscissa axis in FIG. 17 indicates a gray scale level while the left-ordinate axis indicates a light emission period that is a total period of subframe period for light emission. A gray scale level to be displayed is determined in accordance with the length of the light emission period. In the FIG. 17 also, the right-ordinate indicates a sharing ratio $R_{sh}$ (%) obtained by comparing with the case for a lower gray scale level by one. 12 subframe periods $SF_1$ to $SF_{12}$ are employed for display in FIG. 17. The length ratio of the subframe periods $SF_1$ to $SF_{12}$ is set to be SF1:SF2:SF3:SF4:SF5:SF6:SF7:SF8:SF9:SF10:SF11:SF12=1:2:3:3:4:4:5:6:7:8:9:11.

There are periods having the same length among these subframe periods. Therefore, there is a plurality of combinations of subframe periods selected for displaying a certain gray scale, and in accordance with the combinations different tables can be set.

Such a table is a kind of look-up table and is storing by hardware such as a memory of a ROM, a RAM, or the like.

In FIG. 17, the length of respective subframe period is determined such that the sharing ratio $R_{sh}$ (%) is kept at 70% or more when a gray scale from 12 to 63 is displayed. Note that the sharing ratio $R_{sh}$ (%) is not satisfied in the 0-th and 1-th gray scale levels under the definition of the sharing ratio $R_{sh}$ (%). In addition, the sharing ratio $R_{sh}$ (%) is not satisfied either in the 2-th to 11-th gray scale levels which are relatively low in FIG. 17, because the sharing ratio $R_{sh}$ (%) is not necessarily required to be satisfied in such low gray scale levels where a pseudo contour is less generated.

As set forth above, a subframe period is determined in view of the sharing ratio so that a plurality of different tables can be set. By providing the plurality of tables for pixels, a pseudo contour can be prevented.

Embodiment Mode 3

Described in this embodiment mode is the case where a table corresponding to each pixel is not fixed but changed per frame period.

Figure 2A:
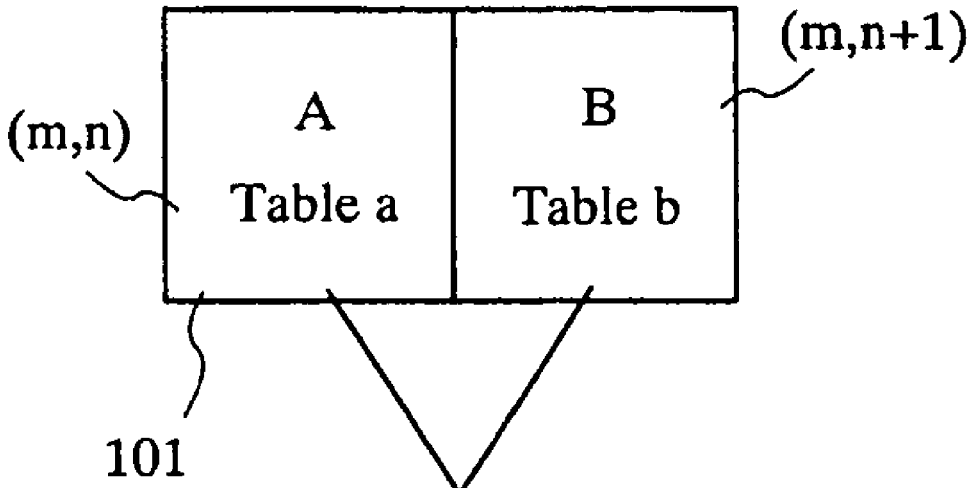
FIGS. 2A and 2B are diagrams showing a pixel portion and a table of the invention.

It is provided that Tables a and b are provided for adjacent pixels (A) and (B) respectively in the T-th frame as shown in FIG. 2A.

Figure 2B:
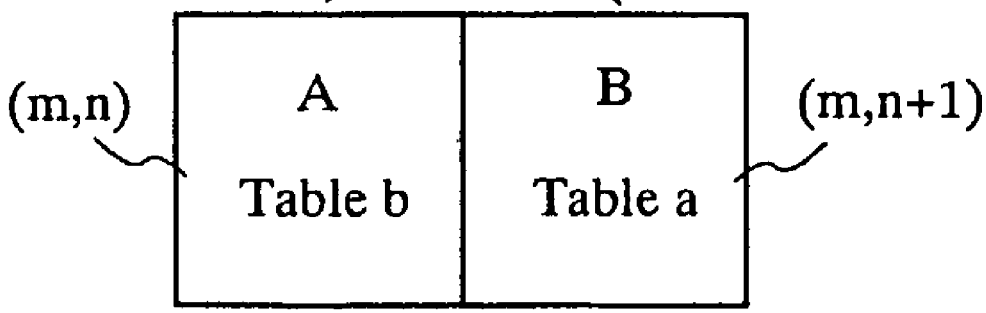

Then, the tables a and b are provided in accordance with positions of the pixels (A) and (B) in the (t+1)-th frame inversely to the case in the t-th frame as shown in FIG. 2B. A table provided correspondingly to each pixel can be changed per frame in this manner. The contents and data on the change of the table can be stored in a ROM or a RAM.

By changing per frame a table corresponding for each pixel, namely a table storing data for determining a subframe period for light emission as set forth above, a pseudo contour can be further prevented.

Tables are provided for the pixels (A) and (B) respectively in this embodiment mode; however, the invention is not limited to this. For example, four tables may be provided for pixels, and the respective pixels for which each table is provided may be arranged in rectangular shape. That is, according to the invention, a pseudo contour can be prevented as compared to a conventional technique by providing tables for at least two pixels or more.

Embodiment Mode 4

Figure 7A:
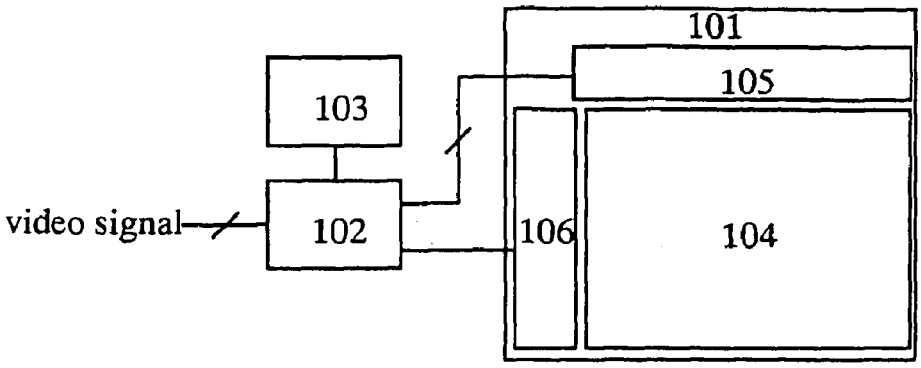
FIGS. 7A and 7B are block diagrams showing constitution of the light emitting device of the invention.
Figure 7B:
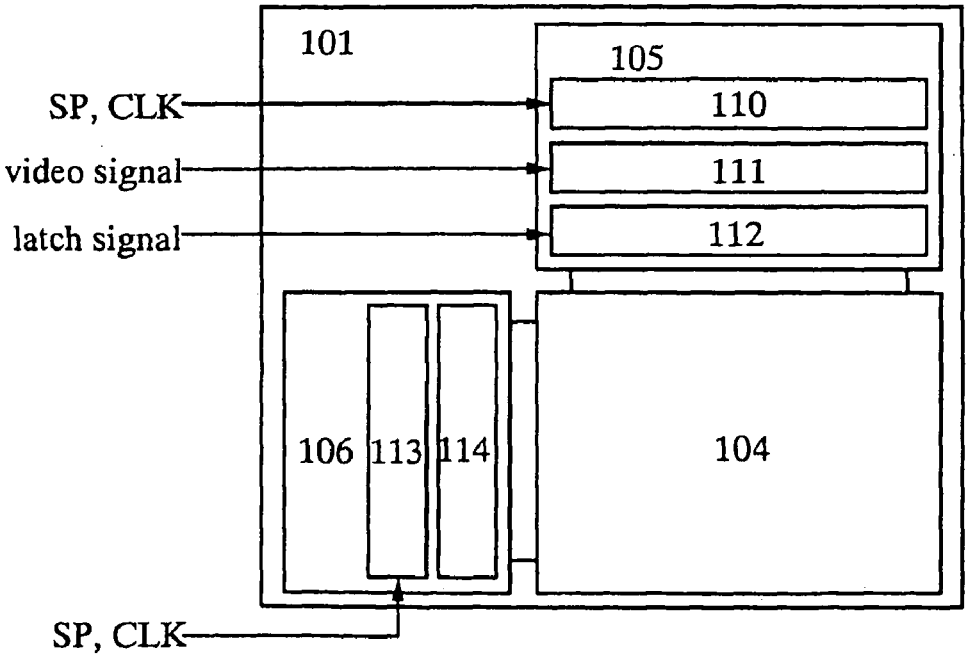

Specific constitution of a light emitting device which is one of display devices is described in this embodiment mode. FIGS. 7A and 7B are block diagrams of exemplary constitution of a light emitting device of the invention. A light emitting device shown in FIGS. 7A and 7B comprises a panel 104, a controller 102, and a table 103. The panel 104 comprises a pixel portion 100 including a plurality of pixels each having a light emitting element, a signal line driver circuit 105, and a scan line driver circuit 106.

The table 103 is storing by hardware such as a memory of a ROM and a RAM, which is provided in plural number in accordance with the pixels. The memory stores data on a pixel arrangement corresponding to each table and the like. The memory also stores in accordance with a subframe ratio $R_{SF}$ the number and length of a plurality of subframe periods in one frame period, and data for determining a subframe period for light emission in each gray scale level among the plurality of subframe periods. The subframe ratio $R_{SF}$ is calculated following a sharing ratio $R_{sh}$ determined depending on the frame frequency.

The controller 102 can determine a subframe period for light emission depending on the gray scale level of an inputted video signal, in accordance with the data stored in the table 103, and output it. In addition, the controller 102 has a frame memory, and can generate various control signals such as a clock signal and a start pulse signal depending on each length of a plurality of subframe periods stored in the table 103, the operating frequency of the signal line driver circuit 105 and the scan line driver circuit 106, and the like.

Video signal conversion and control signal generation are both performed by the controller 102 in FIG. 7A; however, the invention is not limited to this constitution. A controller for converting a video signal and a controller for generating a control signal may be provided separately in the light emitting device.

FIG. 7B is an exemplary specific constitution of the panel 104 shown in FIG. 7A.

In FIG. 7B, the signal line driver circuit 105 includes a shift register 110, a latch A 111, and a latch B 112. Control signals such as a clock signal (CLK) and a start pulse signal (SP) are inputted into the shift register 110. When the clock signal (CLK) and the start pulse signal (SP) are inputted, a timing signal is generated in the shift register 110. The generated timing signal is inputted into the first-stage latch A 111 sequentially. Upon input of the timing signal into the latch A 111, a video signal inputted from the controller 102 is sequentially inputted into the latch A 111 in synchronization with a pulse of the inputted timing signal, and held. Note that the video signal is inputted into the latch A 111 sequentially in this embodiment mode; however, the invention is not limited to this structure. Alternatively, so-called division drive may be performed, in which a plurality of stages of the latch A 111 is divided into several groups so that a video signal is inputted in parallel per group. The number of the groups here is called a division number. For example, when the latch is divided into four groups of stages, four-division drive is performed.

A period for inputting a video signal into all of the latch stages of the latch A 111 is called a row selection period. Practically, there may be a case where a row selection period includes a horizontal retrace period in addition to the aforementioned row selection period.

Upon termination of one row selection period, a latch signal that is one of control signals is supplied to the second-stage latch B 112. In synchronization with the latch signal, the video signal held in the latch A 111 is written all at once into the latch B 112. After the video signal is sent to the latch B 112, the latch A 111 is sequentially inputted with a video signal of the next bit in synchronization with the timing signal from the shift register 110 again. During the second one row selection period, the video signal written and held in the latch B 112 is inputted into the pixel portion 100.

It is to be noted that instead of the shift register 110, a circuit which is capable of selecting a signal line such as a decoder may be used.

Next, constitution of the scan line driver circuit 106 is described. The scan line driver circuit 106 includes a shift register 113 and a buffer 114. In addition, a level shifter may be included if necessary. In the scan line driver circuit 106, a clock signal (CLK) and a start pulse signal (SP) are inputted into the shift register 113 to generate a selection signal. The generated selection signal is amplified in the buffer 114 to be supplied to the corresponding scan line. Since the selection signal supplied to the scan line controls operation of transistors included in pixels of one row, a buffer which is capable of supplying a relatively large amount of current to a scan line is preferably used as the buffer 114.

It is to be noted that instead of the shift register 113, a circuit which is capable of selecting a signal line such as a decoder may be used.

The scan line driver circuit 106 and the signal line driver circuit 105 may be formed over either the same substrate as the pixel portion 100 or a different substrate in the invention. For example, the scan line driver circuit 106 or the signal line driver circuit 105 may be formed using an IC chip to be mounted. Constitution of the panel in the light emitting device of the invention is not limited to that shown in FIGS. 7A and 7B if the panel 104 has such constitution that the pixel gray scale level is controlled in accordance with a video signal inputted from the controller 102.

By employing a plurality of tables in such a light emitting device, a pseudo contour can be prevented.

In display devices other than the above also, by employing a memory storing a plurality of tables, a pseudo contour can be prevented.

Embodiment Mode 5

Next, an equivalent circuit diagram of a pixel in the light emitting device of the invention is described with reference to FIGS. 8A to 8C.

Figure 8A:
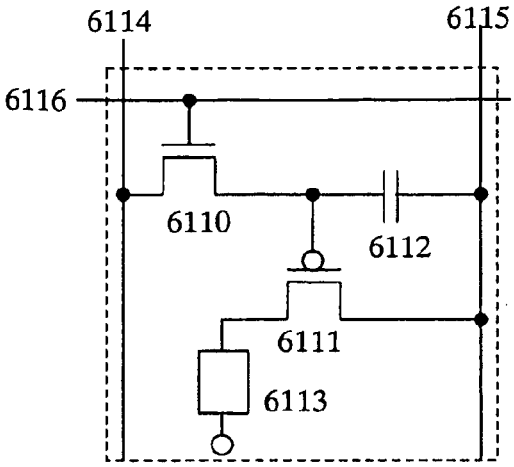
FIGS. 8A to 8C are diagrams showing examples of a pixel in the light emitting device of the invention.

FIG. 8A is an example of an equivalent circuit diagram of a pixel, which includes a signal line 6114, a power supply line 6115, a scan line 6116, a light emitting element 6113, transistors 6110 and 6111, and a capacitor 6112. The signal line 6114 is inputted with a video signal by a signal line driver circuit. The transistor 6110 can control supply of potential of the video signal to a gate of the transistor 6111 in accordance with a selection signal inputted into the scan line 6116. The transistor 6111 can control supply of current to the light emitting element 6113 in accordance with the potential of the video signal. The capacitor 6112 can hold voltage between a gate and a source of the transistor 6111 (referred to as gate-source voltage). Note that the capacitor 6112 is provided in FIG. 8A; however, it is not required to be provided if the gate capacitance of the transistor 6111 or the other parasitic capacitance can substitute for it.

Figure 8B:
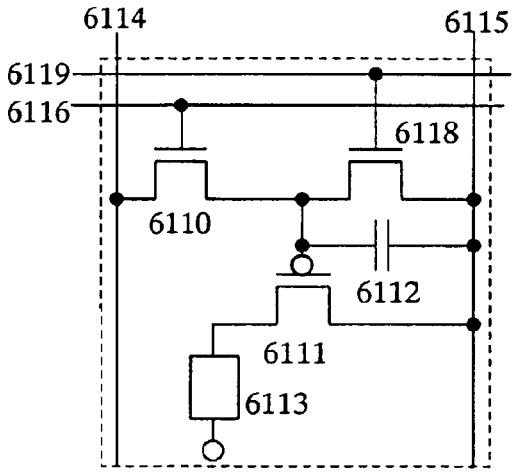

FIG. 8B is an equivalent circuit diagram of a pixel where a transistor 6118 and a scan line 6119 are additionally provided in the pixel shown in FIG. 8A. By the transistor 6118, potential of the gate and a source of the transistor 6111 can be equal to each other so as to forcibly flow no current into the light emitting element 6113. Therefore, the length for each subframe period can be set to be shorter than a period for inputting a video signal into all pixels. Accordingly, display can be performed with high total gray scale level while suppressing the operating frequency.

Figure 8C:
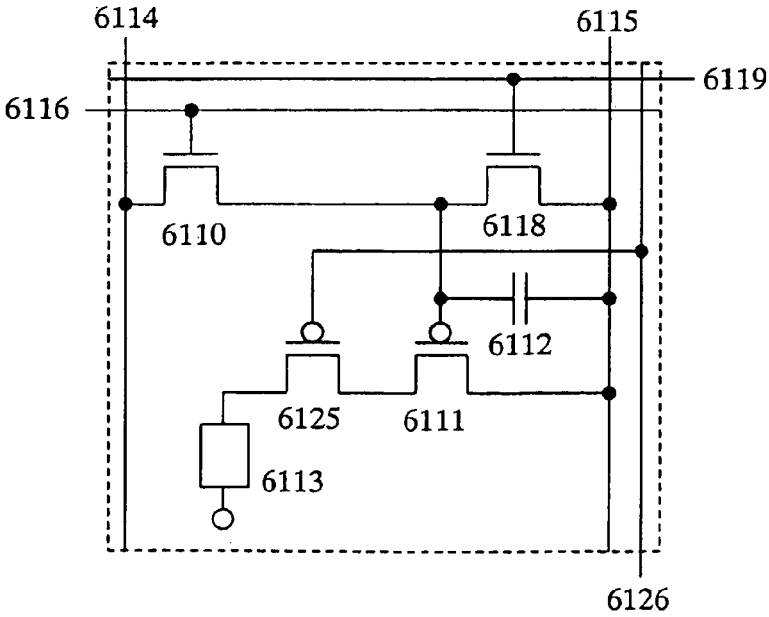

FIG. 8C is an equivalent circuit diagram of a pixel where a transistor 6125 and a wiring 6126 are additionally provided in the pixel shown in FIG. 8B. Gate potential of the transistor 6125 is fixed by the wiring 6126. In addition, the transistors 6111 and 6125 are connected in series between the power supply line 6115 and the light emitting element 6113. In FIG. 8C, accordingly, the transistor 6125 controls the amount of current supplied to the light emitting element 6113 while the transistor 6111 controls whether the current is supplied or not to the light emitting element 6113.

It is to be noted that a configuration of a pixel circuit in the light emitting device of the invention is not limited to those described in this embodiment mode, and the invention can be applied to any display device performing time gray scale display. This embodiment mode can be freely combined with the above embodiment modes.

Embodiment Mode 6

Timing of appearing each subframe period is described in this embodiment mode by using as an example the driving method of the invention shown in FIG. 6.

Figure 9:
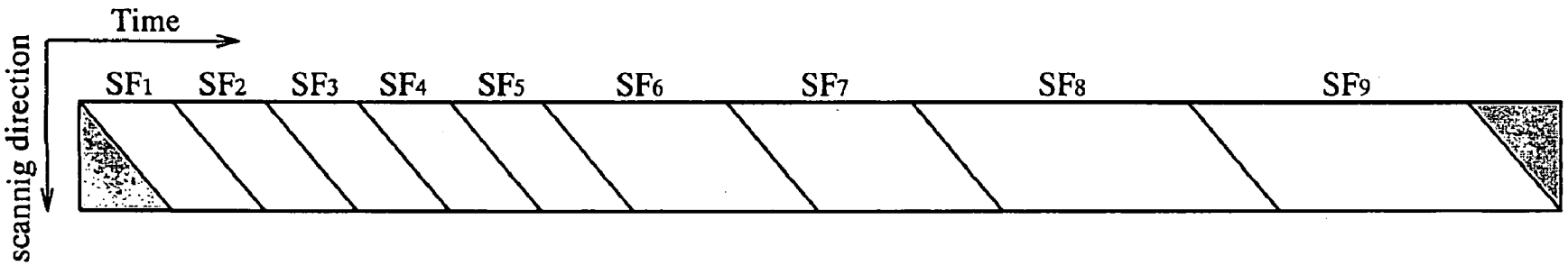
FIG. 9 is a timing chart in the case of displaying a 4-bit gray scale according to the driving method of the invention.

FIG. 9 shows a timing chart in the case where the total gray scale level is 24 in which the driving method of the invention shown in FIG. 6 is employed. The abscissa axis in FIG. 9 indicates the length of the subframe periods $SF_1$ to $SF_9$ in one frame period while the ordinate axis indicates the selection order of scan lines. The length ratio of the subframe periods $SF_1$ to $SF_9$ is set to be 1:1:1:1:1:2:2:3:3 sequentially from $SF_1$. Therefore, when 3-th gray scale level are displayed for example, a light emission period corresponds to the total subframe period of $SF_1$ to $SF_3$, the total subframe period of any one of $SF_1$ to $SF_4$ and either $SF_6$ or $SF_7$, or the subframe period of either $SF_8$ or $SF_9$. As a result, a table storing data for determining a subframe period for light emission can have the redundancy; therefore, different tables can be provided for pixels.

When each subframe period starts, video signal input is performed per one row of pixels sharing one scan line. After the video signal is inputted into the pixel, a light emitting element emits light or not in accordance with data of the video signal. The light emitting element in each pixel keeps emitting light or not in accordance with the video signal until the next subframe period starts.

Note that a light emitting element emit light or not in accordance with data of a video signal simultaneously with the input of the video signal into a pixel in the timing chart shown in FIG. 9; however, the invention is not limited to this structure. Alternatively, it is possible that the light emitting elements are kept to emit no light until a video signal is inputted into all pixels, and after the video signal is inputted into all the pixels, the light emitting elements emit light or not in accordance with data of the video signal.

In addition, all subframe periods appear continuously in the timing chart shown in FIG. 9; however, the invention is not limited to this structure. It is possible to provide a period for forcibly making a light emitting element emit no light (non-display period), between subframe periods. The non-display period can be provided by discharging charges of the capacitor 6112 with the transistor 6118 shown in FIG. 8B or 8C. The non-display period may start before or after video signal input into all pixels is completed in a subframe period right before the non-display period.

Embodiment 7

Figure 10A:
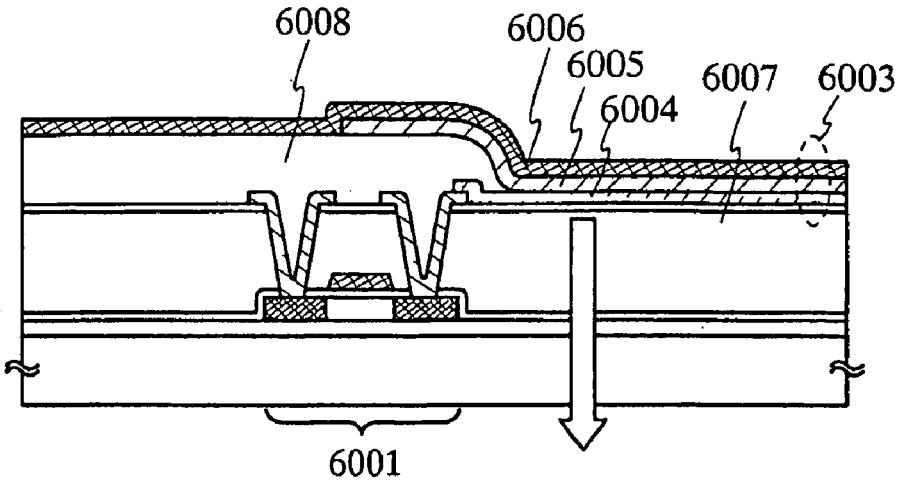
FIGS. 10A to 10C are cross-sectional views of a pixel in the light emitting device of the invention.
Figure 10B:
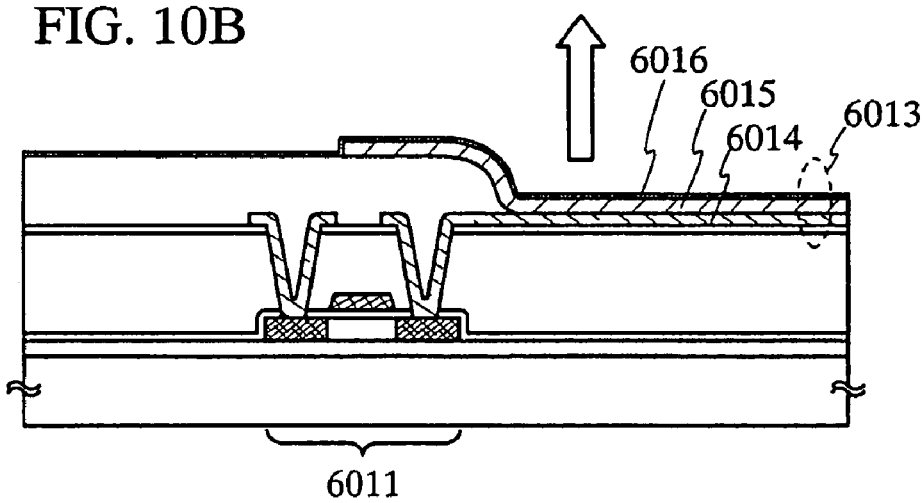
Figure 10C:
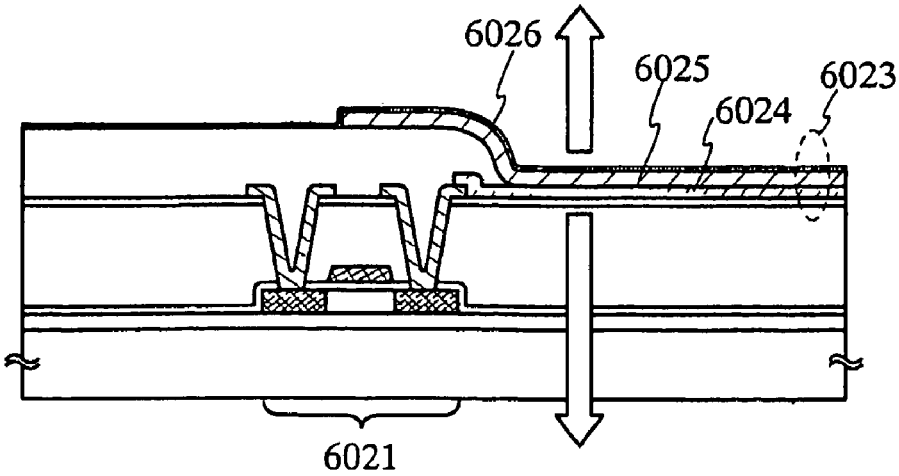

In this embodiment mode, a cross-sectional structure of a pixel where a transistor for controlling current supply to a light emitting element is a P-channel thin film transistor (TFT) is described using FIGS. 10A to 10C. Note that one of an anode and a cathode of which potential can be controlled by a transistor, of the light emitting element is referred to as a first electrode, and the other is referred to as a second electrode in this specification. Description is made on the case where the first electrode is the anode and the second electrode is the cathode in FIGS. 10A to 10C; however, it is possible that the first electrode is the cathode while the second electrode is the anode as well.

FIG. 10A is a cross-sectional view of a pixel where a TFT 6001 is a P-channel type and light from a light emitting element 6003 is extracted from a first electrode 6004 side. The first electrode 6004 of the light emitting element 6003 is electrically connected to the TFT 6001 in FIG. 10A.

The TFT 6001 is covered with an interlayer insulating film 6007, and a bank 6008 having an opening is formed over the interlayer insulating film 6007. In the opening of the bank 6008, the first electrode 6004 is partially exposed, and the first electrode 6004, an electroluminescent layer 6005 and a second electrode 6006 are stacked in this order.

The interlayer insulating film 6007 can be formed using an organic resin film, an inorganic insulating film, or an insulating film containing a siloxane-based material as a starting material and having Si—O—Si bonds (hereinafter referred to as a "siloxane insulating film"). Siloxane insulating film contains hydrogen as a substituent, and can further contain at least one of fluorine, an alkyl group and aromatic hydrocarbon. The interlayer insulating film 6007 may also be formed using a so-called low dielectric constant material (low-k material).

The bank 6008 can be formed using an organic resin film, an inorganic insulating film, or a siloxane insulating film. In the case of an organic resin film, for example, acrylic, polyimide, or polyamide can be used. In the case of an inorganic insulating film, silicon oxide, silicon nitride oxide, or the like can be used. Preferably, the bank 6008 is formed by using a photosensitive organic resin film and has an opening on the first electrode 6004 which is formed such that the side face thereof has a slope with a continuous curvature, which can prevent the first electrode 6004 and the second electrode 6006 from being connected to each other.

The first electrode 6004 is formed by using a material or with a thickness to transmit light, and by using a material suitable for being used as an anode. For example, the first electrode 6004 can be formed using a light transmitting conductive oxide such as indium tin oxide (ITO), zinc oxide (ZnO), indium zinc oxide (IZO), and gallium-doped zinc oxide (GZO). Alternatively, the first electrode 6004 may be formed by using zinc oxide containing silicon oxide, indium tin oxide containing silicon oxide (hereinafter referred to as ITSO), or a mixture of ITSO and 2 to 20% of zinc oxide (ZnO). Further, other than the aforementioned light transmitting conductive oxide, the first electrode 6004 may be formed by using, for example, a single-layer film of one or more of TiN, ZrN, Ti, W, Ni, Pt, Cr, Ag, Al and the like, a stacked-layer structure of a titanium nitride film and a film mainly containing aluminum, or a three-layer structure of a titanium nitride film, a film mainly containing aluminum and a titanium nitride film. It is to be noted that when such a material other than the light transmitting conductive oxide is employed, the first electrode 6004 is formed thin enough to transmit light (preferably about 5 to 30 nm).

The second electrode 6006 is formed by using a material and with a thickness to reflect or shield light, and by using a material having a low work function such as a metal, an alloy, an electrically conductive compound, or a mixture of them. Specifically, an alkali metal such as Li and Cs, an alkaline earth metal such as Mg, Ca and Sr, an alloy containing such metals (Mg:Ag, Al:Li, Mg:In, or the like), a compound of such metals ($CaF_2$ or $Ca_3N_2$), or a rare-earth metal such as Yb and Er can be employed. In the case where an electron injection layer is provided, a conductive layer such as an Al layer can be employed instead.

The electroluminescent layer 6005 is structured by a single layer or a plurality of layers. In the case of a plurality of layers, these layers can be classified into a hole injection layer, a hole transporting layer, a light emitting layer, an electron transporting layer, an electron injection layer and the like in terms of the carrier transporting property. When the electroluminescent layer 6005 has any of the hole injection layer, the hole transporting layer, the electron transporting layer and the electron injection layer other than the light emitting layer, the hole injection layer, the hole transporting layer, the light emitting layer, the electron transporting layer and the electron injection layer are stacked in this order on the first electrode 6004. Note that the boundary between the layers is not necessarily distinct and the boundary may not be distinguished clearly since the materials forming the respective layers are partially mixed. Each of the layers can be formed by using an organic material or an inorganic material. As for an organic material, any of the high, medium and low molecular weight materials can be employed. Note that the medium molecular weight material means a low polymer in which the repeated number of structural units (the degree of polymerization) is about 2 to 20. There is no clear distinction between the hole injection layer and the hole transporting layer, and the hole transporting property (hole mobility) is particularly significant in both of them. The hole injection layer is in contact with the anode, and a layer in contact with the hole injection layer is referred to as a hole transporting layer to be distinguished for convenience. The same are applied to the electron transporting layer and the electron injection layer, and a layer in contact with the cathode is referred to as an electron injection layer while a layer in contact with the electron injection layer is referred to as an electron transporting layer. The light emitting layer may additionally have the function of the electron transporting layer, and thus may be called a light emitting electron transporting layer.

In the pixel shown in FIG. 10A, light emitted from the light emitting element 6003 can be extracted from the first electrode 6004 side as shown by a hollow arrow.

FIG. 10B is a cross-sectional view of a pixel where a TFT 6011 is a P-channel type and light emitted from a light emitting element 6013 is extracted from a second electrode 6016 side. A first electrode 6014 of the light emitting element 6013 is electrically connected to the TFT 6011 in FIG. 10B. On the first electrode 6014, an electroluminescent layer 6015 and the second electrode 6016 are stacked in this order.

The first electrode 6014 is formed by using a material and with a thickness to reflect or shield light, and by using a material suitable for being used as an anode. For example, the first electrode 6014 may be formed using a single-layer film of one or more of TiN, ZrN, Ti, W, Ni, Pt, Cr, Ag, Al and the like, a stacked-layer structure of a titanium nitride film and a film mainly containing aluminum, or a three-layer structure of a titanium nitride film, a film mainly containing aluminum and a titanium nitride film.

The second electrode 6016 is formed by using a material or with a thickness to transmit light, and can be formed by using a metal having a low work function, an alloy, an electrically conductive compound, or a mixture of them. Specifically, an alkali metal such as Li and Cs, an alkaline earth metal such as Mg, Ca and Sr, an alloy containing such metals (Mg Ag, Al:Li, Mg:In, or the like), a compound of such metals ($CaF_2$ or $Ca_3N_2$), or a rare-earth metal such as Yb and Er can be employed. In the case where an electron injection layer is provided, a conductive layer such as an Al layer can be employed instead. The second electrode 6016 is formed thin enough to transmit light (preferably about 5 to 30 nm). Note that the second electrode 6016 may also be formed by using a light transmitting conductive oxide such as indium tin oxide (ITO), zinc oxide (ZnO), indium zinc oxide (IZO), and gallium-doped zinc oxide (GZO). Alternatively, the second electrode 6016 may be formed by using zinc oxide containing silicon oxide, indium tin oxide containing silicon oxide (ITSO), or a mixture of ITSO and 2 to 20% of zinc oxide (ZnO). In the case where such a light transmitting conductive oxide is employed, an electron injection layer is preferably provided in the electroluminescent layer 6015.

The electroluminescent layer 6015 can be formed similarly to the electroluminescent layer 6005 shown in FIG. 10A.

In the pixel shown in FIG. 10B, light emitted from the light emitting element 6013 can be extracted from the second electrode 6016 side as shown by a hollow arrow.

FIG. 10C is a cross-sectional view of a pixel where a TFT 6021 is a P-channel type and light emitted from a light emitting element 6023 is extracted from both a first electrode 6024 side and a second electrode 6026 side. The first electrode 6024 of the light emitting element 6023 is electrically connected to the TFT 6021 in FIG. 10C. On the first electrode 6024, an electroluminescent layer 6025 and the second electrode 6026 are stacked in this order.

The first electrode 6024 can be formed similarly to the first electrode 6004 shown in FIG. 10A while the second electrode 6026 can be formed similarly to the second electrode 6016 shown in FIG. 10B. The electroluminescent layer 6025 can be formed similarly to the electroluminescent layer 6005 shown in FIG. 10A.

In the pixel shown in FIG. 10C, light emitted from the light emitting element 6023 can be extracted from both the first electrode 6024 side and the second electrode 6026 side as shown by hollow arrows.

This embodiment mode can be freely combined with the above-described embodiment modes.

Embodiment Mode 8

In this embodiment mode, a cross-sectional structure of a pixel where a transistor for controlling current supply to a light emitting element is an N-channel type is described with reference to FIGS. 11A to 11C. Note that a first electrode is a cathode while a second electrode is an anode in FIGS. 11A to 11C; however, it is possible that the first electrode is an anode while the second electrode is a cathode.

Figure 11A:
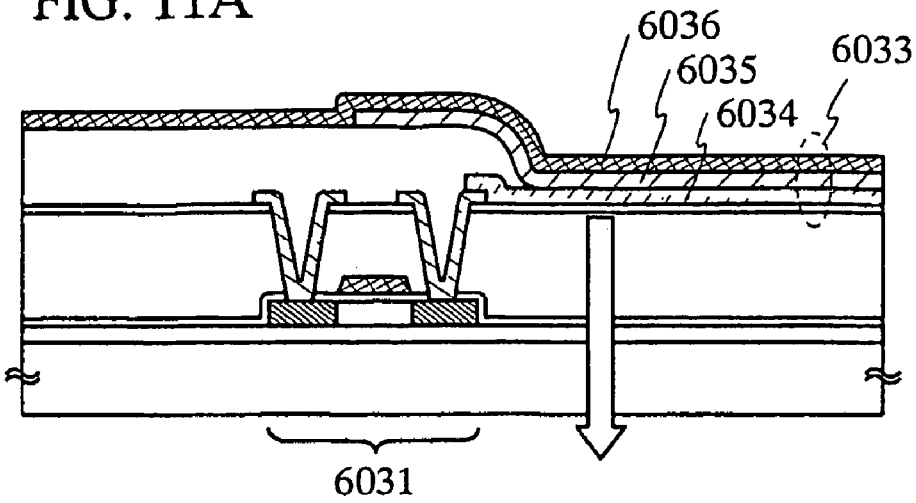
FIGS. 11A to 11C are cross-sectional views of a pixel in the light emitting device of the invention.

FIG. 11A is a cross-sectional view of a pixel where a TFT 6031 is an N-channel type and light emitted from a light emitting element 6033 is extracted from a first electrode 6034 side. The first electrode 6034 of the light emitting element 6033 is electrically connected to the TFT 6031 in FIG. 11A. On the first electrode 6034, an electroluminescent layer 6035 and a second electrode 6036 are stacked in this order.

The first electrode 6034 is formed by using a material or with a thickness to transmit light, and can be formed by using a metal having a low work function, an alloy, an electrically conductive compound, or a mixture of them. Specifically, an alkali metal such as Li and Cs, an alkaline earth metal such as Mg, Ca and Sr, an alloy containing such metals (Mg:Ag, Al:Li, Mg:In, or the like), a compound of such metals ($CaF_2$ or $Ca_3N_2$), or a rare-earth metal such as Yb and Er can be employed. In the case where an electron injection layer is provided, a conductive layer such as an Al layer can be employed instead. In addition, the first electrode 6034 is formed thin enough to transmit light (preferably about 5 to 30 nm). Furthermore, a light transmitting conductive layer may be additionally formed using light transmitting conductive oxide so as to contact the top or bottom of the aforementioned conductive layer having a thickness enough to transmit light in order to suppress the sheet resistance of the first electrode 6034. Note that the first electrode 6034 may also be formed using only a conductive layer employing a light transmitting conductive oxide such as indium tin oxide (ITO), zinc oxide (ZnO), indium zinc oxide (IZO), and gallium-doped zinc oxide (GZO). Alternatively, the first electrode 6034 may be formed by using zinc oxide containing silicon oxide, indium tin oxide containing silicon oxide (ITSO), or a mixture of ITSO and 2 to 20% of zinc oxide (ZnO). When such a light transmitting conductive oxide is employed, an electron injection layer is preferably provided in the electroluminescent layer 6035.

The second electrode 6036 is formed by using a material and with a thickness to reflect or shield light, and by using a material suitable for being used as an anode. For example, the second electrode 6036 may be formed using a single-layer film of one or more of TiN, ZrN, Ti, W, Ni, Pt, Cr, Ag, Al and the like, a stacked-layer structure of a titanium nitride film and a film mainly containing aluminum, a three-layer structure of a titanium nitride film, a film mainly containing aluminum and a titanium nitride film, or the like.

The electroluminescent layer 6035 can be formed similarly to the electroluminescent layer 6005 shown in FIG. 10A. When the electroluminescent layer 6035 has any of a hole injection layer, a hole transporting layer, an electron transporting layer and an electron injection layer other than a light emitting layer, the electron injection layer, the electron transporting layer, the light emitting layer, the hole transporting layer and the hole injection layer are stacked in this order on the first electrode 6034.

In the pixel shown in FIG. 11A, light emitted from the light emitting element 6033 can be extracted from the first electrode 6034 side as shown by a hollow arrow.

Figure 11B:
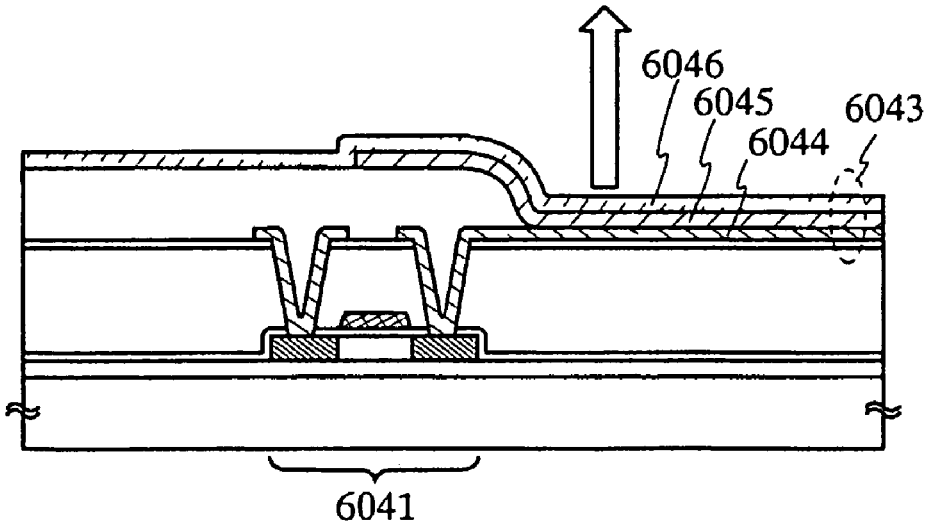

FIG. 11B is a cross-sectional view of a pixel where a TFT 6041 is an N-channel type and light emitted from a light emitting element 6043 is extracted from a second electrode 6046 side. A first electrode 6044 of the light emitting element 6043 is electrically connected to the TFT 6041 in FIG. 11B. On the first electrode 6044, an electroluminescent layer 6045 and the second electrode 6046 are stacked in this order.

The first electrode 6044 is formed by using a material and with a thickness to reflect or shield light, and can be formed by using a metal having a low work function, an alloy, an electrically conductive compound, or a mixture of them. Specifically, an alkali metal such as Li and Cs, an alkaline earth metal such as Mg, Ca and Sr, an alloy containing such metals (Mg:Ag, Al:Li, Mg:In, Or the like), a compound of such metals ($CaF_2$ or $Ca_3N_2$), a rare-earth metal such as Yb and Er, or the like can be employed. In the case where an electron injection layer is provided, a conductive layer such as an Al layer can be employed instead.

The second electrode 6046 is formed by using a material or with a thickness to transmit light, and by using a material suitable for being used as an anode. For example, a light transmitting conductive oxide such as indium tin oxide (ITO), zinc oxide (ZnO), indium zinc oxide (IZO), and gallium-doped zinc oxide (GZO) can be employed. Alternatively, the second electrode 6046 may be formed by using zinc oxide containing silicon oxide, indium tin oxide containing silicon oxide (ITSO), or a mixture of ITSO and 2 to 20% of zinc oxide (ZnO). Further, other than the aforementioned light transmitting conductive oxide, the second electrode 6046 may be formed by using, for example, a single-layer film of one or more of TiN, ZrN, Ti, W, Ni, Pt, Cr, Ag, Al and the like, a stacked-layer structure of a titanium nitride film and a film mainly containing aluminum, or a three-layer structure of a titanium nitride film, a film mainly containing aluminum and a titanium nitride film. It is to be noted that when such a material other than the light transmitting conductive oxide is employed, the second electrode 6046 is formed thin enough to transmit light (preferably about 5 to 30 nm).

The electroluminescent layer 6045 can be formed similarly to the electroluminescent layer 6035 shown in FIG. 11A.

In the pixel shown in FIG. 11B, light emitted from the light emitting element 6043 can be extracted from the second electrode 6046 side as shown by a hollow arrow.

Figure 11C:
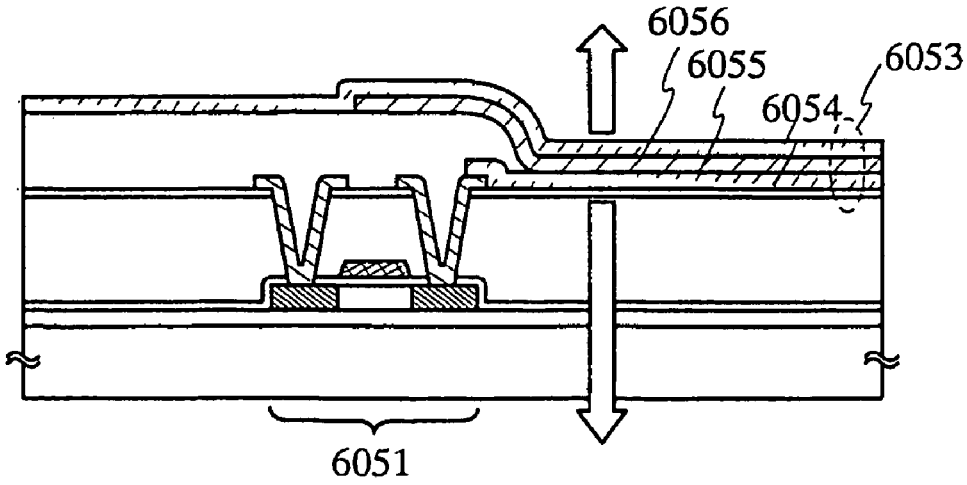

FIG. 11C is a cross-sectional view of a pixel where a TFT 6051 is an N-channel type and light emitted from a light emitting element 6053 is extracted from both a first electrode 6054 side and a second electrode 6056 side. The first electrode 6054 of the light emitting element 6053 is electrically connected to the TFT 6051 in FIG. 11C. On the first electrode 6054, an electroluminescent layer 6055 and the second electrode 6056 are stacked in this order.

The first electrode 6054 can be formed similarly to the first electrode 6034 shown in FIG. 11A while the second electrode 6056 can be formed similarly to the second electrode 6046 shown in FIG. 11B. The electroluminescent layer 6055 can be formed similarly to the electroluminescent layer 6035 shown in FIG. 11A.

In the pixel shown in FIG. 11C, light emitted from the light emitting element 6053 can be extracted from both the first electrode 6054 side and the second electrode 6056 side as shown by hollow arrows.

This embodiment mode can be freely combined with the above-described embodiment modes.

Embodiment Mode 9

Described in this embodiment mode is the case where the light emitting device is manufactured by a printing method typified by screen printing and offset printing, or a droplet discharge method. The droplet discharge method is a method for forming a predetermined pattern by ejecting droplets containing a predetermined composition from a minute hole, which includes an ink-jet method. When using such a printing method or a droplet discharge method, various wirings typified by a signal line, a scan line, and a selection line, a gate of a TFT, an electrode of a light emitting element, and the like can be formed without using an exposure mask. However, the printing method or the droplet discharge method is not necessarily used for the whole process of forming a pattern. For example, it is possible that the printing method or the droplet electing method is used for at least a part of the process and a lithography method is additionally used as follows: wirings and a gate are formed by the printing method or the droplet discharge method while a semiconductor film is patterned by the lithography method. Note that a mask for patterning may be formed by a printing method or a droplet discharge method.

Figure 12:
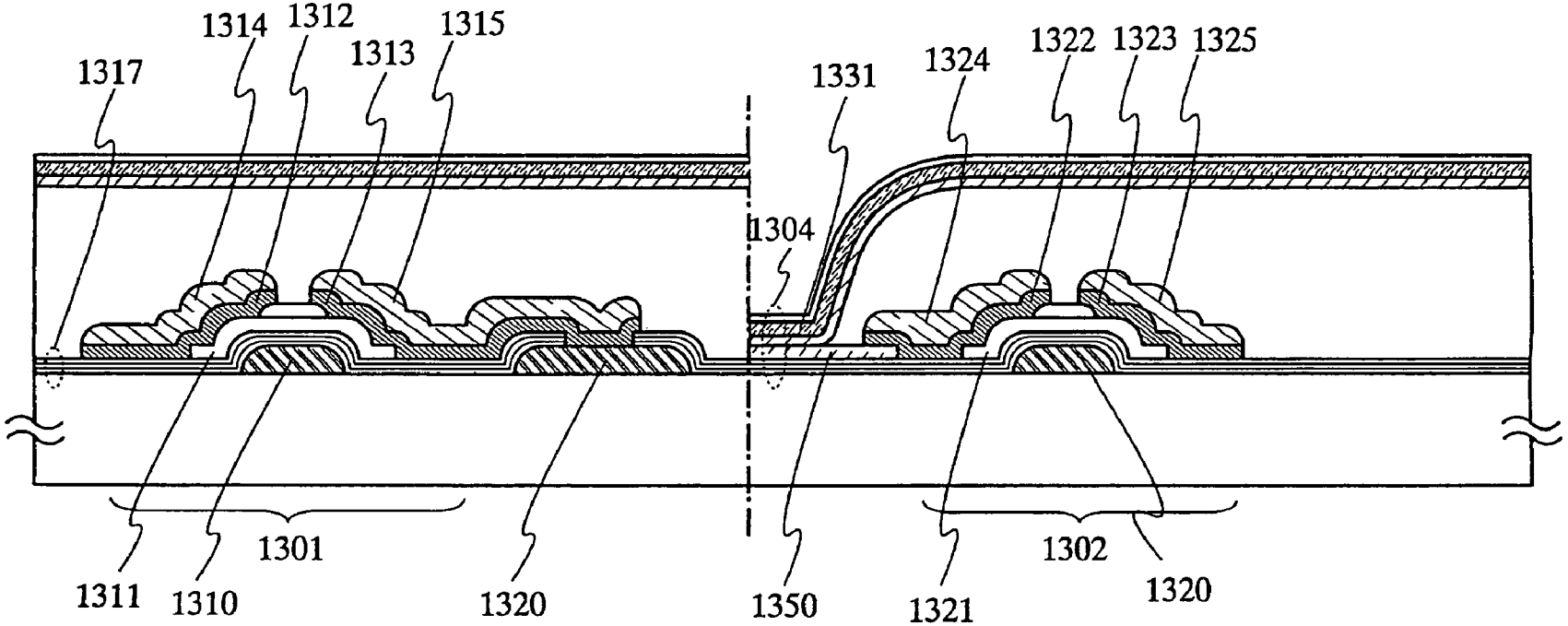
FIG. 12 is a cross-sectional view of a pixel in the light emitting device of the invention.

FIG. 12 is an exemplary cross-sectional view of a light emitting device of the invention formed using a droplet discharge method. Reference numerals 1301 and 1302 each denote a TFT, 1304 denotes a light emitting element in FIG. 12. The TFT 1302 is electrically connected to a first electrode 1350 of the light emitting element 1304. The TFT 1302 is preferably an N-channel type, and in which case it is preferable that the first electrode 1350 is a cathode while a second electrode 1331 is an anode.

The TFT 1301 functioning as a switching element has a gate 1310, a first semiconductor film 1311 including a channel formation region, a gate insulating film 1317 formed between the gate 1310 and the first semiconductor film 1311, second semiconductor films 1312 and 1313 functioning as a source or a drain, a wiring 1314 connected to the second semiconductor film 1312, and a wiring 1315 connected to the second semiconductor film 1313.

The TFT 1302 has a gate 1320, a first semiconductor film 1321 including a channel formation region, the gate insulating film 1317 formed between the gate electrode 1320 and the first semiconductor film 1321, second semiconductor films 1322 and 1323 functioning as a source or a drain, a wiring 1324 connected to the second semiconductor film 1322, and a wiring 1325 connected to the second semiconductor film 1323.

The wiring 1314 corresponds to a signal line, and the wiring 1315 is electrically connected to the gate 1320 of the TFT 1302. The wiring 1325 corresponds to a power supply line.

By forming a pattern using a droplet discharge method or a printing method, a series of steps for a lithography method that includes photoresist formation, exposure, development, etching, and peeling can be simplified. In addition, the droplet discharge method or the printing method can avoid waste of materials that would be removed by etching unlike the case of a lithography method. Further, since an expensive mask for exposure is not required, manufacturing cost of the light emitting device can be suppressed.

Furthermore, unlike a lithography method, etching is not required in order to form wirings. Accordingly, a step of forming wirings can be completed in an extremely shorter time than the case of the lithography method. In particular, when the wiring is formed with a thickness of 0.5 μm or more, preferably 2 μm or more, the wiring resistance can be suppressed. Accordingly, the increase of the wiring resistance along with the enlargement of the light emitting device can be suppressed while shortening time required for the step of forming wirings.

The first semiconductor films 1311 and 1321 may be either an amorphous semiconductor or a semi-amorphous semiconductor (SAS).

An amorphous semiconductor can be obtained by decomposing a silicon-source gas by glow discharge. As the typical silicon-source gas, $SiH_4$ or $Si_2H_6$ can be employed. The silicon-source gas may be diluted with hydrogen, or hydrogen and helium.

Similarly, an SAS can be obtained by decomposing a silicon-source gas by glow discharge. As the typical silicon-source gas, $SiH_4$ can be used as well as $Si_2H_6$, $SiH_2Cl_2$, $SiHCl_3$, $SiCl_4$, $SiF_4$, or the like. The SAS can be formed easily by diluting the silicon-source gas with a hydrogen gas or a mixed gas of hydrogen and one or more of rare-gas elements selected among helium, argon, krypton, and neon. The silicon-source gas is preferably diluted at a rate of 1:2 to 1:1000. Further, the silicon-source gas may be mixed with a carbon-source gas such as $CH_4$ and $C_2H_6$, a germanium-source gas such as $GeH_4$ and $GeF_4$, $F_2$, or the like such that the energy bandwidth is to be 1.5 to 2.4 eV, or 0.9 to 1.1 eV. A TFT using an SAS as the first semiconductor film can exhibit the mobility of 1 to 10 $cm^2$/Vsec or more.

The first semiconductor films 1311 and 1321 may also be formed by using a semiconductor obtained by crystallizing an amorphous semiconductor or a semi-amorphous semiconductor (SAS). For example, an amorphous semiconductor or an SAS is crystallized by using a laser or a heating furnace.

This embodiment mode can be freely combined with the above-described embodiment modes.

Embodiment Mode 10

Figure 13A:
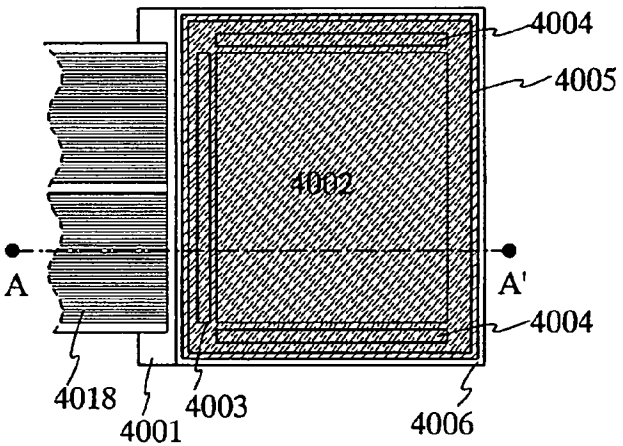
FIG. 13A is a top plan view of the light emitting device of the invention and FIG. 13B is a cross-sectional view thereof.
Figure 13B:
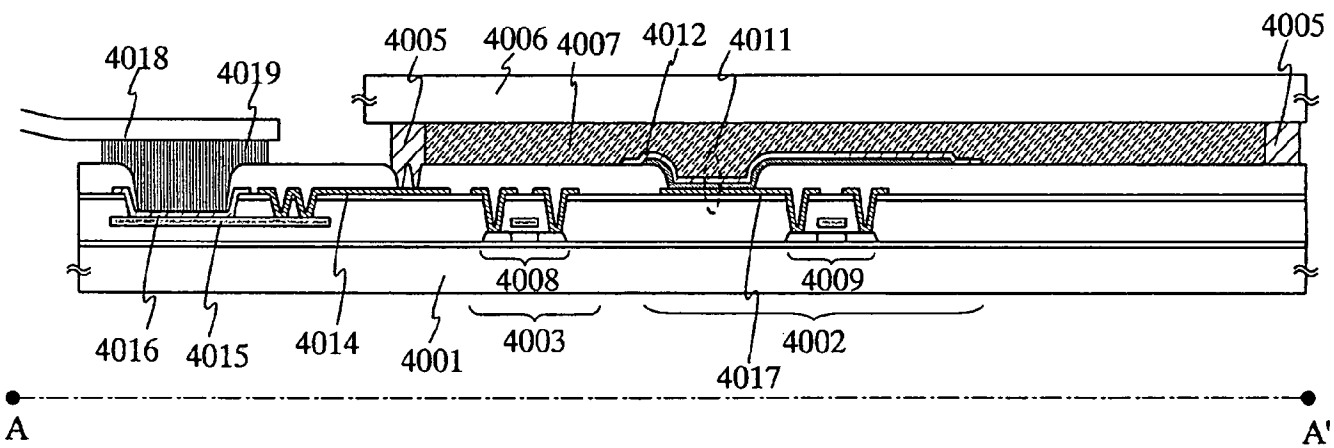

An exterior view of a panel which corresponds to one mode of the light emitting device of the invention is described in this embodiment mode with reference to FIGS. 13A and 13B. FIG. 13A is a top plan view of a panel where TFTs and light emitting elements formed over a first substrate are sealed with a sealant between the first substrate and a second substrate. FIG. 13B is a cross-sectional view of FIG. 13A cut along a line A-A'.

A pixel portion 4002, a signal line driver circuit 4003 and a scan line driver circuit 4004 are provided over a first substrate 4001, and a sealant 4005 is provided so as to surround at least the pixel portion 4002. In addition, a second substrate 4006 is provided over at least the pixel portion 4002 with the sealant 4005 interposed therebetween. The pixel portion 4002, the signal line driver circuit 4003, and the scan line driver circuit 4004 are tightly sealed by the first substrate 4001, the sealant 4005 and the second substrate 4006 together with a filling material 4007 in the light emitting device shown in FIGS. 13A and 13B.

Each of the pixel portion 4002, the signal line driver circuit 4003, and the scan line driver circuit 4004 formed over the first substrate 4001 includes a plurality of TFTs. A TFT 4008 included in the signal line driver circuit 4003 and a TFT 4009 included in the pixel portion 4002 are illustrated in FIG. 13B.

Reference numeral 4011 denotes a light emitting element, and a wiring 4017 connected to a drain of the TFT 4009 functions partially as a first electrode of the light emitting element 4011. A light transmitting conductive film 4012 functions as a second electrode of the light emitting element 4011. Note that the light emitting element 4011 is not limited to the structure described in this embodiment mode, and the structure thereof can be appropriately changed in accordance with the extraction direction of light emitted from the light emitting element 4011, the polarity of the TFT 4009, and the like.

Various signals and voltage are supplied to the signal line driver circuit 4003, the scan line driver circuit 4004 and the pixel portion 4002 from a connecting terminal 4016 through lead wirings 4014 and 4015, though not shown in the cross-sectional view of FIG. 13B.

In this embodiment mode, the connecting terminal 4016 is formed using the same conductive film as the first electrode of the light emitting element 4011. The lead wiring 4014 is formed using the same conductive film as the wiring 4017. The lead wiring 4015 is formed using the same conductive film as respective gate electrodes of the TFTs 4009 and 4008.

The connecting terminal 4016 is electrically connected to a terminal of an FPC 4018 through an anisotropic conductive film 4019.

The first substrate 4001 and the second substrate 4006 may be formed by using glass, metal (typically, stainless), ceramics, or plastics. As for the plastic, an FRP (Fiberglass-Reinforced Plastics) plate, a PVF (Polyvinylfluoride) film, a mylar film, a polyester film or an acrylic resin film can be employed. In addition, a sheet having such a structure that aluminum is sandwiched by PVF films or mylar films can be employed as well.

It should be noted that the substrate disposed on the side from which light emitted from the light emitting element 4011 is extracted, is required to transmit light. In this case, a light transmitting material is employed such as a glass substrate, a plastic substrate, a polyester film and an acrylic film.

As for the filling material 4007, other than an inert gas such as nitrogen and argon, an ultraviolet curable resin or a heat curable resin can be used, and for example, PVC (polyvinyl chloride), acrylic, polyimide, an epoxy resin, a silicone resin, PVB (polyvinyl butyral) or EVA (ethylene vinyl acetate) can be used. Nitrogen is used as the filling material in this embodiment mode.

This embodiment mode can be freely combined with the above-described embodiment modes.

Embodiment Mode 11

The display device of the invention can suppress generation of a pseudo contour, which is suitable for display portions of portable electronic apparatuses such as a portable phone, a portable game machine or an electronic book, a video camera, and a digital still camera. In addition, since the display device of the invention can prevent a pseudo contour, the invention is suitable for electronic apparatuses having a display portion, such as a display device for image display by which moving images can be reproduced.

Further, the display device of the invention can be applied to electronic apparatuses such as a video camera, a digital camera, a goggle type display (a head mounted display), a navigation system, a sound reproducing device (e.g., car audio system and audio component system), a notebook personal computer, a game machine, an image reproducing device equipped with a recording medium (typically, a device reproducing a recording medium such as a DVD (Digital Versatile Disk) and having a display for displaying the reproduced image). Specific examples of such electronic apparatuses are illustrated in FIGS. 14A to 14C.

Figure 14A:
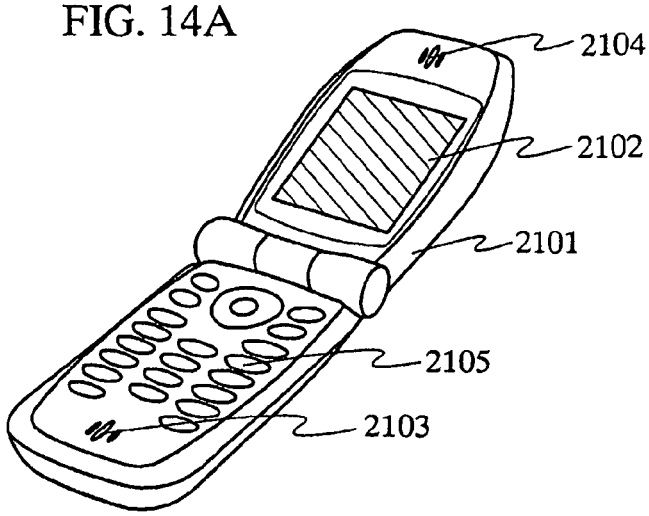
FIGS. 14A to 14C are views of electronic apparatuses of the invention.

FIG. 14A illustrates a portable phone which includes a main body 2101, a display portion 2102, an audio input portion 2103, an audio output portion 2104, and an operating key 2105. A portable phone that is one of the electronic apparatuses of the invention can be completed by forming the display portion 2102 using the display device of the invention.

Figure 14B:
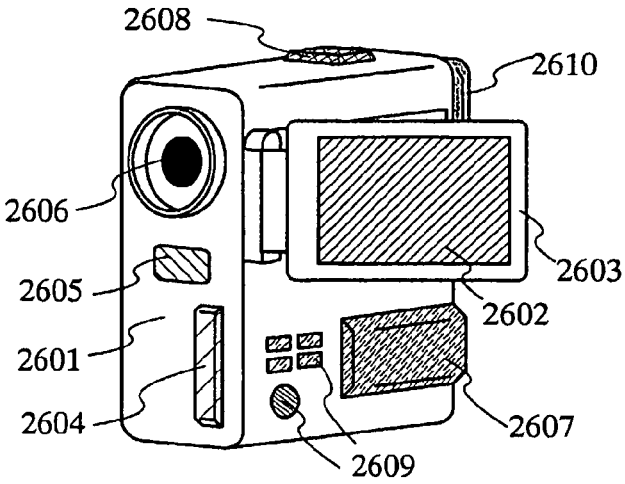

FIG. 14B illustrates a video camera which includes a main body 2601, a display portion 2602, a housing 2603, an external connection port 2604, a remote control receiving portion 2605, an image receiving portion 2606, a battery 2607, an audio input portion 2608, operating keys 2609, and an eyepiece portion 2610. A video camera that is one of the electronic apparatuses of the invention can be completed by forming the display portion 2602 using the display device of the invention.

Figure 14C:
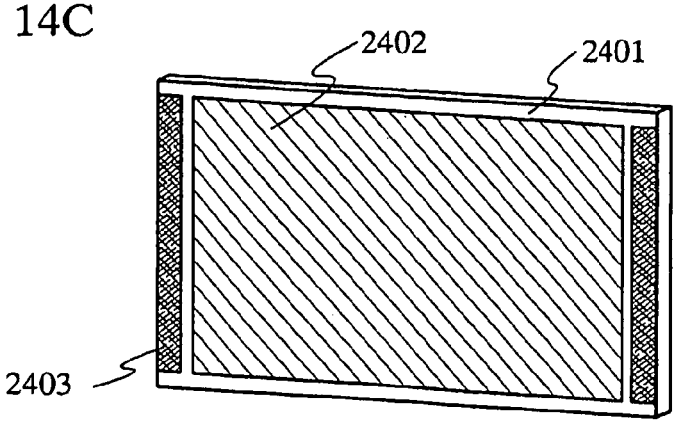

FIG. 14C illustrates a display device which includes a housing 2401, a display portion 2402, and a speaker portion 2403. A display device that is one of the electronic apparatuses of the invention can be completed by forming the display portion 2402 using the display device of the invention. Note that the display device includes in its category any display device for displaying information such as for a personal computer, for receiving TV broadcast, and for displaying advertisement.

As set forth above, the application range of the invention is so wide that it can be applied to electronic apparatuses in various fields. This embodiment mode can be freely combined with the above-described embodiment modes.

EMBODIMENT

Embodiment 1

Described in this embodiment is a test for inspecting a relationship between the sharing ratio and generation of a pseudo contour.

The inventor conducted the following test to inspect a relationship between the sharing ratio and generation of a pseudo contour.

Figure 3:
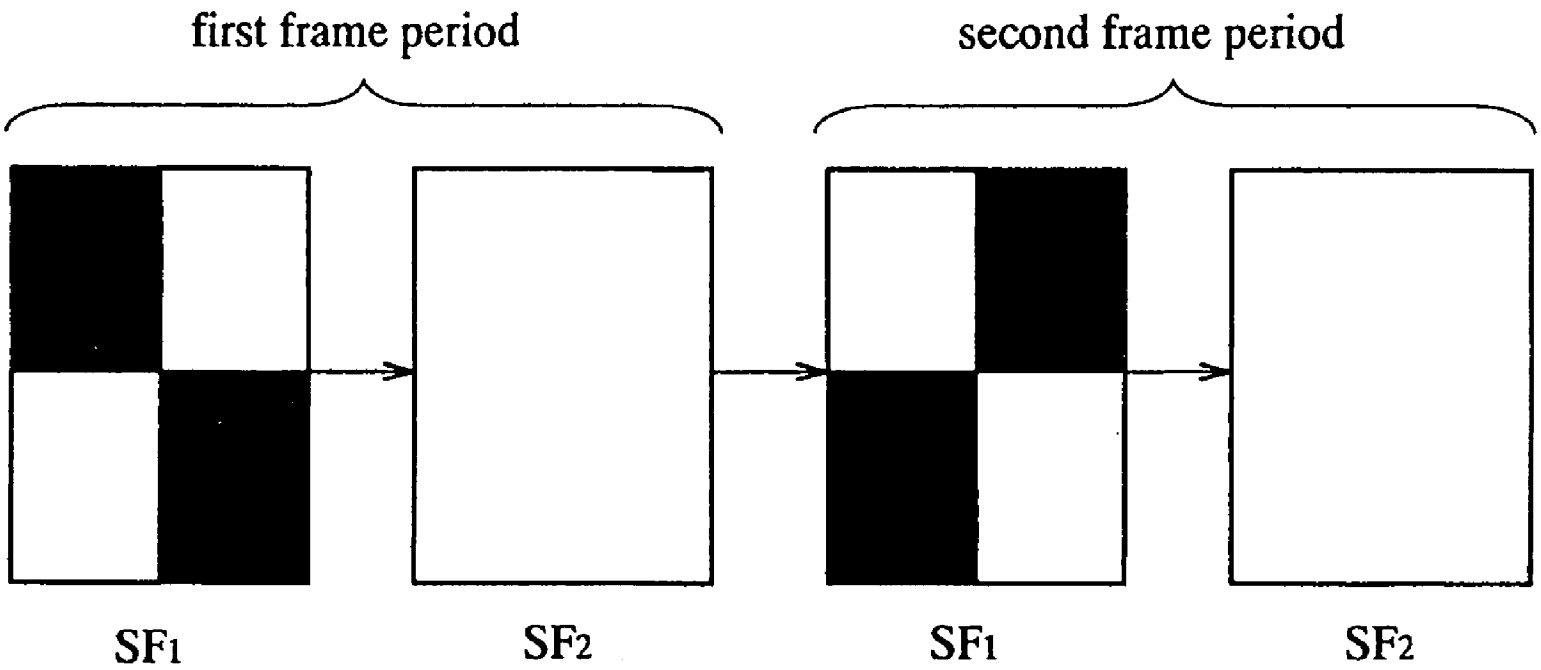
FIG. 3 is a diagram showing patterns used for display in a test carried out for inspecting a relationship between a sharing ratio and generation of a pseudo contour.

First, one frame period is divided into two subframe periods $SF_1$ and $SF_2$, and patterns shown in FIG. 3 are displayed in a first frame period and a second frame period. Specifically, a checkered pattern is displayed in the subframe period $SF_1$ and white is displayed in the entire region in the subframe period $SF_2$. It should be noted here that the pattern displayed in the subframe period $SF_1$ is inverted with respect to a white region and a black region in the first frame period and the second frame period.

Figure 4:
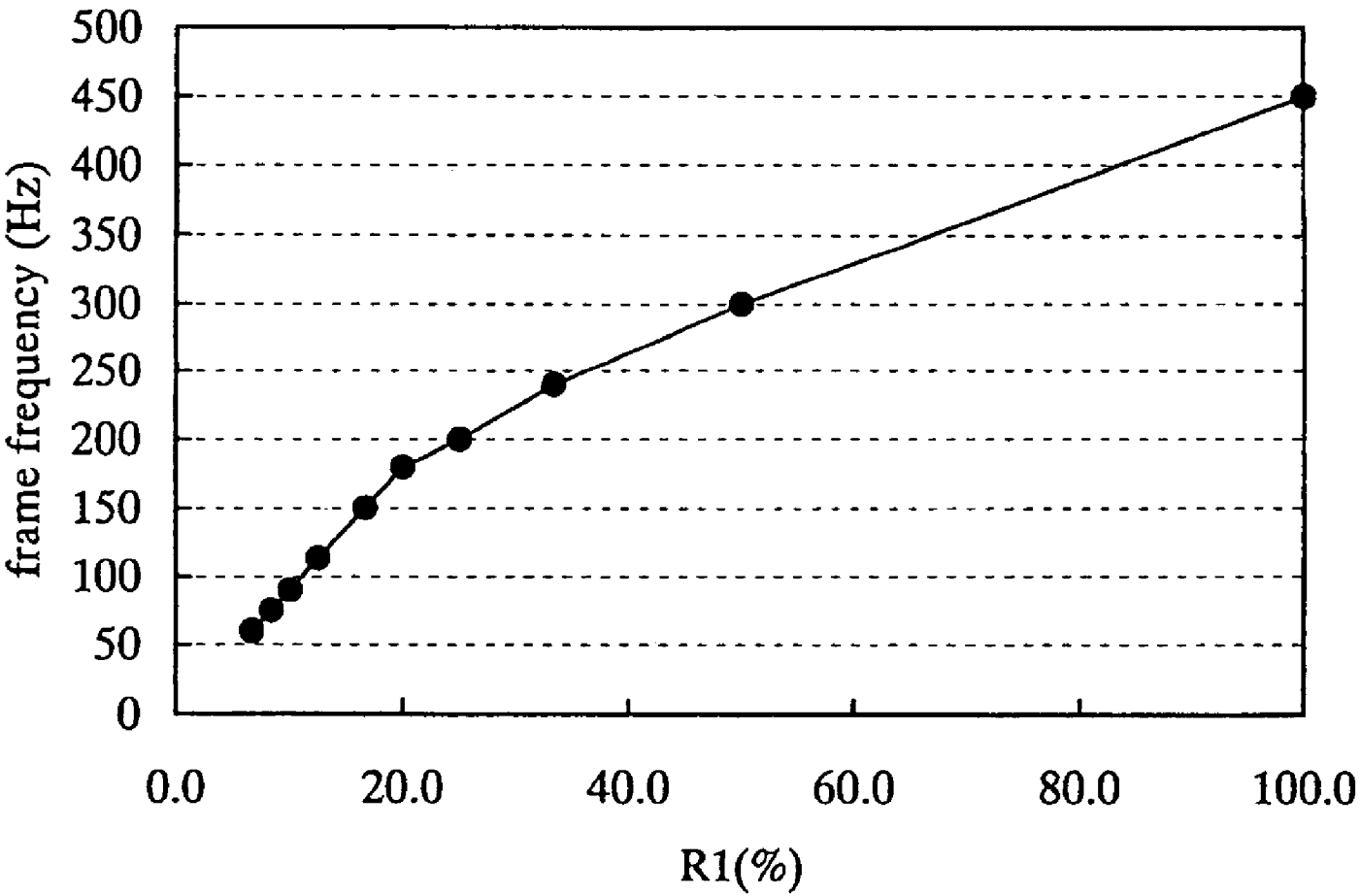
FIG. 4 is a graph showing a relationship between $R_1$ (%), which denotes a rate of a subframe period SF1 in one frame period, and the minimum frame frequency F with which generation of a pseudo contour is perceived.

Then, the two frame periods are set to appear alternatively. In this manner, generation of a pseudo contour was inspected. When a rate of the subframe period $SF_1$ within one frame period is denoted by $R_1$(%), $R_1$(%) and the minimum frame frequency F (Hz) with which generation of a pseudo contour is perceived has a relationship shown in FIG. 4. The display pattern in the subframe period $SF_1$ is different per frame period as shown in FIG. 3. As shown in FIG. 4, as the $R_1$(%) is lower, that is, as the length ratio of a subframe period for displaying a different pattern is smaller, the minimum frame frequency F (Hz) with which generation of a pseudo contour is perceived is lower. To the contrary, as the $R_1$(%) is higher, the minimum frame frequency F (Hz) with which generation of a pseudo contour is perceived is higher.

In other words, as the subframe period $SF_1$ is shorter per adjacent subframe periods, a pseudo contour is less generated. Meanwhile, as the subframe period $SF_2$ in which the display pattern is the same is longer per two frame periods, a pseudo contour is less generated. It this state, the rate of a subframe period $SF_2$ for light emission which appears in common in two frame periods is high, which means the sharing ratio is high.

According to the above-described test result, it was confirmed that the higher the sharing ratio in adjacent frame periods is, the more generation of a pseudo contour can be suppressed. Note that the sharing ratio (%) corresponds to 100-$R_1$(%).

Embodiment 2

The constant subframe ratio $R_{SF}$ is applied to all of $SF_n$ to $SF_1$ respectively in the above-described embodiment; however, the invention is not limited to this structure. For example, the number of subframe periods is not necessarily limited to n even in the case where the total gray scale level is 2″. When the length calculated following Formula 9 is applied to each subframe period, the number of subframe periods results in more than n in many cases. However, as for a short subframe period for displaying a low gray scale, it does not affect generation of a pseudo contour even if the aforementioned value of the sharing ratio $R_{sh}$ is not satisfied. The reason is as follows: in the case of a low gray scale level, a value (the rate of a gray scale level) obtained by a reciprocal of the gray scale level×100 is larger than the case of a high gray scale level. Therefore, a contour due to a difference between gray scale levels is perceived, which makes a pseudo contour to be less perceived.

Figure 15:
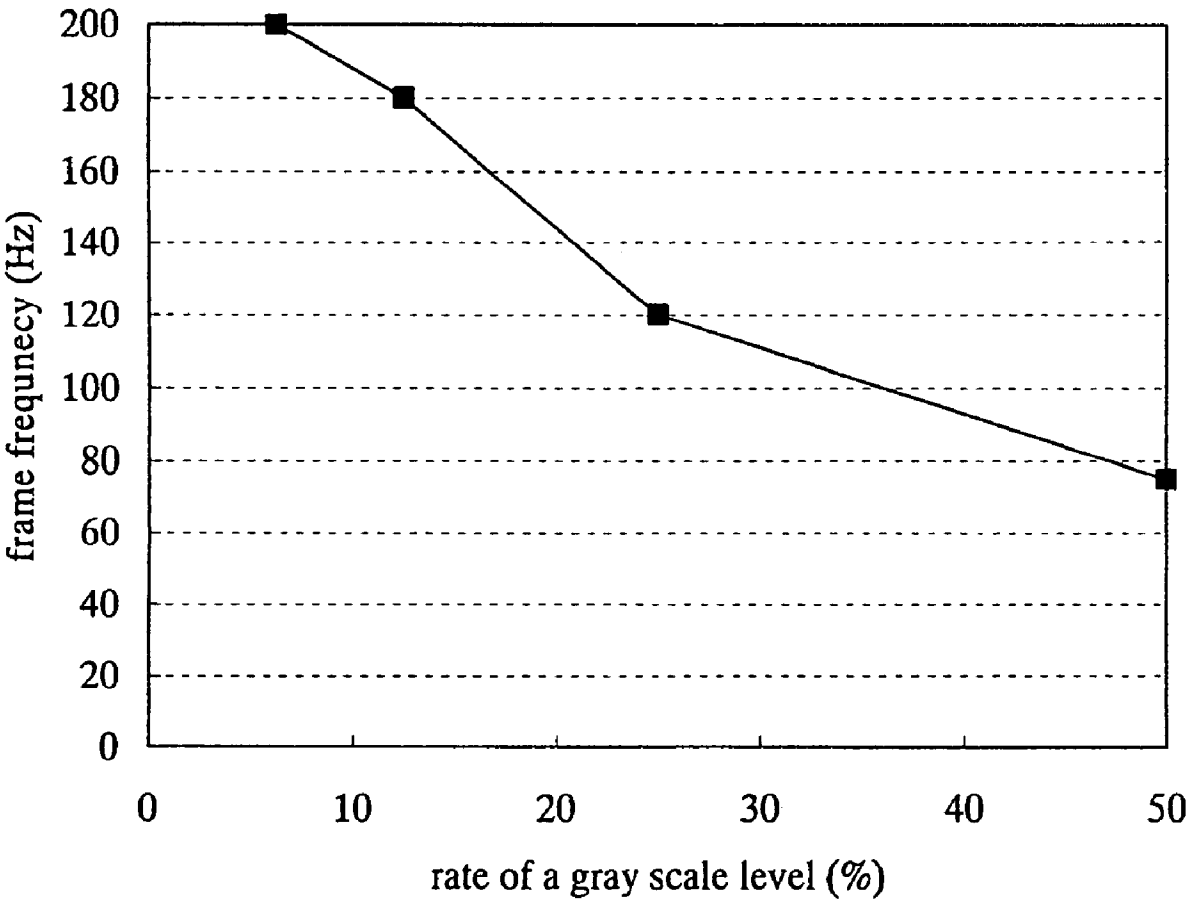
FIG. 15 is a graph showing a relationship between the rate of a gray scale level and the minimum frame frequency with which generation of a pseudo contour is perceived.

For description thereof, a relationship between the rate of a gray scale level (%) and the minimum frame frequency F (Hz) with which generation of a pseudo contour is perceived was inspected, results of which are shown in FIG. 15. The abscissa axis in FIG. 15 indicates the rate of a gray scale level (%), and the ordinate axis indicates the minimum frame frequency F (Hz) with which generation of a pseudo contour is perceived. It can be confirmed from FIG. 15 that as the rate of a gray scale level (%) is higher, that is, as the gray scale level is lower, the frame frequency with which generation of a pseudo contour can be suppressed is lower. Therefore, the sharing ratio is not necessarily satisfied in a short subframe period for displaying a low gray scale level.

In view of the foregoing, it is preferable to focus on decrease of the operating frequency of a driver circuit, rather than to provide many short subframe periods having no effect on generation of a pseudo contour; therefore, it is preferable that a short subframe period is removed and the sharing ratio is satisfied in the rest subframe periods. By calculation, in the case where a plurality of short subframe periods each corresponding to 1 gray scale is provided, the sharing ratio is not required to be satisfied in one or several of the subframe periods.

Specifically, the total gray scale level is divided equally into three, and a value of the sharing ratio $R_{sh}$ is not necessarily required to be satisfied in the lowest gray scale group among them; to the contrary, the value of the sharing ratio $R_{sh}$ is satisfied in the middle and the highest gray scale groups among them. For example, in the case where the total gray scale level is $2^6$ (=64), the 0-th to 63-th gray scale level is divided equally into three, resulting in 21. In this case, the lowest gray scale level is the 0-th to 21-th gray scale level, the middle gray scale level is the 22-th to 42-th gray scale level, and the highest gray scale level is the 43-th to 63-th gray scale level. Note that when the total gray scale level cannot be divided equally into three, a fraction thereof may be rounded up or down.

Embodiment 3

Specific timing charts and tables thereof in the case where four tables are provided are described in this embodiment mode.

Figure 18:
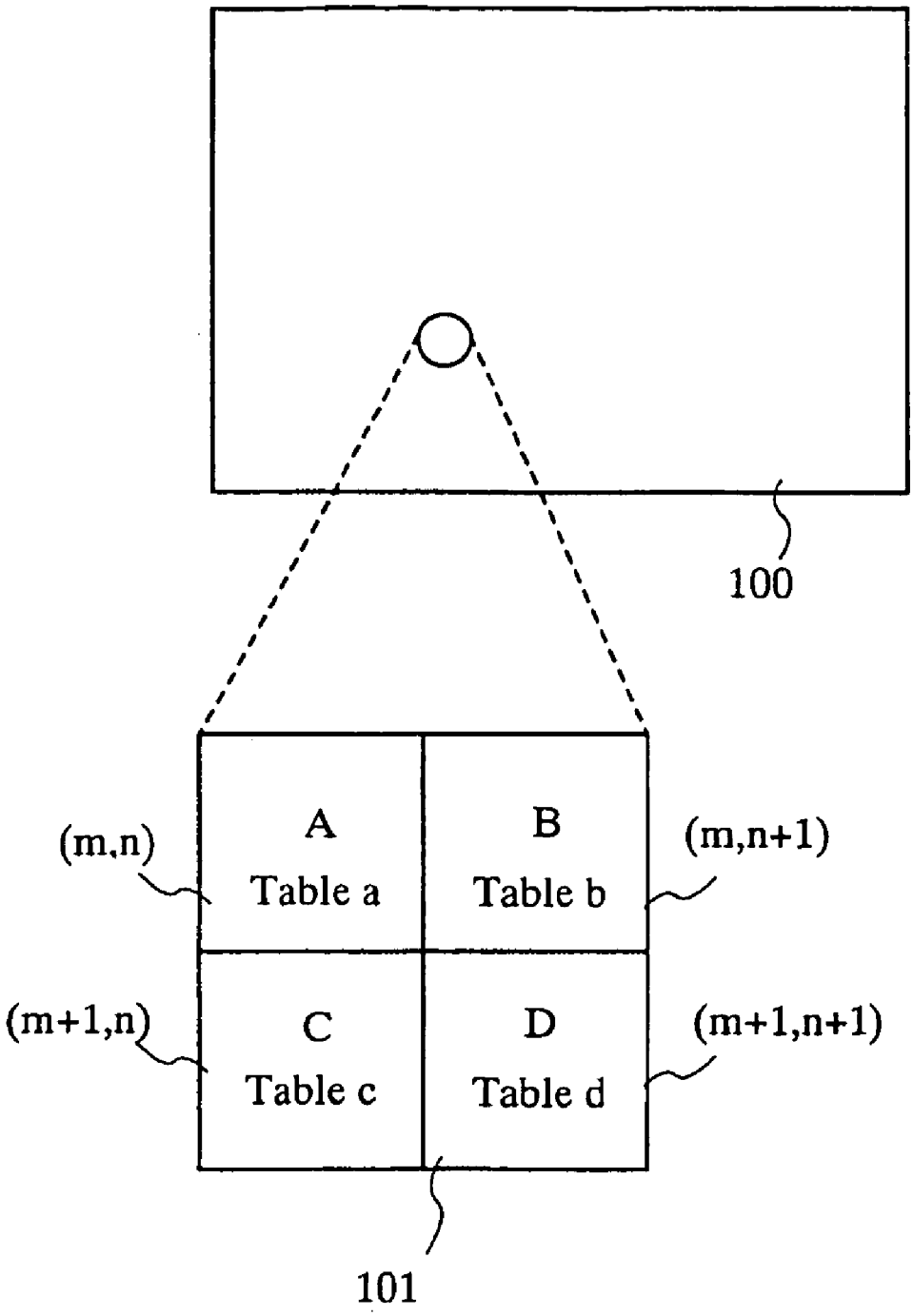
FIG. 18 is a diagram showing a pixel portion and a table of the invention.

The pixel portion 100 includes the plurality of pixels 101 as shown in FIG. 18. Pixels (A), (B), (C), and (D) are focused on among the pixels 101, provided that their positions are denoted by (m, n), (m, n+1), (m+1, n), and (m+1, n+1) respectively. It is to be noted that m is an arbitrary pixel number of the pixel portion in the row direction while n is an arbitrary pixel number of the pixel portion in the column direction.

Described hereinafter are timing charts and tables in the case where the pixels (A), (B), (C), and (D) arranged adjacently in rectangular shape.

Figures 19A, 19B, 19C, 19D, 19E:
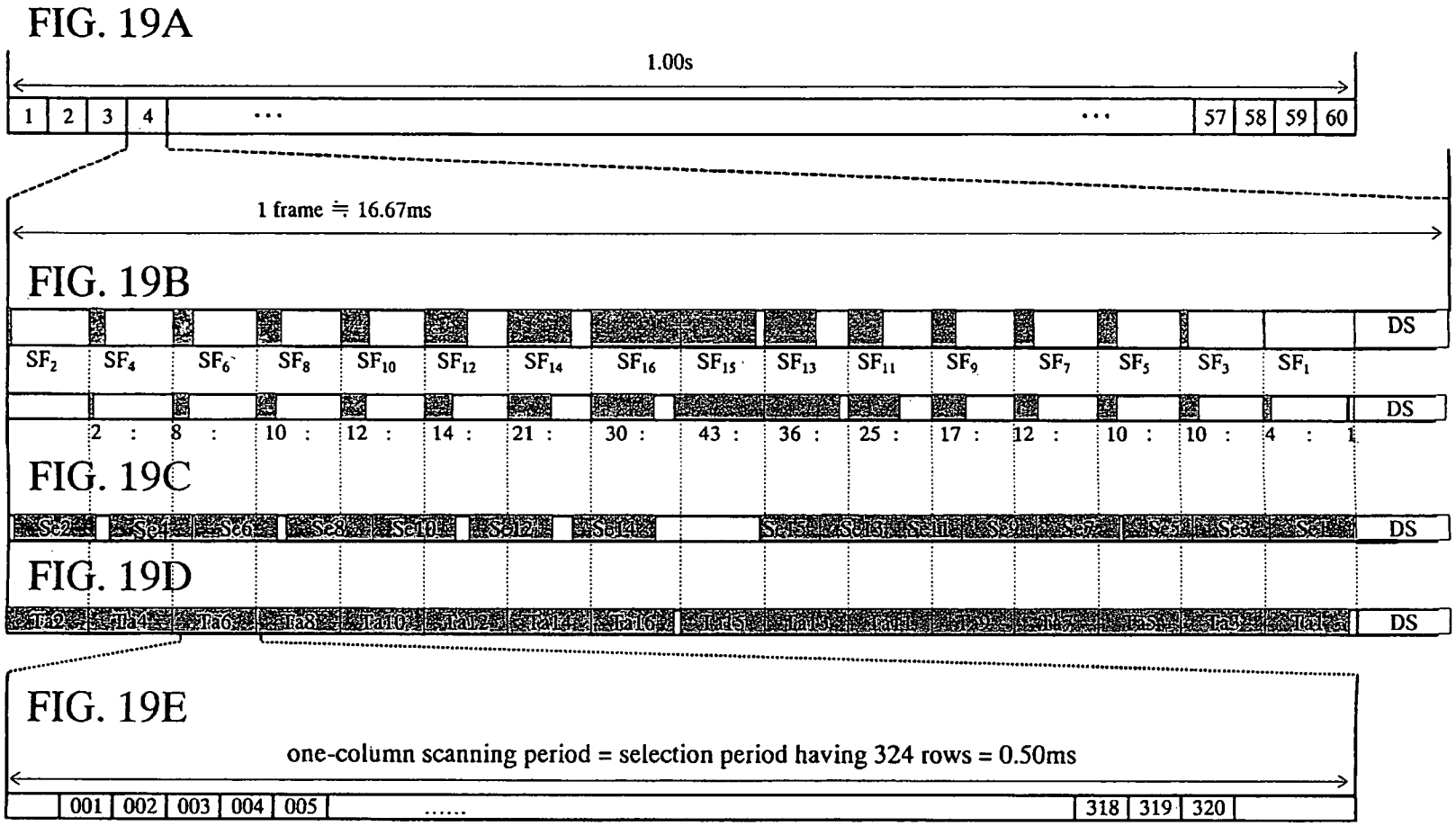
FIGS. 19A to 19E are diagrams showing timing charts of the invention.

FIGS. 19A to 19E are timing charts. Since the frame frequency is 60 Hz, 60 frames appear per second and the length of one frame period here is about 16.67 ms. 16 subframe periods are provided in one frame period and these subframe periods appear at random within the frame period. The subframe periods $SF_1$ to $SF_{16}$ appear in the following order in this embodiment: $SF_2$, $SF_4$, $SF_6$, $SF_8$, $SF_{10}$, $SF_{12}$, $SF_{14}$, $SF_{16}$, $SF_{15}$, $SF_{13}$, $SF_{11}$, $SF_9$, $SF_7$, $SF_5$, $SF_3$, and $SF_1$. The length ratio of the subframe periods is set to be $SF_1$:$SF_2$:$SF_3$:$SF_4$:$SF_5$:$SF_6$:$SF_7$:$SF_8$:$SF_9$:$SF_{10}$:$SF_{11}$:$SF_{12}$:$SF_{13}$:$SF_{14}$:$SF_{15}$:$SF_{16}$=1:2:4:8:10:10:10:12:12:14:17:21:25:30:36:43. Display is performed in pixels sequentially from the first row to the last row as shown in FIG. 19B. Below the display in the pixels of the last row shown in FIG. 19B, the length ratio of the subframe periods is described.

FIG. 19C shows timing of scanning by a scan line driver circuit for erasing. In this embodiment, erasing periods Se1 to Se15 are provided in the subframe periods SF1 to SF15 respectively.

FIG. 19D shows timing of scanning by a scan line driver circuit for writing. Writing periods Ta1 to Ta16 are provided in the subframe periods respectively.

One-column scanning period is provided in one writing period as shown in FIG. 19E, and in which all rows (324 rows in this embodiment) are selected.

It is to be noted that one frame period includes a reverse-voltage applying period (a DS period). By applying a reverse voltage to a light emitting element, degradation state of the light emitting element is improved and the reliability can be enhanced. The light emitting element may have an initial defect that an anode and a cathode thereof are short-circuited due to adhesion of foreign substances, some pinholes that are produced by minute projections of the anode or the cathode, or nonuniformity of the electroluminescent layer. Such an initial defect is eliminated by applying the reverse voltage, which leads to favorable image display. Note that the insulation of the short-circuited portion is preferably performed before shipping.

Subframe periods can be selected among these subframe periods in order to display a certain gray scale such as $SF_5$, $SF_6$, and $SF_7$, or $SF_8$ and $SF_9$. Therefore, a plurality of tables can be provided.

FIGS. 1 to 4 show specific examples of a table in the case of the above-described timing charts. Noted here that "0" denotes a non-light emission state and "1" denotes a light emission state in Tables a to d shown in FIGS. 1 to 4.

Each of Tables a to d each are a kind of look-up table and is structured by hardware such as a memory of a ROM, a RAM, or the like. Needless to say, data of the table is not limited to Tables a to d, and it can be set arbitrarily depending on the power consumption and the image quality.

As seeing the subframe ratio at the 191-th gray scale level in Tables a to d, it is seen that subframe periods for light emission are different per table.

As set forth above, a plurality of tables is provided, and correspondingly to them combination of adjacent pixels is specified; for example, if there are four tables, such combination of pixels (A) to (D) as shown in FIG. 18 can be specified. That is, it is preferable that the number of tables is equal to the number of pixels for forming combination. In other words, Tables a to d are selected among a plurality of tables each storing data for determining a subframe period for light emission, which are provided for pixels (A) to (D) arranged so as to be adjacent to at least two pixel each other, as follows: Table a is provided for the pixel (A), Table b is provided for the pixel (B), Table c is provided for the pixel (C), and Table d is provided for the pixel (D).

It is to be noted that the pixel arrangement is not limited to that shown in FIG. 18. For example, in the case where four pixels segmented as one combination is provided with four tables like the case of FIG. 18, the pixels (A) to (D) may be arranged in vertical direction or in horizontal direction; however, at least two pixels of them provided with different tables are required to be adjacent to each other.

Accordingly, a subframe period being selected in displaying a certain gray scale can be different in adjacent pixels. As a result, the gray scale level where a pseudo contour tends to be generated easily can be spatially dispersed. Note that the gray scale level where a pseudo contour tends to be generated easily has a low sharing ratio, and corresponds to the middle or high gray scale level.

One frame period is divided into 16 subframe periods in the case of a frame frequency of 60 Hz in the timing charts described in this embodiment; however, the number of subframe periods may be changed depending on the frame frequency.

Furthermore, as described in the above-described embodiment mode, a table corresponding to each pixel is not required to be fixed but may be changed per frame period. That is, a table storing data for determining a subframe period for light emission may be changed per frame period.

The invention claimed is:

1. A display device comprising:

a plurality of tables which stores data for determining how to combine a plurality of subframe periods for light emission;

a controller for outputting a video signal in accordance with the data; and a pixel portion including pixels of which gray scale level is controlled in accordance with the outputted video signal, wherein tables used for determining combinations of the plurality of subframe periods are different between adjacent pixels in the pixel portion, wherein the number and length of the plurality of subframe periods are determined in accordance with a subframe ratio $R_{SF}$ calculated from a sharing ratio $R_{sh}$, and wherein the subframe ratio $R_{SF}$ and the sharing ratio $R_{sh}$ satisfy $R_{SF}=(1-R_{sh})/(2-R_{sh})$.

2. A display device, wherein one frame period includes a plurality of subframe periods, comprising:

a plurality of tables which stores data for determining how to combine the plurality of subframe periods for light emission among the plurality of subframe periods;

a controller for outputting a video signal in accordance with the data; and a pixel portion including pixels of which gray scale level is controlled in accordance with the outputted video signal, wherein tables used for determining combinations of the plurality of subframe periods are different between adjacent pixels in the pixel portion, wherein a table corresponding to a pixel is different per frame period, wherein the number and length of the plurality of subframe periods are determined in accordance with a subframe ratio $R_{SF}$ calculated from a sharing ratio $R_{sh}$, and wherein the subframe ratio $R_{SF}$ and the sharing ratio $R_{sh}$ satisfy $R_{SF}=(1-R_{sh})/(2-R_{sh})$.

3. A display device according to claim 1, wherein the plurality of tables, when a total gray scale level is equally divided into three, each satisfy the number and length of the plurality of subframe periods determined in accordance with the subframe ratio $R_{SF}$ at a middle gray scale level and a highest gray scale level.

4. A display device according to claim 2, wherein the plurality of tables, when a total gray scale level is equally divided into three, each satisfy the number and length of the plurality of subframe periods determined in accordance with the subframe ratio $R_{SF}$ at a middle gray scale level and a highest gray scale level.

5. A display device according to claim 1, wherein combination of the plurality of subframe periods determined for displaying a certain gray scale is different among the plurality of tables.

6. A display device according to claim 2, wherein combination of the plurality of subframe periods determined for displaying a certain gray scale is different among the plurality of tables.

7. A display device according to claim 1, wherein the plurality of tables is stored in a memory.

8. A display device according to claim 2, wherein the plurality of tables is stored in a memory.

9. An electronic apparatus having the display device according to claim 1, wherein the electronic apparatus is an selected from the group consisting of a camera such as a digital camera and a video camera, a goggle type display, a navigation system, a sound reproducing device, a notebook personal computer, a game machine, an image reproducing device equipped with a recording medium, and a portable phone.

10. An electronic apparatus having the display device according to claim 2, wherein the electronic apparatus is an selected from the group consisting of a camera such as a digital camera and a video camera, a goggle type display, a navigation system, a sound reproducing device, a notebook personal computer, a game machine, an image reproducing device equipped with a recording medium, and a portable phone.

11. A driving method of a display device, comprising the steps of:

having at least a first pixel and a second pixel adjacent to each other;

providing for the first pixel a first table selected among a plurality of tables which stores data for determining how to select a subframe plurality of periods for light emission and providing for the second pixel a second table selected among the plurality of tables;

storing the number and length of the plurality of subframe periods, which are determined in accordance with a subframe ratio $R_{SF}$ calculated from a sharing ratio $R_{sh}$, each in the plurality of tables; and being combination of the plurality of subframe periods for determining for a certain gray scale display different among the plurality of tables, wherein the sharing ratio $R_{sh}$ and the subframe ratio $R_{SF}$ satisfy $R_{SF}=(1-R_{sh})/(2-R_{sh})$.

12. A driving method of a display device according to claim 11, wherein the plurality of tables, when a total gray scale level is equally divided into three, each satisfy the number and length of the plurality of subframe periods determined in accordance with the subframe ratio $R_{SF}$ at a middle gray scale level and a highest gray scale level.

13. A driving method of a display device according to claim 11, wherein the first table and the second table are changed per frame period having the plurality of subframe periods.

* * * * *